US006992428B2

(12) United States Patent
Kyogaku et al.

(10) Patent No.: US 6,992,428 B2
(45) Date of Patent: Jan. 31, 2006

(54) ELECTRON EMITTING DEVICE, ELECTRON SOURCE AND IMAGE DISPLAY DEVICE AND METHODS OF MANUFACTURING THESE DEVICES

(75) Inventors: Masafumi Kyogaku, Kanagawa (JP); Hironobu Mizuno, Kanagawa (JP); Yasuhiro Hamamoto, Kanagawa (JP); Kazuya Miyazaki, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 143 days.

(21) Appl. No.: 10/321,605

(22) Filed: Dec. 18, 2002

(65) Prior Publication Data

US 2003/0124944 A1 Jul. 3, 2003

(30) Foreign Application Priority Data

Dec. 25, 2001 (JP) ..... 2001-391151
Dec. 25, 2001 (JP) ..... 2001-391154
Dec. 2, 2002 (JP) ..... 2002-349507

(51) Int. Cl.
*H01J 1/02* (2006.01)

(52) U.S. Cl. ..... 313/310; 313/495
(58) Field of Classification Search ..... 313/495, 313/309, 310, 336, 351
See application file for complete search history.

(56) References Cited

U.S. PATENT DOCUMENTS 4,904,895 A 2/1990 Tsukamoto et al. ..... 313/336
4,954,744 A 9/1990 Suzuki et al. ..... 313/336
5,290,610 A 3/1994 Kane et al. ..... 427/577
5,591,061 A 1/1997 Ikeda et al. ..... 445/3
5,622,634 A 4/1997 Noma et al. ..... 216/40
5,674,100 A 10/1997 Ono et al. ..... 445/24
5,847,495 A 12/1998 Yamanobe et al. ..... 313/310
5,986,389 A 11/1999 Tsukamoto ..... 313/310
6,005,334 A 12/1999 Mitome et al. ..... 313/309
6,008,569 A 12/1999 Yamanobe ..... 313/310
6,123,876 A 9/2000 Kobayashi et al. ..... 252/519.2
6,129,602 A 10/2000 Yamanobe ..... 445/24
6,147,449 A 11/2000 Iwasaki et al. ..... 313/495
6,169,356 B1 1/2001 Ohnishi et al. ..... 313/495
6,171,162 B1 1/2001 Iwasaki et al. ..... 445/6
6,179,678 B1 1/2001 Kishi et al. ..... 445/24

(Continued)

FOREIGN PATENT DOCUMENTS

EP 0354750 2/1990
EP 0609532 8/1994

(Continued)

OTHER PUBLICATIONS

A. Baba, et al., *Field Emission form an Ion–Beam–Modified Polyimide Film*, Journal Appl. Phys., vol. 38 (1999), pp. L261–L263.

(Continued)

*Primary Examiner*—Vip Patel
(74) *Attorney, Agent, or Firm*—Fitzpatrick, Cella, Harper & Scinto

(57) ABSTRACT

The present invention provides an electron emitting device including electrodes disposed with a space therebetween on a surface of a substrate, a carbon film disposed between the electrodes and connected to one of the electrodes, and a gap disposed between the carbon film and the other electrode. In the gap, the distance between the edge of the carbon film connected to one of the electrode and the edge of the other electrode at an upper position apart from the surface of the substrate is smaller than that at the surface of the substrate. The present invention also provides an electron source and an image display device each including the electron emitting device.

49 Claims, 39 Drawing Sheets

U.S. PATENT DOCUMENTS

| | | | | |
|---|---|---|---|---|
| 6,184,610 | B1 | 2/2001 | Shibata et al. | 313/309 |
| 6,221,426 | B1 | 4/2001 | Yamanobe | 427/77 |
| 6,231,413 | B1 | 5/2001 | Tsukamoto | 445/24 |
| 6,246,168 | B1 | 6/2001 | Kishi et al. | 313/495 |
| 6,259,191 | B1 | 7/2001 | Mitome et al. | 313/310 |
| 6,334,801 | B1 | 1/2002 | Kawade et al. | 445/24 |
| 6,334,803 | B1 | 1/2002 | Shibata | 445/51 |
| 6,344,711 | B1 | 2/2002 | Ohnishi et al. | 313/495 |
| 6,348,761 | B1 | 2/2002 | Nomura et al. | 313/495 |
| 6,366,015 | B1 | 4/2002 | Shibata | 313/495 |
| 6,380,665 | B1 | 4/2002 | Motoi et al. | 313/310 |
| 6,383,047 | B1 | 5/2002 | Minami et al. | 445/6 |
| 6,384,541 | B1 | 5/2002 | Ohnishi et al. | 315/169.3 |
| 6,409,563 | B1 | 6/2002 | Tamura et al. | 445/3 |
| 6,416,374 | B1 | 7/2002 | Mitome et al. | 445/6 |
| 6,435,928 | B1 | 8/2002 | Tsukamoto | 445/24 |
| 6,472,814 | B1 | 10/2002 | Yamanobe et al. | 313/495 |
| 2002/0000767 | A1 | 1/2002 | Shibata et al. | |
| 2002/0041294 | A1 | 4/2002 | Nomura et al. | |
| 2002/0081931 | A1 | 6/2002 | Iwaki et al. | |
| 2002/0084736 | A1 | 7/2002 | Shibata | |
| 2002/0117670 | A1 | 8/2002 | Horiguchi et al. | |
| 2002/0146958 | A1 | 10/2002 | Ono et al. | |
| 2003/0082981 | A1 | 5/2003 | Takegami et al. | 445/6 |

FOREIGN PATENT DOCUMENTS

| | | |
|---|---|---|
| EP | 0660357 | 6/1995 |
| EP | 0 693 766 A1 | 1/1996 |
| EP | 0701265 | 3/1996 |
| EP | 0 703 594 A1 | 3/1996 |
| EP | 0725413 | 8/1996 |
| EP | 0736890 | 10/1996 |
| EP | 0757371 | 2/1997 |
| EP | 0788130 | 8/1997 |
| EP | 0803890 | 10/1997 |
| EP | 0901144 | 3/1999 |
| EP | 0986085 | 3/2000 |
| EP | 1009009 | 6/2000 |
| EP | 1 184 886 A1 | 3/2002 |
| JP | 64-31332 | 2/1989 |
| JP | 1-279542 | 11/1989 |
| JP | 1-283749 | 11/1989 |
| JP | 1-309242 | 12/1989 |
| JP | 03-046729 | 2/1991 |
| JP | 7-65703 | 3/1995 |
| JP | 7-65704 | 3/1995 |
| JP | 7-235255 | 9/1995 |
| JP | 8-007749 | 1/1996 |
| JP | 8-55563 | 2/1996 |
| JP | 8-102247 | 4/1996 |
| JP | 08-102250 | 4/1996 |
| JP | 8-162002 | 6/1996 |
| JP | 8-264112 | 10/1996 |
| JP | 8-273523 | 10/1996 |
| JP | 8-321254 | 12/1996 |
| JP | 09-055161 | 2/1997 |
| JP | 9-102267 | 4/1997 |
| JP | 9-120067 | 5/1997 |
| JP | 9-161666 | 6/1997 |
| JP | 9-237571 | 9/1997 |
| JP | 10-69850 | 3/1998 |
| JP | 2836015 | 10/1998 |
| JP | 2903295 | 3/1999 |
| JP | 11-120901 | 4/1999 |
| JP | 11-144605 | 5/1999 |
| JP | 2000-231872 | 8/2000 |
| KR | 2000-0058133 | 9/2000 |

OTHER PUBLICATIONS

Minouri Seiji; Graphite Material; Patent Abstracts of Japan; JP3037109; Feb. 18, 1991; vol. 15, No. 167.

H. Pagnia et al.; "Scanning Tunnelling Microscopic Investigation of Electroformed Planar Metal–Insulator–Metal Diodes"; Int. J. Electronics; 1990; vol; 69, No. 1, 25–32.

M. Bischoff et al.; "Energy Distribution of Emitted Electrons From Electroformed MIM Structures the Carbon Island Model"; Int. J. Electronics, 1992; vol. 73, No. 5, 1009–1010.

M. Bischoff et al.; "On the Electron Emissio From Evaporated Thin Au Films"; Physics Letters; vol. 62A, No. 7; Oct. 3, 1977.

R. Blessing et al.; The Electroforming Process in Mim Diodes; Electronics and Optics, Thin Solid Films, 85 (1981), pp. 119–128.

R, Blessing et al.; "Evidence for the Contribution of an Adsorbate to the Voltage–Controlled Negative Resistance of Gold Island Film Diodes"; General Film Behaviour, Thin Films, 78 (1981), pp. 397–401.

R. Mull r et al.; "Water–Influ nced Switching in Discontinuous Au Film Diodes"; Materials Letters; Mar. 1984; vol. 2, No. 4A.

H. Pagnia et al.; Influence of Organic Molecules on the Current–Voltage Characteristic of Planar MIM Diodes; Phys. Stat. Sol. (a) 90,771 (1985).

M. Borbonus et al.; "Influence of Gas Composition on Regeneration in Metal/Insulator/Metal Diodes"; Electronics and Optics, Thin Solid Films, 151 (1987), pp. 333–342.

H. Pagnia; "Prospects for Metal/Non–Metal Microsystems: Sensors, Sources and Switch s"; Int. J. Electronics, 1992; vol. 73, No. 5, pp. 819–825.

M. Bischoff; "Carbon–Nanoslit Model for the Electroforming Process in M–I–M Structures"; Int. J. Electronics, 1991; vol. 70, No. 3, pp. 491–498.

H. Pagnia et al.; "Metal Influence on Switching MIM Diodes"; Phys. Stat. Sol. (a) 111,387 (1989).

M. Hartwell et al.; "Strong Electron Emission from Patterned Tin–Indium Oxide Thin Film"; International Electron Devices Meeting 1975; pp. 519–521.

C.A. Spindt et al.; "Physical Properties of Thin–Film Field Emission Cathodes with Molybdenum Cones"; Journal of Applied Physics; vol. 47, No. 12; Dec. 1976.

W. P. Dyke et al.; "Field Emission"; Advances in Electron and Electron Physics; vol. 8; 1956; pp. 89–185.

C. A. Mead; "Operation of Tunnel–Emission Devices"; Journal of Applied Physics; vol. 32, pp. 646–652, No. 4; Apr. 1961.

M. L. Elinson et al.; "The Emission of Hot Electrons and the Field Emission of Electrons from Tin Oxide"; Radio Engineering and Electronics Physics; Jul. 1965; pp. 1290–1296.

G. Dittmer; "El ctrical Conduction and Electron Emission of Discontinuous Thin Films"; Thin Solid Films; 9 (1972, pp. 317–328.

Hisashi Araki et al., Electroforming and Electron Emission of Carbon Thin Films, Journal of the Vacuum Society of Japan, vol. 2–6, No. 1, 1983, pp. 22–29 (with English Abstract on p. 22).

"Thin Film Handbook", Japan Society for the Promotion of Art and Science. 1983, pp. 1–19.

PRIOR ART

PRIOR ART

ELECTRON EMITTING DEVICE, ELECTRON SOURCE AND IMAGE DISPLAY DEVICE AND METHODS OF MANUFACTURING THESE DEVICES

BACKGROUND OF THE INVENTION

1. Field of the Invention

The present invention relates to an electron emitting device, an electron source, an image display device, and methods of manufacturing these devices.

2. Description of the Related Art

Conventional electron emitting devices are roughly of two types, including thermionic-cathode electron-emitting devices, and cold-cathode electron-emitting devices. Example of cold-cathode electron-emitting devices include a field emission type (referred to as "FE type" hereinafter), a metal/insulator/metal type (referred to as "MIM type" hereinafter), a surface conduction type, and the like, types of electron-emitting devices.

Known examples of FE type devices are disclosed in M. P. Dyke & W. W. Dolan, "Field Emission", Advance in Electron Physics, 8, 89 (1956), C. A. Spindt, "Physical Properties of Thin-Film Field Emission Cathodes with Molybdenum Cones", J. Appl. Phys., 47, 5248 (1976), and Japanese Patent Laid-Open No. 3-46729.

Known examples of MIM type devices are disclosed in C. A. Mead, "Operation of Tunnel-Emission Devices", J. Apply. Phys., 32, 646 (1961), etc.

Examples of surface conduction electron-emitting devices are disclosed in M. I. Elinson, Radio Eng. Electron Phys., 10, 1290 (1965), Japanese Patent Laid-Open Nos. 7-235255, 8-102247, 8-273523, 9-102267, and 2000-231872, and Japanese Patent Application Nos. 2836015 and 2903295.

A surface conduction type of electron-emitting device uses the phenomenon that an electric current is caused to flow through a small-area thin film formed on a substrate in parallel with the film plane to emit electrons. As the surface conduction type of electron-emitting device, a device comprising a $SnO_2$ thin film by Elinson, a device comprising an Au thin film (G. Dittmer: "Thin Solid Films", 9, 317 (1972)), a device comprising an $In_2O_3/SnO_2$ thin film (M. Hartwell and C. G. Fonstad: "IEEE Trans. EDConf." 519 (1975)), and a device comprising a carbon thin film (Hisashi Araki, et al: "Shinku" (Vacuum), Vol. 26, No. 1, p. 22 (1983)) are known.

An electron source substrate comprising a plurality of the above-described electron-emitting devices can be combined with an image forming member comprising a fluorescent material or the like to obtain an image forming apparatus.

However, in the surface conduction type of electron-emitting devices, stable electron emission performance and electron emission efficiency are not necessarily obtained. Therefore, at present, it can be difficult to provide an image forming apparatus having high accuracy and excellent operation stability by using surface conduction type electron-emitting devices.

Therefore, as disclosed in Japanese Patent Laid-Open Nos. 7-235255, 8-264112, and 8-321254, a device subjected to a "forming step" may be subjected to a treatment called an "activation step". The "activation step" represents a step of significantly changing a device current If and an emission current Ie.

Like the "forming step", the "activation step" can be performed by repeatedly applying a pulse voltage to the device in an atmosphere containing an organic material. In this step, carbon or a carbon compound is deposited in the gaps and near the gaps formed in the "forming step" from the organic material present in the atmosphere. Consequently, the device current If and the emission current Ie are significantly changed to obtain higher electron emission performance. Furthermore, Japanese Patent Laid-Open No. 8-321254 discloses another method for improving the electron emission performance by a step different from the "activation step" disclosed in the above publications.

FIGS. 40A and 40B schematically show the general construction of a surface conduction type of electron-emitting device formed by the "activation step" disclosed in the above publications. FIGS. 40A and 40B are respectively a plan view and a sectional view of the electron-emitting device disclosed in the above publications.

In FIGS. 40A and 40B, reference numeral 131 denotes a substrate, reference numerals 132 and 133 denote a pair of electrodes (device electrodes), reference numeral 134 denotes a conductive film, reference numeral 135 (FIG. 40B) denotes a second gap, reference numeral 136 denotes a carbon film, and reference numeral 137 denotes a first gap.

FIG. 41 consisting of FIGS. 41A to 41D schematically shows an example of a process for forming an electron emitting device having the structure shown in FIGS. 40A and 40B.

First, the pair of electrodes 132 and 133 is formed on the substrate 131 (FIG. 41A).

Then, the conductive film 134 is formed for connecting the electrodes 132 and 133 (FIG. 41B).

Then, in a "forming step", a current is passed between the electrodes 132 and 133 to form the second gap 135 in the conductive film 134 (FIG. 41C).

Furthermore, in an "activation step", a voltage is applied across the electrodes 132 and 133 in a carbon compound atmosphere to form the carbon film 136 within the gap 135 on the substrate 131 and on the conductive film 134 near the gap 135, to form the electron-emitting device (FIG. 41D).

On the other hand, Japanese Patent Laid-Open No. 9-237571 discloses a method of manufacturing an electron-emitting device. The method comprises a step of coating an organic material such as a thermosetting resin, or the like on a conductive film and a step of carbonizing the coating, instead of the "activation step" in which a pulse voltage is repeatedly applied between electrodes in an atmosphere containing an organic material to deposit carbon and/or a carbon compound on a device.

SUMMARY OF THE INVENTION

However, conventional devices have the following two main problems:

1) It is not necessarily easy to form a conductive film with a high accuracy in the films thickness and quality, thereby deteriorating uniformity in forming many electron-emitting devices in a flat panel display.

2) In order to form a narrow gap having good electron emission performance, many additional steps need to be performed such as a step of forming an atmosphere containing an organic material, a step of precisely forming a polymer film on a conductive film, etc., thereby complicating control of each of the steps.

Furthermore, in an image forming apparatus comprising plural electron-emitting devices, the electron emission performances of the electron-emitting devices must be made uniform to provide for a stable display. However, the conventional surface conduction type of electron-emitting devices have the following problems:

In the surface conduction type of electron-emitting device, an electron emission portion is formed by the "forming step" (and the "activation step"), but the position of the electron emission portion varies according to various circumstances during formation.

However, in an electron source comprising a plurality of electron-emitting devices respectively having the electron emission portions formed at different positions, when a voltage with the same polarity is applied to each of the devices, significant non-uniformity occurs in the amounts of the electrons emitted. In some cases, an image forming apparatus using such an electron source causes non-uniformity in brightness.

Therefore, it is preferred to use electron-emitting devices comprising an electron emission section formed at predetermined positions. However, the formation position of a conventional electron emission portion of a conventional electron-emitting device cannot be sufficiently easily controlled.

In the conventional device, as shown in FIG. 41D, in addition to the "forming step", the "activation step" is further performed to form the carbon film 136 composed of carbon or a carbon compound and having the first narrower gap 137 in the second gap 135 formed by the "forming step", to achieve good electron emission performance.

However, a method of manufacturing an image forming apparatus using the conventional electron-emitting devices has the following problems:

Each of the "forming step" and the "activation step" comprises many additional steps such as repeated current supplying steps, a step of forming a preferred atmosphere in each step, etc., thereby complicating control of each of the steps.

When the electron-emitting devices are used for an image forming apparatus such as a display or the like, a further improvement in the electron emission properties is desired for decreasing the power consumption of the apparatus.

Accordingly, the present invention has been achieved for solving the above problems, and it is an object of the present invention to provide a method of manufacturing an electron emitting device, a method of manufacturing an electron source, and a method of manufacturing an image forming apparatus, which are capable of simplifying a process for manufacturing an electron-emitting device, and of improving electron emission properties.

The present invention has been achieved as a result of extensive research for solving the above problems, and constructions of devices according to the present invention are as follows.

In a first aspect of the present invention, an electron-emitting device comprises:

first and second electrodes (first and second electroconductive films) disposed with a space therebetween on a surface of a substrate;

a carbon film disposed between the first and second electrodes on the surface of the substrate, and connected to the second electrode; and a gap defined between the first electrode and the carbon film connected to the second electrode;

wherein within the gap, the space between a surface of the carbon film and a surface of the first electrode at an upper position apart from the surface of the substrate is smaller than that at the surface of the substrate, and the surface of the first electrode is partially exposed in the gap.

The electron-emitting device further comprises another carbon film disposed on the first electrode. In this embodiment, an interface between the first electrode and the another carbon film is exposed in the gap. Also in this case, in a plane which is substantially perpendicular to the surface of the substrate, and which passes through the first and second electrodes, the height of the another carbon film on the first electrode from the surface of the substrate is larger than the height of the carbon film connected to the second electrode relative to the surface of the substrate. That is, a distance between an upper surface of the another carbon film from an upper surface of the substrate is greater than a distance between the upper surface of the substrate between the electrodes and an upper surface of the carbon film which is disposed between the electrodes.

Furthermore, the end surface of the carbon film connected to the second electrode faces the first electrode in at least a portion of the gap.

In another embodiment of the present invention, an electron-emitting device comprises first and second electrodes disposed on a surface of a substrate, and a carbon film having a gap and disposed between the first and second electrodes on the surface of the substrate so that one end covers a portion of the first electrode, and the other end covers a portion of the second electrode, wherein a part of a surface of the first electrode is exposed in the gap, and the width of the gap at an upper position apart from the surface of the substrate is smaller than that at the surface of the substrate.

In the electron-emitting device, the part of the surface of the carbon film faces the first electrodes in at least a portion of the gap. Furthermore, an interface between the first electrode and a portion of the carbon film positioned on the first electrode is exposed in the gap.

In a still another embodiment of the present invention, an electron-emitting device comprises first and second electrodes disposed with a space therebetween on a surface of a substrate, a carbon film disposed between the first and second electrodes on the surface of the substrate so that one end portion of the carbon film covers a portion of the second electrode, and a gap defined at least by the other end portion of the carbon film and the first electrode.

Furthermore, the distance between the other end portion of the carbon film and the first electrode at an upper position apart from the surface of the substrate is smaller than that at the surface of the substrate. Also, another the carbon film is disposed on the first electrode.

In a plane which is substantially perpendicular to the surface of the substrate, and which passes through the first and second electrodes, the height of the another carbon film on the first electrode from the surface of the substrate is larger than the height of the carbon film, which is disposed between the first and second electrodes on the surface of the substrate (to cover a portion of the second electrode) relative to the surface of the substrate. That is, a distance between an upper surface of the another carbon film from an upper surface of the substrate is greater than a distance between the upper surface of the substrate between the electrodes and an upper surface of the carbon film which is disposed between the electrodes.

Furthermore, in at least a portion of the gap, the carbon film connected to the second electrode faces the first electrode.

In a till further embodiment of the present invention, an electron-emitting device comprises first and second electrodes disposed on a surface of a substrate, and a carbon film having a gap and disposed between the first and second electrodes on the surface of the substrate so that one end of the film covers a portion of the first electrode, and the other end covers a portion of the second electrode, wherein at least part of a surface of the first electrode is exposed in the gap.

In the electron-emitting device according to this embodiment, the interface between the first electrode and a portion of the carbon film covering the first electrode is exposed in the gap.

In a further embodiment of the present invention, an electron-emitting device comprises first and second electrodes disposed on a surface of a substrate, and a carbon film disposed between the first and second electrodes on the surface of the substrate so that one end portion of the film covers a portion of the second electrode, wherein another end portion of the carbon film faces the first electrode with a space interposed therebetween.

Also, the other end portion of the carbon film is spaced apart from the surface of the substrate, and another carbon film which is disposed on the first electrode. Furthermore, in a plane which is substantially perpendicular to the surface of the substrate, and which passes through the first and second electrodes, the height of the another carbon film on the first electrode from the surface of the substrate is larger than the height of the carbon film, which is disposed between the first and second electrodes on the surface of the substrate (to cover a portion of the second electrode) relative to the surface of the substrate. That is, a distance between an upper surface of the another carbon film from an upper surface of the substrate is greater than a distance between the upper surface of the substrate between the electrodes and an upper surface of the carbon film which is disposed between the electrdoes.

Each of the above electron-emitting devices of the present invention is preferably further characterized in that at least a portion of the surface of the substrate, which is positioned within (adjacent) the gap, is concave (or includes a depressed or recessed portion), a plurality of electron emission sections (referred to as "electron emission points" or "electron emission sites") are disposed in the gap, that a voltage is applied across the first and second electrodes to exhibit an asymmetric electron emission property according to the direction of an electric field applied between the first and second electrodes, and a width of the gap, in a direction of which the first and second electrodes are facing, is 50 nm or less, preferably 10 nm or less, and more preferably 5 nm or less.

In a further aspect of the present invention, a method of manufacturing an electron-emitting device comprises the steps of:

forming a pair of electrodes and a polymer film for connecting the electrodes on a substrate;

decreasing a resistance of the polymer film; and forming a gap in a film obtained by decreasing the resistance of the polymer film;

wherein in the step of forming the gap, a current is supplied, through the pair of electrodes, to the film obtained by decreasing the resistance of the polymer film so that the Joule heat generated near an end of one of the electrodes is hither than the Joule heat generated near an end of another one of the electrodes.

In a further aspect of the present invention, a method of manufacturing an electron-emitting device comprises the steps of:

forming a pair of electrodes and a polymer film for connecting the electrodes on a substrate so that a contact resistance between one of the electrodes and the polymer film is different from the contact resistance between another one of the electrodes and the polymer film;

decreasing a resistance of the polymer film; and forming a gap in a film obtained by decreasing the resistance of the polymer film;

wherein the gap is formed by supplying a current, through the pair of electrodes, to the film obtained by decreasing the resistance of the polymer film.

In a further aspect of the present invention, a method of manufacturing an electron-emitting device comprises the steps of:

forming, on a substrate, a pair of electrodes and a polymer film for connecting the electrodes by covering a portion of each of the electrodes;

decreasing a resistance of the polymer film; and forming a gap in a film obtained by decreasing the resistance of the polymer film;

wherein the polymer film is formed so that the step coverage of a portion partially covering one of the electrodes is different from the step coverage of a portion partially covering the other electrode; and the gap is formed by supplying, through the pair of electrodes, a current to the film obtained by decreasing the resistance of the polymer film.

In a further aspect of the present invention, a method of manufacturing an electron-emitting device comprises the steps of:

forming a pair of electrodes and a polymer film for connecting the electrodes on a substrate so that a structural configuration of one of the electrodes and the polymer film is different from a structural configuration of another one of the electrodes and the polymer film;

decreasing a resistance of the polymer film; and forming a gap in a film obtained by decreasing the resistance of the polymer film;

wherein the gap is formed by supplying, through the pair of electrodes, a current to the film obtained by decreasing the resistance of the polymer film.

In a further aspect of the present invention, a method of manufacturing an electron-emitting device comprises the steps of:

forming a pair of electrodes having different shapes, and a polymer film for connecting the electrodes on a substrate;

decreasing a resistance of the polymer film; and forming a gap in a film obtained by decreasing the resistance of the polymer film;

wherein the gap is formed by supplying, through the pair of electrodes, a current to the film obtained by decreasing the resistance of the polymer film.

Each of the above methods of manufacturing the electron-emitting device according to the present invention is preferably characterized in that the pair of electrodes are formed in different sizes, the pair of electrodes are formed to different thicknesses, and the pair of electrodes are formed so that an angle formed by a side surface of one of the electrodes and the upper surface of the substrate is different from an angle formed by a side surface of another one of the electrodes and the upper surface of the substrate.

In a further aspect of the present invention, a method of manufacturing an electron-emitting device comprises the steps of:

forming a pair of electrodes comprising different materials, and a polymer film for connecting the electrodes on a substrate;

decreasing a resistance of the polymer film; and forming a gap in a film obtained by decreasing the resistance of the polymer film;

wherein the gap is formed by supplying, through the pair of electrodes, a current to the film obtained by decreasing the resistance of the polymer film.

In a further aspect of the present invention, a method of manufacturing an electron-emitting device comprises the steps of:

forming a pair of electrodes having different surface energies on a substrate;

forming a polymer film for connecting the electrodes disposed on the substrate;

decreasing a resistance of the polymer film; and forming a gap in a film obtained by decreasing the resistance of the polymer film;

wherein the polymer film for connecting the electrodes is formed by coating the substrate with a solution of a polymer constituting the polymer film or a solution of a precursor of the polymer, and then heating the substrate with the solution coated thereon, and wherein the gap is formed by supplying, through the pair of electrodes, a current to the film obtained by decreasing the resistance of the polymer film.

In a further aspect of the present invention, a method of manufacturing an electron-emitting device comprises the steps of:

forming a pair of electrodes having different compositions on a substrate;

forming a polymer film for connecting the electrodes disposed on the substrate;

decreasing a resistance of the polymer film; and forming a gap in a film obtained by decreasing the resistance of the polymer film;

wherein the polymer film for connecting the electrodes is formed by coating the substrate with a solution of a polymer constituting the polymer film or a solution of a precursor of the polymer, and then heating the substrate with the solution coated thereon, and wherein the gap is formed by supplying, through the pair of electrodes, a current to the film obtained by decreasing the resistance of the polymer film.

Furthermore, each of the above methods of manufacturing the electron-emitting device of the present invention is preferably characterized in that the pair of electrodes is formed by using a pair of conductive members comprising substantially the same material, and adding a material different from the conductive members to at least one of the pair of conductive members, and that the pair of electrodes is formed by connecting at least one of a pair of conductive members comprising substantially the same material to a member comprising a material having a lower standard electrode potential than that of the material of the conductive members, and heating at least the member comprising a material having a lower standard electrode potential than that of the material of the conductive members.

In a further aspect of the present invention, a method of manufacturing an electron-emitting device comprises the steps of:

forming a pair of electrodes and a polymer film for connecting the electrodes on a substrate so that a connection length (connection interface) between one of the electrodes and the polymer film is different in length from a connection length (connection interface) between another one of the electrodes and the polymer film;

decreasing a resistance of the polymer film; and forming a gap in a film obtained by decreasing the resistance of the polymer film;

wherein the gap is formed by supplying, through the pair of electrodes, a current to the film obtained by decreasing the resistance of the polymer film.

Furthermore, the above method of manufacturing the electron-emitting device of the present invention is preferably characterized in that the connection length represents the length of connection (i.e., the connection interface is) between the polymer film and an end of a corresponding one of the electrodes, and that the connection length represents the length of (i.e., the connection interface is) a portion of contact between the polymer film and at least one of the substrates and a corresponding one of the electrodes.

In a further aspect of the present invention, a method of manufacturing an electron-emitting device comprises the steps of:

forming a pair of electrodes and a polymer film for connecting the electrodes on a substrate;

decreasing a resistance of the polymer film so that the resistance of a portion the film near one of the electrodes is lower than the resistance of another portion of the film near the other electrode; and supplying, through the pair of electrodes, a current to a film obtained by decreasing the resistance of the polymer film to form a gap in the film obtained by decreasing the resistance of the polymer film.

Furthermore, the method of manufacturing the electron-emitting device of the present invention is preferably characterized in that the "resistance decreasing step" comprises the step of heating one of the electrodes to a temperature higher than the temperature of another one of the electrodes or the step of irradiating the polymer film with at least any of electrons, light and ions, the substrate comprises a light-transmitting material so that light is transmitted through the substrate to irradiate one of the electrodes with light, and the step of supplying a current to the film obtained by decreasing the resistance of the polymer film to form the gap in the film is performed at the same time as the "resistance decreasing step".

The preferred conditions of these methods of manufacturing the electron-emitting device of the present invention include the following conditions:

The pair of electrodes is formed in different sizes.

The pair of electrodes is formed in different thicknesses.

The pair of electrodes is formed so that the angle formed by a side surface of one of the electrodes and a plane of an upper surface of the substrate is different from an angle formed by a side surface of the other electrode and the plane of the upper surface of the substrate.

The pair of electrodes is formed by using a pair of conductive members comprising substantially the same material, and one of the members contains a material different from the conductive members.

The pair of electrodes is formed by connecting at leas one of a pair of conductive members comprising substantially the same material to a member comprising a material having a lower standard electrode potential than that of the material of the conductive members, and heating at least the member comprising the material having a lower standard electrode potential than that of the material of the conductive members.

In one embodiment of the invention, the connection length represents the length of connection (interface) between the polymer and each of the electrodes at an end of each electrode.

The connection length, in another embodiment of the invention, represents the length of a portion of contact (interface) between the polymer film, the substrate and a corresponding electrode.

The step of forming the polymer film is performed by coating a solution of a polymer constituting the polymer film or a solution of a precursor of the polymer by using an ink jet method.

The solution is applied to a position on the substrate deviating from the center of the space between the electrodes.

The step of decreasing the resistance of the polymer film is performed by irradiating the polymer film disposed between the electrodes with a particle beam or light.

According to one of the embodiment, the particle beam is an electron beam.

According to another embodiment, the particle beam is an ion beam.

The light preferably is a laser beam.

An electron source according to the present invention comprises a plurality of the electron-emitting devices of the present invention, which are disposed on a substrate.

A method of manufacturing an electron source according to the present invention comprises manufacturing a plurality of electron-emitting devices by any one of the above-described methods of manufacturing an electron-emitting device of the present invention.

An image display device according to the present invention comprises the electron source of the present invention, and a light emitting member.

A method of manufacturing an image display device, which comprises an electron source comprising a plurality of electron-emitting devices, and a light emitting member according to the present invention, comprises manufacturing the electron source by the method of manufacturing the electron source of the present invention.

In a further aspect of the present invention, an electron-emitting device comprises two electron-emitting devices arranged in parallel and each comprises a pair of electrodes, one of the electrodes being used as a common electrode, an electron source comprises a plurality of these electron-emitting devices disposed on a substrate, and an image display device comprises the electron source and a light emitting member.

In each of the electron-emitting devices of the present invention, a space serving as an electron emission section can be formed at a predetermined position, and thus the electron emission characteristics and reproducibility can be improved.

The manufacturing method of the present invention can be significantly simplified, as compared with a conventional manufacturing method requiring the step of forming a conductive film, the step of forming a gap in the conductive film, the step of forming an atmosphere containing an organic compound (or the step of forming a polymer film on the conductive film), the step of forming a carbon film by supplying a current to the conductive film, and forming a gap in the carbon film.

In the present invention, the gap can be selectively formed in the carbon film near one of the electrodes, thereby permitting the stable production of a uniform electron emitting portion.

The electron-emitting device manufactured according to the present invention has excellent heat resistance, thereby permitting an improvement in its electron emission properties, which can be limited by the performance of a conductive film in a conventional device.

The electron-emitting device manufactured according to the present invention has a high efficiency of electron emission, and thus the power consumption of the device can be decreased when the device is used for an image forming apparatus such as a display or the like.

Furthermore, in the electron-emitting device manufactured according to the present invention, an electron emitting portion can be uniformly formed with high controllability, thereby improving uniformity in a display screen, and suppressing variations in devices when the device is used for an image forming apparatus such as a display or the like.

In the electron-emitting device according to the present invention, electrical conductivity is significantly asymmetric with respect to the polarities of the applied voltage. Namely, when a positive voltage is applied to the electrode near the gap, the flowing current is 10 times as much as the current with the same voltage (about 20 V) with the reverse polarity.

This indicates that the voltage-current characteristic is a tunnel conduction type under a high electric field. When an anode electrode is disposed on a device, and the distance between the device and the anode electrode is, for example, 2 mm, an electron emission efficiency of as high as 1% or more can be obtained with an anode voltage of 1 kV. This electron emission efficiency is several times as high as that of a conventional surface conduction type of electron emitting device.

The reasons why an asymmetric electron emission property and a high electron emission efficiency can be obtained are not known completely at present. However, this is possibly related to the fact that electrons are emitted from an asymmetric electron emission section, and one conceivable reason is that when the potential of the electrode adjacent to the gap is set to be higher than that of the other electrode in driving, a larger number of electron emission points can be obtained.

Further objects, features and advantages of the present invention will become apparent from the following description of the preferred embodiments with reference to the attached drawings.

DESCRIPTION OF THE PREFERRED EMBODIMENTS

Embodiments of the present invention will be described below. However, the present invention is not limited to these embodiments.

Figure 1A:
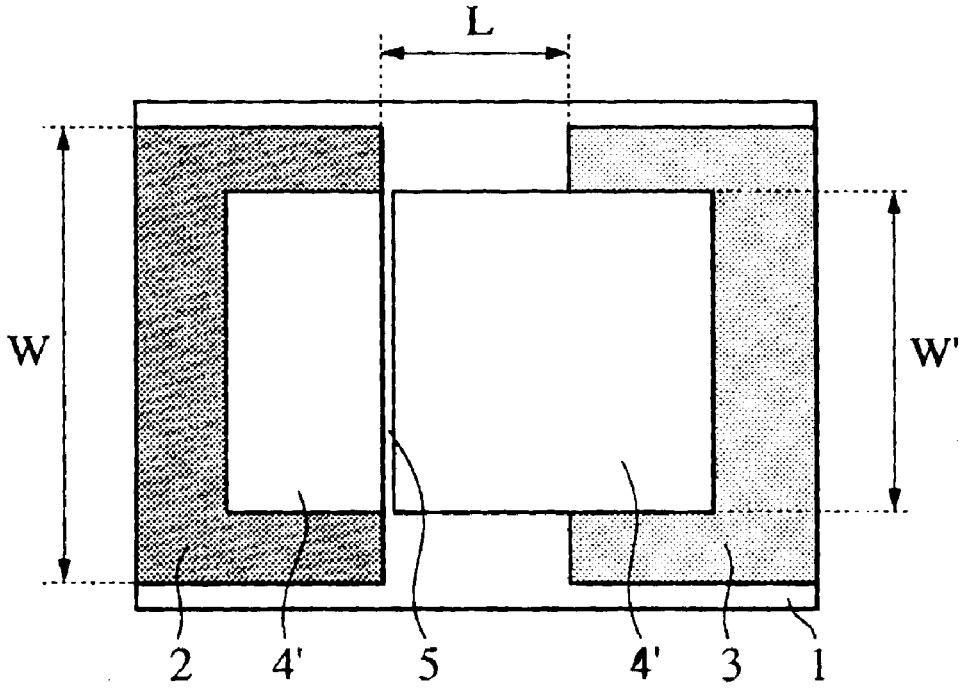
FIG. 1, consisting of FIGS. 1A and 1B, is a schematic drawing showing an electron emitting device according to an embodiment of the present invention.
Figure 1B:
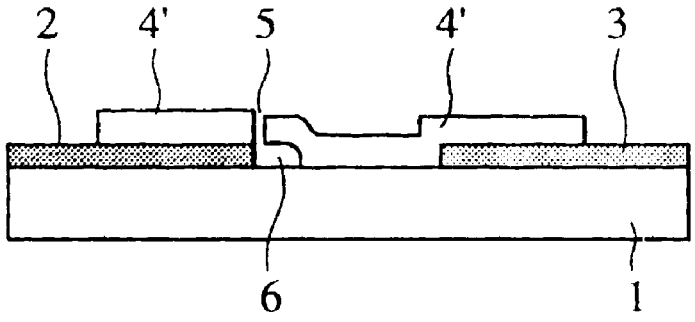

FIG. 1, consisting of FIGS. 1A and 1B, is a schematic drawing showing an example of a construction of an electron emitting device of the present invention. FIG. 1A is a plan view, and FIG. 1B is a sectional view taken along a plane passing through electrodes 2 and 3 substantially perpendicularly to an upper surface of a substrate 1 on which the electrodes 2 and 3 are disposed.

In FIG. 1, reference numeral 4' denotes a carbon film; reference numeral 5, a gap; and reference numeral 6 (FIG. 1B), a space between the carbon film 4' and the substrate 1. The space 6 constitutes a portion of the gap 5.

The carbon film 4' also is referred to herein s a "conductive film mainly composed of carbon", a "conductive film for electrically connecting a pair of electrodes", a "conductive film mainly composed of carbon and having a gap", or "a pair of conductive films mainly composed of carbon". Alternatively, the carbon film 4' is simply referred to as a "conductive film". In some cases, the carbon film 4' is referred to as a "film obtained by decreasing the resistance of a polymer film" in view of a manufacturing process of the present invention, and the film 4' is identified with a particular material, depending on which material is employed in a particular embodiment, described below.

A basic process for manufacturing the electron emitting device of the present invention comprises the following steps of:

(a) forming electrodes 2 and 3 on the substrate 1;

(b) forming a polymer film 4, which is a precursor to a film 4', such as a carbon film 4 for connecting the electrodes 2 and 3;

(c) decreasing a resistance of the polymer film 4; and (d) flowing a current (by applying a voltage) between the electrodes 2 and 3 to form the gap 5 in the resulting film 4' obtained by decreasing the resistance of the polymer film 4.

In the electron emitting device having the above-described construction, when a sufficient electric field is applied to the gap 5, electrons tunnel through the gap 5 to pass a current between the electrodes 2 and 3. The tunneling electrons partially become emission electrons.

Although the carbon film 4' preferably has conductivity over its entire surface, it does not necessarily have conductivity over its entire surface. If the film 4' is an insulator, a sufficient electric field necessary to cause an electron emission cannot be applied to the gap 5 even by applying a potential difference between the electrodes. The carbon film 4' preferably has conductivity at least in a region near the electrode 2 (and the electrode 3) and the gap 5. This permits the application of a desired electric field to the gap 5, sufficient to generate an electron emission.

In the electron emitting device of the present invention, the gap is disposed nearer to one of the electrodes 2 and 3 than to the other. As schematically shown in FIGS. 1B, 4, 5, 7B, 16B and 28, an end surface (part of a surface) of the electrode 2 (i.e., a right end thereof, in those drawings) is preferably exposed in (present in) (and partially defines) the gap 5. Namely, the electrode 2 (a portion of an end surface of the electrode 2) faces, within the gap 5, a portion of the carbon film (conductive film) 4', that is connected to the electrode 3. In at least one embodiment, at least a portion of the gap 5 is defined by the carbon film (conductive film) 4' connected to the electrode 3, the electrode 2 (a portion of the end surface of the electrode 2) and the substrate 1. The "gap", or a sub-part thereof, is also referred to as a "space".

In the present invention, the "exposure" of the electrode 2, of course, includes (at least part of a surface of the electrodes 2) is completely exposed, and includes a state in which impurities and atmospheric gases are adsorbed on, or adhered to, the end surface of the electrode 2 (adsorbed on or adhered to the part of a surface of the electrode 2). The gap 5 is thought to be formed by interaction of thermal deformation and/or thermal distortion between the electrodes 2 and 3, the carbon film 4' and the substrate 1 in a "voltage applying step" to be described below. Therefore, in the present invention, the "exposure" includes a state in which residue of the carbon film 4' in contact with the surface of the electrode 2 before the "voltage applying step" slightly adheres to the surface of the electrode 2 within the gap 5 after the "voltage applying step". Furthermore, the "exposure" includes a state in which a film is present on the surface of the electrode 2 within the gap 5 as long as the film is not confirmed by a TEM photograph and SEM photograph of a section.

When the gap 5 is formed nearer to one of the electrodes 2 and 3 (as described above), the electron emitting device can exhibit significantly asymmetric electrical conductivity (electron emission property) with respect to the polarities of the voltage applied between the electrodes 2 and 3. When a voltage with a forward polarity is applied (when the potential of the electrode 2 is higher than that of the electrode 3), for example, when 20 V is applied, the current is 10 times or more as large as that in a case in which the same voltage is applied with a reverse polarity. The voltage-current characteristic of the electron-emitting device of the present invention is a tunnel conduction type under a high electric field.

As schematically shown in FIGS. 15, 25, 26, 31, 35 and 38, a plurality of the electron emitting devices of the present invention are arranged in a matrix, and connected to scanning wirings 63 to which scanning signals are applied, and signal wirings 62 which are perpendicular to the scanning wirings 63, and to which modulation signals are applied synchronously with the scanning signals. When scanning pulses are successively applied to the scanning wirings 63 to perform a line-sequential drive, even if a bias reversed with respect to a forward bias for emitting electrons is applied to the electron emitting devices, unnecessary electron emission can be suppressed. Consequently, unnecessary light emission can be suppressed in a display, thereby forming a display having an excellent contrast.

Furthermore, the electron emitting device of the present invention can exhibit a high efficiency of electron emission. In measuring the electron emission efficiency, an anode electrode is disposed on the device, and the potential of the electrode 2 adjacent to the gap 5 is set to be higher than that of the other electrode 3. In this case, a high efficiency of electron emission can be obtained. When the ratio (Ie/If) of the emission current Ie captured by the anode electrode to the device current If flowing between the electrodes 2 and 3 is defined as the electron emission efficiency, the efficiency is several times as high as that of a conventional surface conduction type of electron emitting device.

As described above, in the electron emitting device of the present invention, it is important to provide the gap near one of the electrodes 2 and 3. The method of selectively forming the gap 5 near one of the electrodes 2 and 3 is described below.

As described above, the gap 5 is formed by the "voltage applying step" of applying a voltage (passing a current) to the film 4' obtained by decreasing the resistance of the polymer film 4. The gap 5 can be selectively formed near an end surface of one of the electrodes 2 and 3 by a method of causing an asymmetry in the connection form between the electrode 2 and the film 4' obtained by decreasing the resistance, and the connection form (i.e., connection interface) between the electrode 3 and the film obtained by decreasing the resistance.

This can be achieved by controlling the Joule heat generated near the end surface of one of the electrodes to be higher than the Joule heat generated near the end surface of the other electrode in forming the gap 5 by the "voltage applying step".

Several methods for causing an asymmetry in the Joule heat generated near the electrode 2 and the Joule heat generated near the electrode 3 in the "voltage applying step" are described below.

(1) The connection resistance or step coverage (the amount of area covered by the film 4' in a case where the film 4' has a step-shaped structure) between the electrode 2 and the film 4' obtained by decreasing the resistance of the polymer film 4 is made asymmetric with the connection resistance or step coverage between the electrode 3 and the film 4' obtained by decreasing the resistance of the polymer film 4.

(2) A portion near the connection region between the electrode 2 and the film 4' obtained by decreasing the resistance of the polymer film 4 and a portion near the connection region between the electrode 3 and the film 4' obtained by decreasing the resistance of the polymer film 4 are designed so that both portions have different degrees of thermal diffusion.

(3) With electrodes having asymmetric shapes, a deviation can be produced in a thickness distribution in forming the polymer film 4 depending upon the method of depositing the polymer film 4. In this case, even when the resistance of the polymer film 4 is decreased by "resistance decreasing step", a deviated distribution can be imparted to the resistance.

(4) When the connection length (i.e., the length of the interface) between the electrode 2 and the film 4' obtained by decreasing the resistance of the polymer film 4 is set to be asymmetric with the connection length (length of the interface) between the electrode 3 and the film 4' obtained by decreasing the resistance of the polymer film 4, a current density with the shorter connection length can be increased in the "voltage applying step".

By using any one of the above methods, the Joule heat generated near a first electrode can be differentiated from the Joule heat generated near a second electrode in the "voltage applying step". As a result, the gap 5 can be selectively formed near one of the electrodes. In the "voltage applying step", the difference between the Joule heat generated near the first electrode and the Joule heat generated near the second electrode is preferably as large as possible. However, in consideration of an actual process, the higher Joule heat generated is 1.1 times or more, preferably 1.5 times or more, and more preferably 1.7 times or more, as high as the lower Joule heat.

A typical example of methods for controlling the Joule heat is a method comprising causing an asymmetry in the connection form (i.e., connection interface) between the second electrode and the polymer film 4 (or the film 4' obtained by decreasing the resistance of the polymer film 4) and in the connection form between the first electrode and the polymer film 4 (or the film 4' obtained by decreasing the resistance of the polymer film 4), and then performing the "voltage applying step", to selectively dispose the gap 5 near one of the electrodes.

Figure 16A:
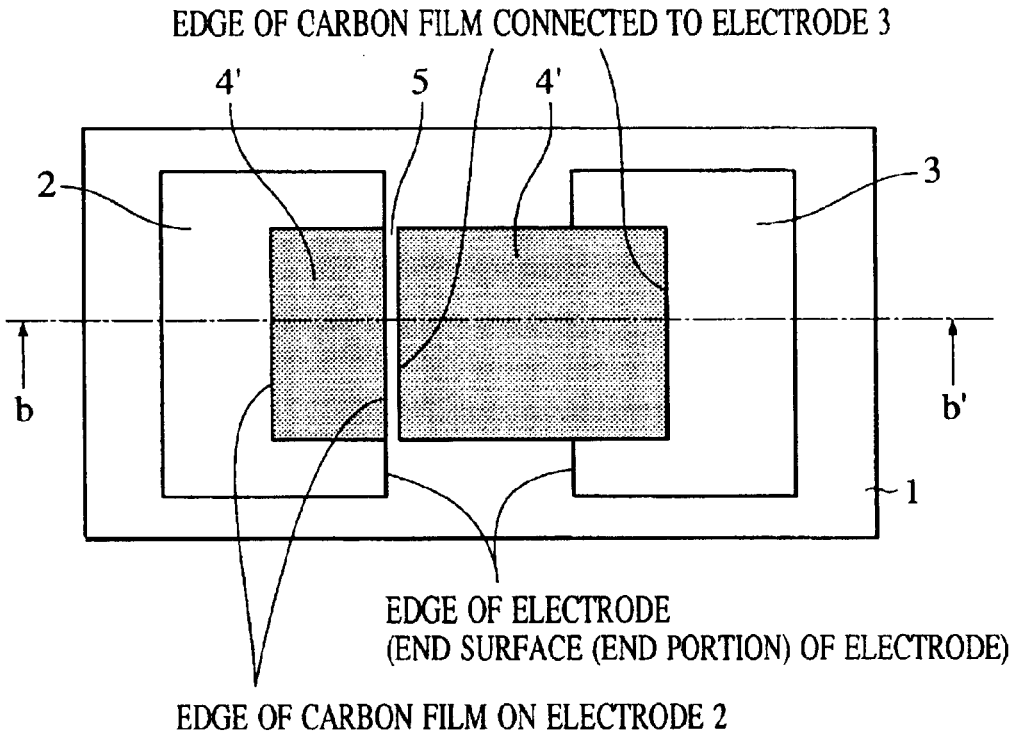
FIGS. 16A and 16B are a schematic plan view and sectional view showing an example of an electron emitting device manufactured in the present invention.
Figure 18:
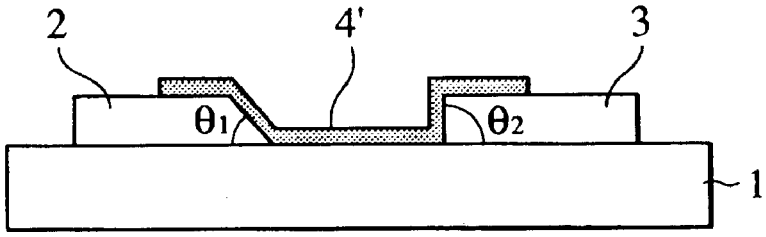
FIG. 18 is a schematic sectional view showing another example of an electron emitting device manufactured in the present invention.

As shown in, for example, FIGS. 16 and 18, the electrodes 2 and 3 may be formed to have different thicknesses and sizes, thereby achieving an asymmetry in the connection forms (i.e., connection interface).

Figure 28A:
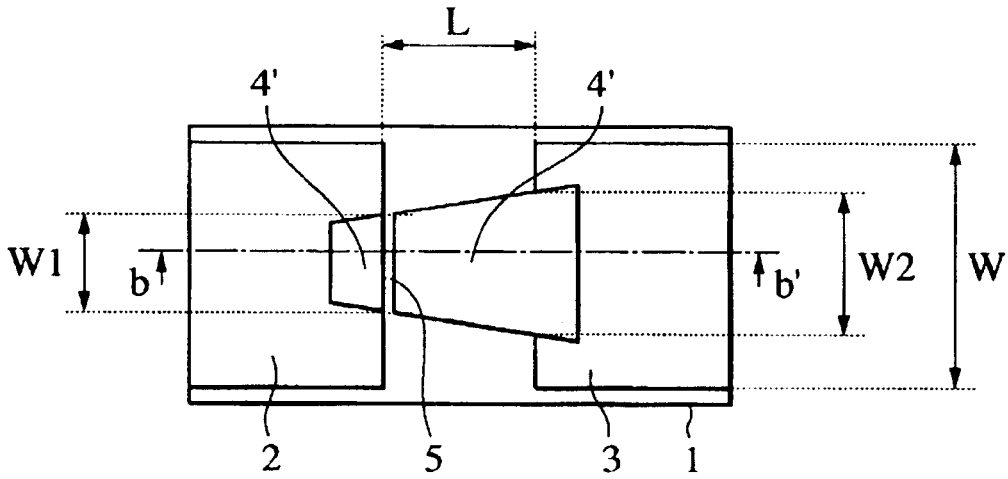
FIG. 28, consisting of FIGS. 28A and 28B, is a schematic drawing showing the structure of an electron emitting device according to a further embodiment of the present invention.
Figure 28B:
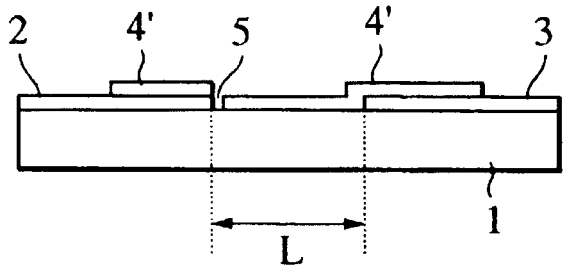

Alternatively, the electrodes 2 and 3 have substantially the same shape, but the polymer film (or the film 4' obtained by decreasing the resistance of the polymer film 4) near the electrode 2, and the polymer film (or the film 4' obtained by decreasing the resistance of the polymer film 4) near the electrode 3 may be provided in different shapes, thereby achieving an asymmetry in the connection forms. This method can be achieved by differentiating the connection length between the electrode 2 and the polymer film 4 (or the film 4' obtained by decreasing the resistance of the polymer film 4) from the connection length between the electrode 3 and the polymer film 4 (or the film 4' obtained by decreasing the resistance of the polymer film 4), for example, as shown in FIGS. 28A and B and FIGS. 29A and B. As described in detail below, another example of the method of differentiating between the connection lengths comprises preparing the electrodes 2 and 3 having different surface energies, and forming a polymer film by a liquid coating method to differentiate the connection length between the polymer film and the electrode 2 from the connection length between the polymer film and the electrode 3, for example, as shown in FIGS. 36A to D.

In the present invention, the term "connection length" represents the length of contact (i.e., the interface) between the polymer film 4 (or the film 4' obtained by decreasing the resistance of the polymer film 4) and the electrode 2 or 3 at a corresponding end (edge) of the electrode 2 or 3. Alternatively, the term "connection length" may represent the length of a portion formed by contact (i.e., the interface) between the polymer film 4 (or the film 4' obtained by decreasing the resistance of the polymer film 4), the electrode 2 or 3, and the substrate 1. In this case, the edge of the electrode represents the electrode edge shown in FIG. 16.

In the present invention, the shape of the electrode 2 may be differentiated from the shape of the electrode 3, and the length of connection between the polymer film 4 (or the film 4' obtained by decreasing the resistance of the polymer film 4) and the electrode 2 may be differentiated from the length of connection between the polymer film and the electrode 3, thereby achieving an asymmetry in the connection forms.

Another example of a method for embodying the idea of the present invention comprises differentiating a degree of a decrease in the resistance of the polymer film 4 near one of the electrodes from a degree of a decrease in the resistance of the polymer film 4 near the other electrode to achieve an asymmetry in the connection forms (i.e., connection interfaces).

The asymmetry in the connection forms (i.e., connection interfaces) can also be achieved by a method of differentiating the contact resistance (connection resistance) between the electrode 2 and the polymer film 4 (or the film 4' obtained by decreasing the resistance of the polymer film 4) from the contact resistance between the electrode 3 and the polymer film 4 (or the film 4' obtained by decreasing the resistance of the polymer film 4).

Furthermore, the asymmetry in the connection forms (i.e., connection interfaces) can also be achieved by using different materials (or compositions) for the pair of electrodes 2 and 3 to differentiate the thermal conduction (thermal conductivity) of one of the electrodes from the thermal conduction (thermal conductivity) of the other electrode.

An example of a series of processes for manufacturing the electron emitting device of the present invention will be described in further detail below with reference to FIGS. 2A and B, 3A to C, 16A and B, 17A to D, 18, 19, 28A and B, 29A to F, 32A to C, and 36A to D.

(1) The substrate (base) 1 made of glass or the like is sufficiently cleaned with a detergent, pure water and an organic solvent, and an electrode material (electroconductive material) is deposited by a vacuum deposition or sputtering method. Then, the electrodes 2 and 3 are formed on the substrate 1 by, for example, photolithography (FIG. 2A). As the material of the substrate 1, a transparent material such as glass is preferably used when a back of the substrate 1 is irradiated with light in the "resistance decreasing step", as described below. The substrate 1 may be basically an insulating substrate. The distance between the electrodes 2 and 3 is preferably 1 $\mu$m to 100 $\mu$m.

As the electrode material, a film comprising a low-resistivity material can be used. Particularly, the electrode 2 disposed near the gap 5 shown in FIG. 1 comprises a material different from the carbon film 4' after the "resistance decreasing step" and the "voltage applying step" for forming the gap 5. Furthermore, the electrode 2 preferably comprises a material with lower resistivity than that of the carbon film 4'. Furthermore, in FIG. 1B, the material of the electrode 2 is preferably selected so that the resistivity of the carbon film 4' connected to the electrode 2 is higher than the resistivity of the electrode 2 in the direction perpendicular to the surface of the substrate 1 (in the direction of lamination of the electrode 2 and the carbon film 4'). More specifically, as the material of the electrode 2, a metal or a material mainly composed of a metal is preferably used.

Figure 2A:
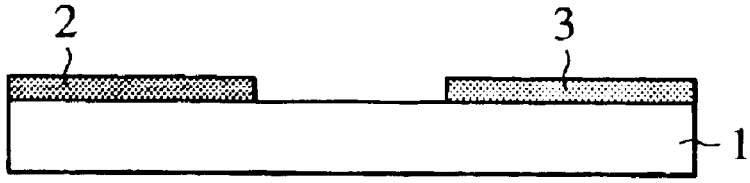
FIG. 2, consisting of FIGS. 2A and 2B, is a schematic drawing showing a method of manufacturing an electron emitting device according to an embodiment of the present invention.
Figure 16B:
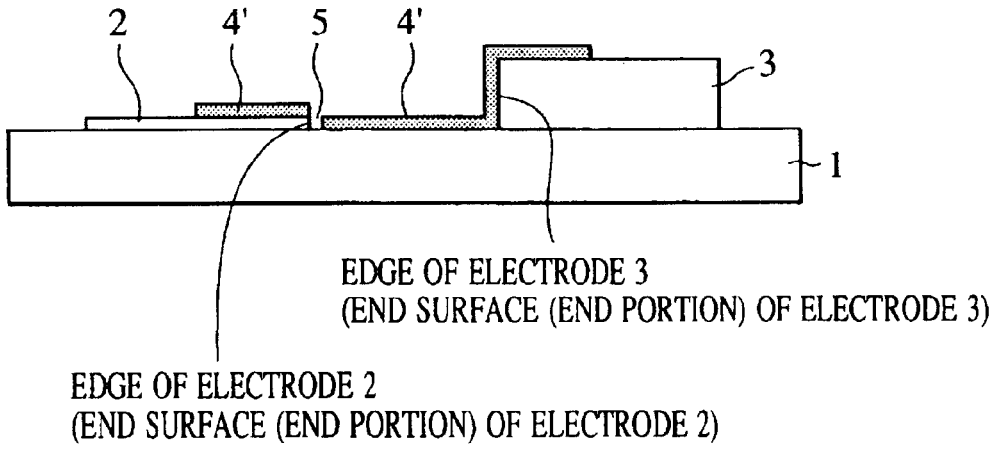

In the step shown in FIG. 2A, the electrodes 2 and 3 are formed in substantially the same shape. However, in the present invention, as described above, the electrodes 2 and 3 may be formed in different shapes to control the position of the gap 5 formed in the "voltage applying step", as shown in FIGS. 16B and 18.

When the electrodes 2 and 3 are formed in different shapes, for example, the electrodes 2 and 3 are first formed to a same thickness, and then one (e.g., the electrode 2 in FIG. 16) of the electrodes is masked, and the other electrode (e.g., electrode in FIG. 16) is further formed to a larger thickness. In this method, the thermal conductivity of the thicker electrode can be set to be higher than that of the other thinner electrode. As a result, the gap 5 can be formed near the thinner electrode in the "voltage applying step" described below.

When electrodes are formed in the shapes shown in. FIG. 18, for example, one of the electrodes can be formed by lift-off patterning, and the other electrode can be formed by etching (chemical wet etching). In this case, the angle $\theta_1$ formed by a side plane (a side surface) of one of the electrodes 2 and the upper surface of the substrate 1 can be differentiated from the angle $\theta_2$ formed by a side plane (a side surface) of the other electrode 3 and the upper surface of the substrate 1.

Figure 29A:
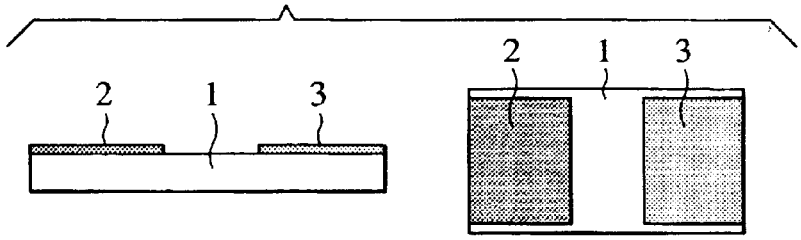
FIG. 29, consisting of FIGS. 29A to 29F, is a schematic drawing showing steps for manufacturing the electron emitting device shown in FIG. 28.
Figure 29B:
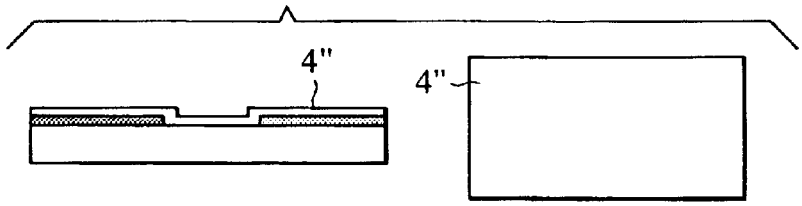
Figure 29C:
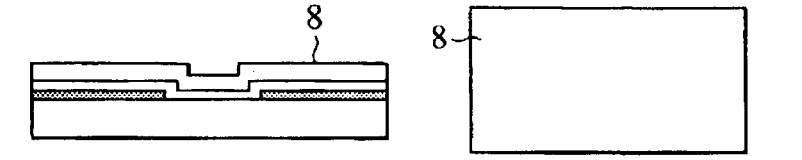
Figure 29D:
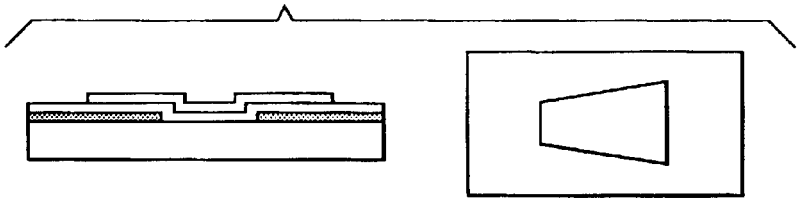
Figure 29E:
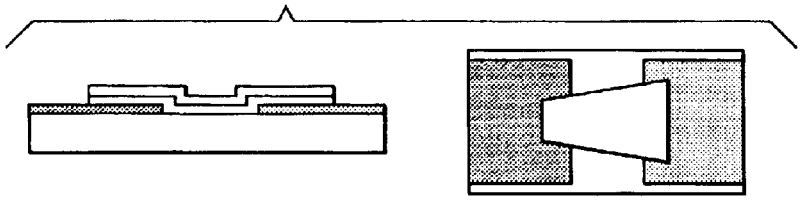
Figure 29F:
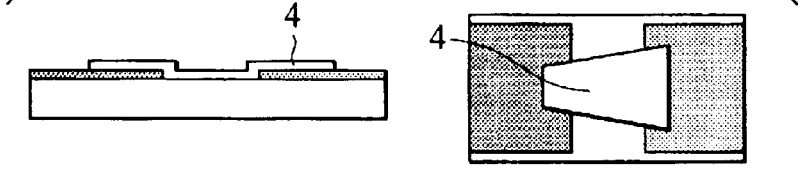
Figure 32A:
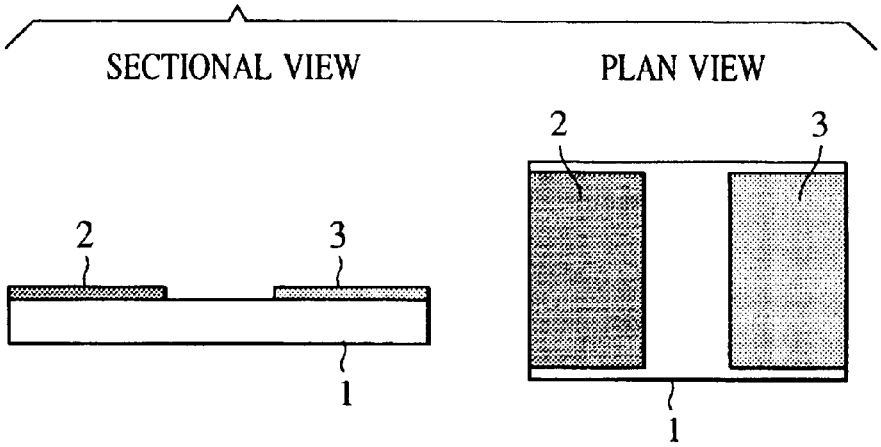
FIG. 32, consisting of FIGS. 32A to 32C, is a schematic drawing showing another step for manufacturing an electron emitting device of the present invention.
Figure 32B:
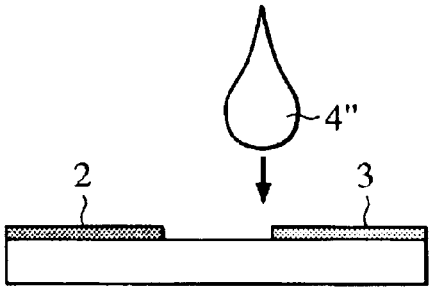
Figure 32C:
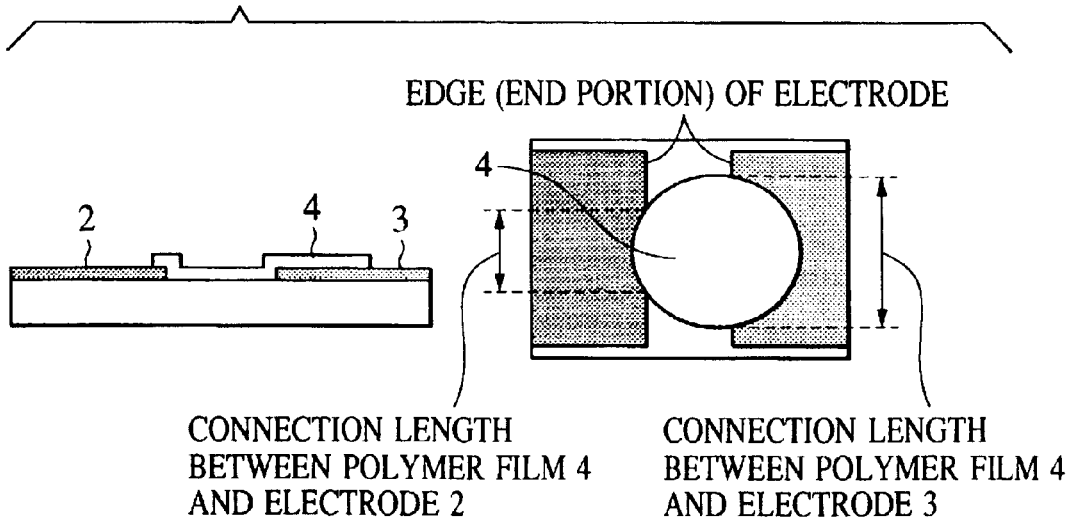

In the method of controlling the position of the gap 5 by controlling the shape of the polymer film 4 (or the film 4' obtained by decreasing the resistance of the polymer film 4), as shown in FIG. 28A, FIG. 29F and FIG. 32C, the process for causing an asymmetry in the shapes of the electrodes 2 and 3 is not necessarily performed.

As described in detail below, the electrodes 2 and 3 may be formed to have different surface energies so that the gap 5 is disposed near one of the electrodes, as shown in FIGS. 36A to D. In this case, the process for causing an asymmetry in the shapes of the electrodes 2 and 3 is not necessarily performed.

In order to form the electrodes 2 and 3 having different surface energies, various methods can be used. One of the methods comprises forming the electrodes 2 and 3 by using the same material, and then differentiating the surface energy of the electrode 2 from the surface energy of the electrode 3 in a surface energy control step. Another method comprises forming the electrodes 2 and 3 by using different materials.

In the method of comprising the surface energy control step, the surface energies of the electrodes 2 and 3 are differentiated in this step or between this step and a next step of forming the polymer film 4.

Various methods can be used as the method of differentiating between the surface energies of the electrodes 2 and 3. Examples of such methods include a method comprising forming the electrodes 2 and 3 by using the same material, masking one of the electrodes 2 and 3, and then cleaning with an alkali, a method comprising forming the electrodes 2 and 3 by using the same material, masking one of the electrodes 2 and 3, and then allowing the other of the electrodes 2 and 3 to stand in an organic atmosphere for a predetermined time, a method comprising forming the electrodes 2 and 3 by using the same material, and then doping one of the electrodes with a material by addition (or implantation), a method comprising forming the electrodes 2 and 3 by using different materials, etc. Any other suitable method can be used as well as long as the surface energy of one of the electrodes 2 and 3 can be differentiated from that of the other electrode 2 or 3.

Figure 2B:
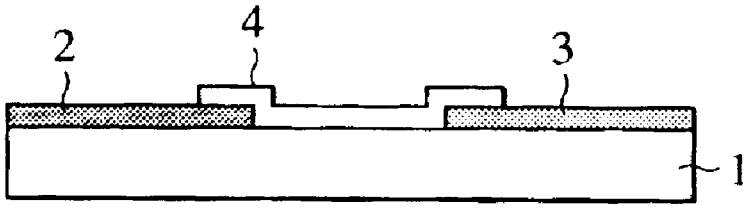

(2) Next, the polymer film 4 is formed for connecting the electrodes 2 and 3 provided on the substrate 1 (FIG. 2B).

A polymer used in the present invention has at least carbon atomic bonds. In some cases, a polymer having carbon atomic bonds is heated to produce dissociation and recombination of the carbon atomic bonds, and then increasing its conductivity. In the present invention, such a polymer which is increased in conductivity by heating is used.

In the present invention, in the "resistance deceasing step" described below, the resistance of the polymer film 4 can be decreased by irradiation of a particle beam such as an electron beam or an ion beam, or light such as a laser beam. In the "resistance deceasing step" of the present invention, therefore, dissociation/recombination by a factor other than heat, for example, an electron beam or photons, may be added to thermal dissociation/recombination to produce dissociation and recombination of carbon atomic bonds of the polymer film, thereby effectively improving the conductivity of the polymer film.

In the present invention, a structural change and a change in conductivity due to heat and the above-described factor other than heat are generically represented as "transforming".

In the present invention, it can be understood that the conductivity is increased due to an increase in a number of conjugate double bonds of carbon atoms in the polymer. The conductivity varies with the progress of "transforming".

Polymers which easily exhibit conductivity due to dissociation and recombination of carbon atomic bonds, i.e., polymers which easily produce double bonds of carbon atoms, include aromatic polymers. Particularly, aromatic polyimide is a polymer producing a pyrolytic polymer having high conductivity at relatively low temperature. Although an aromatic polyimide itself is generally an insulator, polymers such as polyphenylene oxadiazole, polyphenylene vinylene, and the like have conductivity before pyrolysis. These polymers can also be used in the present invention because they exhibit further conductivity due to pyrolysis.

As the method of forming the polymer film 4, various known methods such as a spin coating method, a printing method, a dipping method, and the like can be used. Particularly, the printing method is preferred because the polymer film 4 can be formed at a low cost. By using an ink jet printing method, a patterning step can be eliminated, and a pattern of several hundreds $\mu$m or less can be formed. Therefore, the ink jet printing method is effective to manufacture an electron source applied to a flat panel display and comprising a plurality of electron emitting devices arranged at a high density.

In forming the polymer film 4 by the coating method using a liquid (such as in the ink jet method or the spin coating method), a liquid comprising a solution of a polymer material or a liquid comprising a solution of a desired polymer precursor may be used. When the liquid comprising the solution of a polymer material is used, the polymer film 4 can be formed by applying the liquid on the substrate 1, and then drying the liquid applied on the substrate. On the other hand, when the solution of a desired polymer precursor is used, the polymer film 4 can be formed by applying the liquid on the substrate 1, and then polymerizing the precursor by heating.

In the present invention, an aromatic polymer is preferably used as the polymer material. However, this polymer is insoluble in many solvents, and it is thus effective to coat a solution of a precursor of the polymer. For example, a solution of polyamic acid, which is a precursor of aromatic polyimide, can be coated (applied as a coating), and then heated to form a polyimide film.

Examples of a solvent for dissolving the precursor of the polymer include N-methylpyrrolidone, N,N-dimethylacetamide, N,N-dimethylformamide, dimethylsulfoxide, and the like. These solvents can be combined with n-butyl cellosolve, triethalamine, or the like. The solvent is not limited to these solvents only as long as it can be used in the present invention.

In the step of forming the polymer film 4, the connection length between the electrode 2 and the polymer film 4 (or the film 4' obtained by decreasing the resistance of the polymer film 4) is differentiated from the connection length between the electrode 3 and the polymer 4 (or the film 4' obtained by decreasing the resistance of the polymer film 4) according to the shape of the polymer film 4 (or the film 4' obtained by decreasing the resistance of the polymer film 4), as described above with reference to FIG. 28. For example, as shown in FIG. 28, the polymer film 4 is formed so that the connection length between the polymer film 4 (film 4') and the electrode 2 is differentiated from the connection length between the polymer film 4 (film 4') and the electrode 3.

A method of patterning the polymer film 4 can be used for differentiating between the connection lengths. In forming the polymer film 4 by the ink jet printing method, as shown in FIGS. 32A to C, a method of applying a droplet 6" near one of the electrodes 2 and 3, but not at the center between the electrodes, can be used. Alternatively, as shown in FIGS. 36A to D, a solution of a polymer material or a solution of a polymer material precursor may be applied under a condition in which the surface energy of one of the electrodes is different from the surface energy of the other electrode, and then heated to form the polymer film 4 having different connection lengths, as described in detail below. In this way, a method of differentiating between the connection lengths can be appropriately selected from various methods.

The difference between the connection length between the polymer film 4 and the electrode 2 and the connection length between the polymer film 4 and the electrode 3 is preferably as large as possible. However, in consideration of the actual process, the longer connection length may be set to 1.1 times or more, preferably 1.5 times or more, and more preferably 1.7 times or more, as long as the shorter connection length, although the invention, broadly construed, is not necessarily limited to these factors only.

(3) Next, the "resistance decreasing step" is performed for decreasing the resistance of the polymer film 4. In "the resistance decreasing step", the polymer film 4 is provided with conductivity, and converted into the conductive film 4' having a desired resistance. The conductive film 4' formed by the "resistance decreasing step" also is referred to herein as the "conductive film mainly composed of carbon" or simply the "carbon film".

This step is performed until the sheet resistance of the polymer film 4 is decreased to the range of $10^3$ Ω/□ to $10^7$ Ω/□ (or the resistivity is decreased to $10^{-3}$ Ωcm to 10 Ωcm) in view of the step of forming the gap 5 described below. For example, the resistance of the polymer film 4 can be decreased by heating the polymer film 4. The reason for decreasing the resistance (making conductive) of the polymer film 4 by heating it is that conductivity is exhibited by dissociation and recombination of carbon atomic bonds in the polymer film 4.

The resistance of the polymer film 4 can be decreased by heating at a temperature higher than the decomposition temperature of the polymer constituting the polymer film 4. Particularly, the polymer film 4 is preferably heated in an oxidation inhibiting atmosphere such as an inert gas atmosphere or a vacuum.

Although the aromatic polymer, particularly aromatic polyimide, has a high thermal decomposition temperature, heating at a temperature, typically 700° C. to 800° C., higher than the thermal decomposition temperature can impart high conductivity to the polymer.

However, when the polymer film 4 as a component member of the electron emitting device is heated until it is thermally decomposed, the method of heating the whole polymer by using an oven or a hot plate possibly can be restricted from the viewpoint of heat resistance of the other component members of the electron emitting device. Particularly, the substrate 1 may need to be limited to a material with high heat resistance, such as a quartz glass or ceramic substrate, and thus the substrate 1 can become very expensive when applied to a large-area display panel or the like.

Therefore, in the present invention, the resistance of the polymer film 4 is more preferably decreased by irradiating the polymer film 4 with a particle beam or light from a means for irradiating a particle beam such as an electron beam or an ion beam, or a means for irradiating light such as a laser beam or halogen light. In this case, the resistance of the polymer film 4 can be decreased while suppressing the thermal influence on the other members of the device. The particle beam, the laser beam, or the halogen light is referred to as an "energy beam" because this is a means for extremely supplying energy to the polymer film 4 on the substrate 1.

An example of the "resistance decreasing step" according to an embodiment of this invention will be described below.

(Electron Beam Irradiation)

In electron beam irradiation, the substrate 1 on which the electrodes 2 and 3 and the polymer film 4 are formed is set in a low-pressure atmosphere (vacuum container) (not shown) provided with an electron gun (not shown). The polymer film 4 is irradiated with an electron beam from the electron gun provided in the container. At this time, preferred conditions for electron beam irradiation include an acceleration voltage $V_{ac}$ of 0.5 kV to 40 kV. During irradiation with the electron beam, the resistance value between the electrodes 2 and 3 is monitored so that electron beam irradiation can be stopped when a desired resistance value is obtained.

(Laser Beam Irradiation)

In laser beam irradiation, the substrate 1 on which the electrodes 2 and 3 and the polymer film 4 are formed is set on a stage (not shown), and the polymer film 4 is irradiated with a laser beam. At this time, in order to suppress oxidation (combustion) of the polymer film 4, the environment of laser beam irradiation is preferably an inert gas or vacuum environment. However, the irradiation may be performed in the atmosphere according to conditions for laser beam irradiation.

Laser beam irradiation is preferably performed by, for example, using a second harmonic (wavelength 532 nm) of a pulse YAG laser. During irradiation with the laser beam, the resistance value between the electrodes 2 and 3 is preferably monitored so that laser beam irradiation can be stopped when a desired resistance value is obtained.

The "resistance decreasing step" need not necessarily be performed over the entire region of the polymer film 4. However, in consideration of the fact that the electron emitting device of the present invention is driven in a vacuum atmosphere, it is undesirable that an insulator is exposed to the vacuum atmosphere. Therefore, the "resistance decreasing step" is preferably over substantially the entire region of the polymer film 4.

The conductive film 4' formed by the "resistance decreasing step" also is referred to herein as the "conductive film mainly composed of carbon" or simply the "carbon film".

As described above with respect to the "resistance decreasing step", when the degree of decrease in the resistance of the polymer film near one of the electrodes is differentiated from the degree of decrease in the resistance of the polymer film near the other electrode to change the formation position of the gap 5, the resistance of the polymer film 4 is decreased so that the resistance of a portion of the polymer film 4, which is near the electrode adjacent to the gap 5 to be formed, is higher than that of a portion of the polymer film 4, which is near the other electrode.

In other words, the resistance of the polymer film 4 is decreased so that the resistivity (electrical resistivity) of a portion of the polymer film 4, which is near the electrode (e.g., the electrode 2 in FIGS. 2 and 3) adjacent to the gap 5 to be formed, is higher than that of a portion of the polymer film 4 which is near the other electrode (e.g., the electrode 3 in FIGS. 2 and 3). In this case, when a voltage is applied between the pair of electrodes 2 and 3, Joule heat generated near one of the electrodes 2 and 3 can be increased, as compared with Joule heat generated near the other electrode. As a result, the gap 5 can be precisely formed near the desired electrode.

Figure 3A:
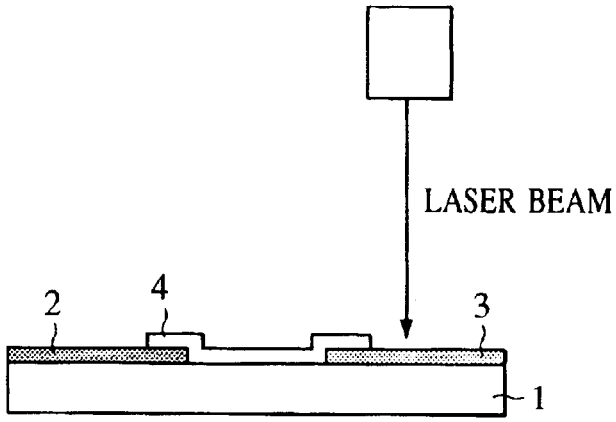
FIG. 3, consisting of FIGS. 3A to 3C, is a schematic drawing showing a method of manufacturing an electron emitting device according to an embodiment of the present invention.
Figure 3B:
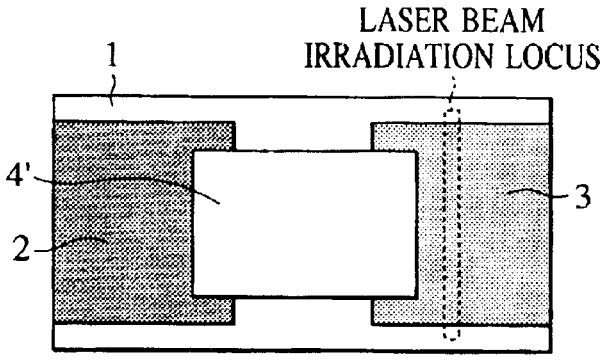

FIGS. 3A and 3B are schematic views each showing the case in which the "resistance decreasing step" is performed by laser beam irradiation. More specifically, as shown in FIG. 3B, the "resistance decreasing step" is performed by irradiating a portion of the electrode 3 with a laser beam so that a heating temperature gradient is caused in the polymer film 4 from the electrode 3 to the electrode 2. In this case, the conductive film 4' can be formed, in which the resistivity of a portion of the film 4' near the electrode 2 is higher than the resistivity of a portion of the film 4' near the electrode 3.

Although the example using the laser beam is described above, a resistivity distribution can also be provided by particle beam or light irradiation from a particle beam irradiation means or light irradiation means by the same method as described above.

Although the method of providing a resistivity distribution may be performed as at least part of the "resistance decreasing step", it also may be performed as another step after the "resistance decreasing step" for substantially uniformly decreasing the resistance of the polymer film 4.

Figure 9A:
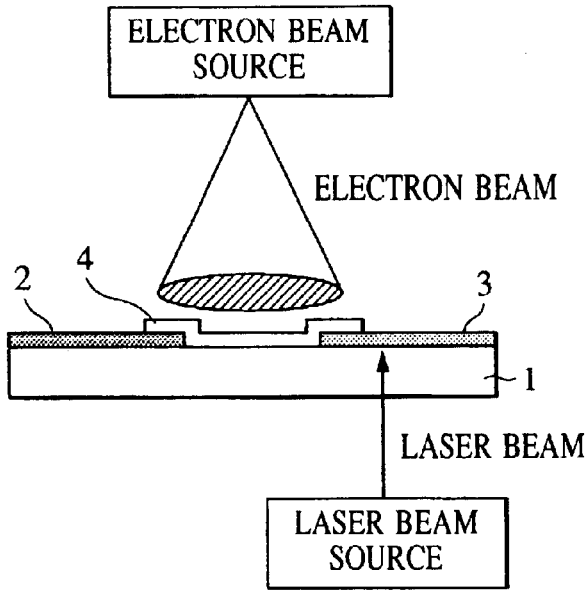
FIG. 9, consisting of FIGS. 9A to 9C, is a schematic drawing showing a method of manufacturing an electron emitting device according to a further embodiment of the present invention.

Furthermore, as shown in FIG. 9A, a resistivity distribution may be provided in the polymer film 4 by irradiating only the electrode 3 with a laser beam after (or while) the whole polymer film 4 is irradiated with an electron beam for substantially uniformly decreasing the resistance of the polymer film 4. Therefore, the "resistance decreasing step" can be performed by using a plurality of resistance decreasing means (particle beam irradiation means and light irradiation means). In this case, laser beam irradiation may be performed after electron beam irradiation or at the same time as electron beam irradiation.

Figure 3C:
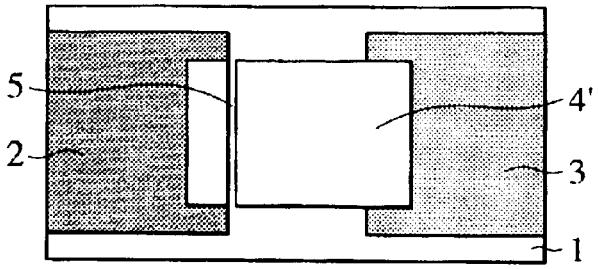

(4) Next, the gap 5 is formed in the conductive film 4' obtained in the step (3) (FIG. 3C). This step is referred to as the "voltage applying step".

The gap 5 is formed by applying a voltage (passing a current) between the electrodes 2 and 3. The gap 5 is formed in the conductive film 4' in the "voltage applying step". The applied voltage may be either a DC or AC voltage, or a pulse voltage such as a rectangular pulse or the like, but a pulse voltage is preferably used.

The "voltage applying step" may be performed by applying a voltage between the electrodes 2 and 3 at the same time as the "resistance decreasing step". In order to form the gap 5 with high reproducibility, "climbing forming" is preferably performed, in which the pulse voltage applied between the electrodes 2 and 3 is gradually increased.

The "voltage applying step" is preferably performed in a low-pressure atmosphere, and more preferably in an atmosphere of a pressure of $1.3\times10^{-3}$ Pa or less.

In a plane (sectional view) which is perpendicular to an upper surface of the substrate 1, and which is passing through the electrodes 2 and 3, it can be said that the gap 5 formed in the "voltage applying step" is defined at least in part by at least an edge (end portion) of the electrode 2 and an edge (end portion) of the carbon film 4' connected to the electrode 3 and disposed on the surface of the substrate 1 (refer to FIG. 16, etc.). In a plane (sectional view), which is perpendicular to the upper surface of the substrate 1, and which is passing through the electrodes 2 and 3, it can also be said that the gap 5 is defined at least in part by at least the edge (end portion) of the carbon film 4' disposed on the electrode 2 and the edge (end portion) of the carbon film 4' connected to the electrode 3 and disposed on the surface of the substrate 1 (refer to FIG. 16, etc.). In detail, in a plane (sectional view), which is perpendicular to the upper surface of the substrate 1, and which is passing through the electrodes 2 and 3, it can also be said that the gap 5 is defined by at least the edge (end portion) of the electrode 2, the edge (end portion) of the carbon film 4' disposed on the electrode 2, and the edge (end portion) of the carbon film 4' connected to the electrode 3 and disposed on the surface of the substrate 1 (refer to FIG. 16, etc.).

The electron emitting device of the present invention is formed by the above-described steps (1) to (4). Although the mechanism of formation of the gap 5 in the carbon film (conductive film) 4' by the "voltage applying step" is not known, a conceivable mechanism of formation of the gap 5 will be described below.

The temperature of the conductive film 4' is increased by the Joule heat generated in the "voltage applying step". Also, the resistivity of the conductive film 4' is further decreased because the film 4' has a negative temperature (thermal) coefficient of resistance. Consequently, in the "voltage applying step", a large amount of Joule heat is generated in the conductive film 4' with the passage of time to possibly cause a reaction for decreasing the resistivity.

As described above, by using the electrodes 2 and 3 and the polymer film 4 having the structure shown in FIG. 16B, 17A to D, 18, 28A or 29F, the Joule heat generated near one of the electrodes in the "voltage applying step" can be set to be larger than the Joule heat generated near the other electrode. On the other hand, the Joule heat generated in the "voltage applying step" is radiated through the substrate 1 and the electrodes 2 and 3, and thus a large temperature gradient occurs near the electrodes 2 and 3 each comprising a material having a higher thermal conductivity than the material of the substrate 1. At a temperature higher than a predetermined value and a temperature gradient higher than a predetermined value, the conductive film (the film obtained by decreasing the resistance of the polymer film) 4' cannot resist strain, and a portion near the edge (end portion) of one of the electrodes, which has a small thickness and a high temperature gradient, is possibly broken to form the gap 5. In other words, in the "voltage applying step", the gap 5 is possibly formed due to a relative change such as shrinkage, thermal expansion or thermal deformation of the electrodes 2 and 3, the carbon film 4' and the substrate 1.

In some cases, the resistance of the film 4' obtained by the "resistance decreasing step" is further decreased by the "voltage applying step". Therefore, in some cases, some differences occur in electrical properties and film quality between the conductive film 4' after the "resistance decreasing step" and the conductive film 4' after the "voltage applying step" of forming the gap 5. However, both the conductive film 4' after the "resistance decreasing step" and the conductive film 4' after the "voltage applying step" of forming the gap 5 comprise carbon as a main component. Therefore, as used in this description, the film obtained by decreasing the resistance of the polymer film is not distinguished from the conductive film obtained by the "voltage applying step" unless otherwise stated.

When a voltage is applied, through the electrodes 2 and 3, to the film 4' having the gap 5 formed as described above, a tunnel current flows through the gap 5. At this time, when a high voltage is applied to an anode electrode (not shown) disposed opposite to the substrate 1, a part of the tunnel current is scattered so that the scattered part of the tunnel current can be caused to reach the anode electrode as an emission current.

As a result of detailed observation of an electron emission point distribution by using a microscope (not shown) for observing an electron beam distribution, it was found that the electron emission points (electron emission sites) are discretely or continuously formed along the gap 5 (including a case in which discrete emission points are closely connected so that the emission points cannot be observed).

Figure 4:
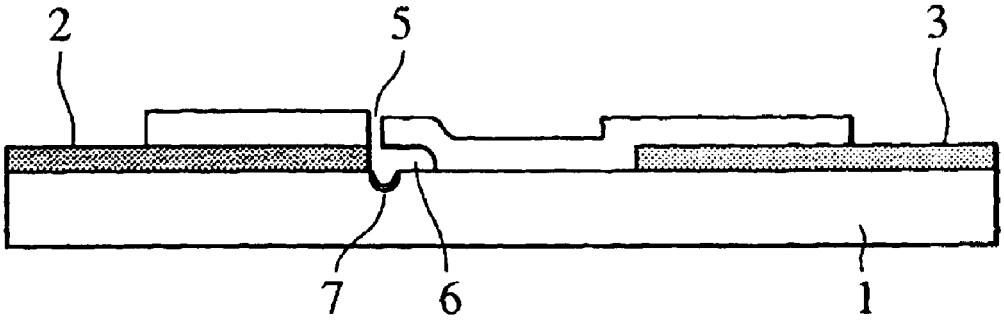
FIG. 4 is a schematic drawing showing an electron emitting device according to another embodiment of the present invention.
Figure 5:
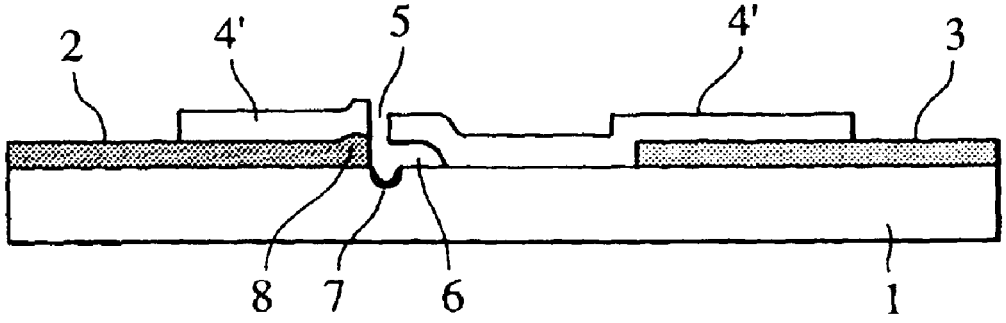
FIG. 5 is a schematic drawing showing an electron emitting device according to still another embodiment of the present invention.
Figure 7A:
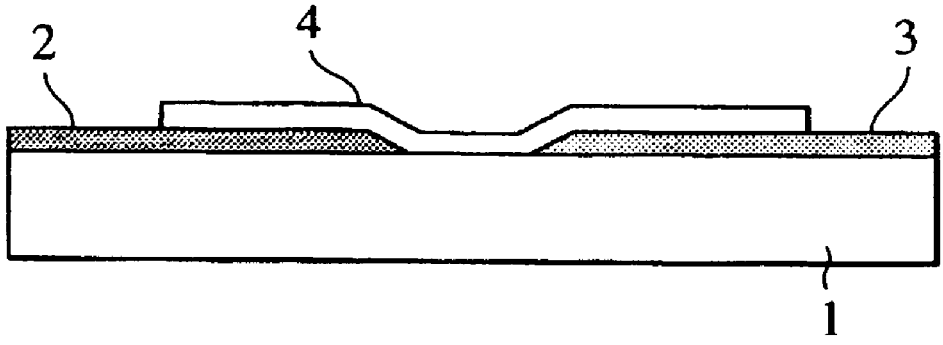
FIG. 7, consisting of FIGS. 7A and 7B, is a schematic drawing showing a method of manufacturing an electron emitting device according to still another embodiment of the present invention.
Figure 7B:
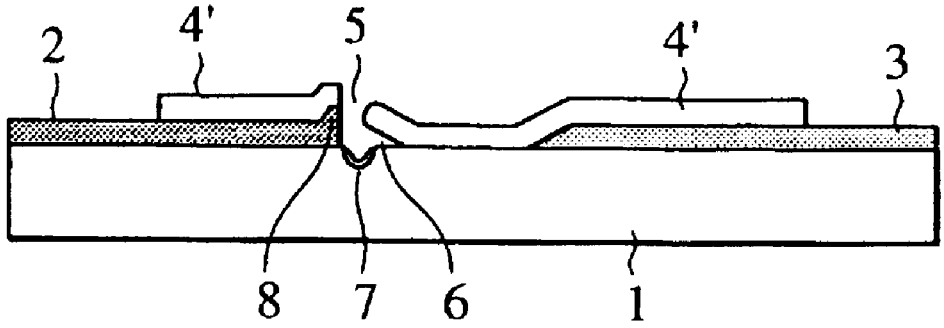

Besides the shape shown in a schematic sectional view of FIG. 1B, the gap 5 formed by the "voltage applying step" may have such a shape as shown in FIG. 4, 5 or 7B.

As shown in FIG. 1B, in the electron emitting device of the present invention, the carbon film 4' connected to the electrode 3 is disposed between the electrodes 2 and 3 on the upper surface of the substrate 1, as shown in a plane (sectional view), passing through the electrodes 2 and 3, substantially perpendicular to the upper surface of the substrate 1 on which the electrodes 2 and 3 are formed.

As described above, in the electron emitting device of the present invention, one end surface of the electrode 2 is preferably exposed to (and present in) the gap 5, as shown in FIG. 1B. In other words, a portion of the carbon film (conductive film) 4', which is connected to electrode 3 faces the electrode 2 (i.e., an end portion of the electrode 2) within the gap 5. The gap 5 is defined by the carbon film (conductive film) 4' connected to the electrode 3, the electrode 2 (the edge portion of the electrode 2) and the substrate 1. As used in the present description, the term "faces" represents a state in which a space between two members is not filled with another solid. However, the term also includes a case in which contaminants and deposits are slightly present on the opposing surfaces of members. Thus, as used herein, the term "faces" includes a state in which no film is observed on each of surfaces of two facing members at least by SEM or section TEM.

In the electron emitting device of the present invention, particularly the portion of the film 4' adjacent to the gap 5, and being a portion of the carbon film (conductive film) 4' connected to the electrode 3, preferably faces a laminate of the electrode 2 and the other carbon film (conductive film) 4' which is connected to the electrode 2. In other words, within the gap 5, the carbon film (conductive film) 4' that is connected to the electrode 3 also faces an interface between the electrode 2 and the other carbon film (conductive film) 4' connected to the electrode 2. It is also said that the gap 5 is defined by the carbon film (conductive film) 4' connected to the electrode 3, the electrode 2 (an end portion of the electrode 2), and the substrate 1. More specifically, the gap 5 of the electron emitting device of the present invention is defined by a portion (or an edge) of a lower surface of a carbon film 4' which is connected at another portion thereof to the electrode 3, a surface portion of the electrode 2, and an end portion (or edge) of a carbon film 4' which is connected to electrode 2. The end portion (surface portion) of the electrode 2 is not necessarily exposed over the entire region (over the whole length W shown in FIG. 1A) in the gap 5. Also, the electrode 3 is apart from the gap 5, and thus the electrode 3 is not exposed (present) to the gap 5.

FIG. 1 schematically shows the state in which at least one carbon film is completely divided into two parts by the gap 5. However, it also is within the scope of the present invention to include a case in which a portion of the carbon film 4' near the electrode 2 is partially connected to a portion of the carbon film 4' near the electrode 3 without causing a problem of electron emission.

The inventors have discovered that when the electrode 2 and the carbon film 4' connected to the electrode 2 are present at (exposed to) the gap 5, the electron emission efficiency is significantly improved. Although the reason for this is not known completely, the inventors believe that, owing to the influence of an electric field at the interface between the electrode 2 and the carbon film 4' on the electrode 2, tunnel electrons from the carbon film 4' connected to the electrode 3 are highly likely to become emission electrons to be captured by the anode electrode. As a result, excellent electron emission efficiency and electron emission properties can be obtained.

In the electron emitting device of the present invention, an end surface of the electrode 2 is exposed to (present at) the gap 5, but the electrode 3 is apart from the gap 5, and is not exposed to (present at) the gap 5. This construction makes a significant asymmetry in the electron emission properties with respect to the polarities of the voltage applied between the electrodes 2 and 3. This is possible due to a difference in electron emission efficiency between the case of electron tunneling from the electrode 2 (or the carbon film 4' connected to the electrode 2) and the case of electron tunneling from the carbon film 4' connected to the electrode 3. Therefore, when the end surface of the electrode 2 is exposed to the gap 5, even if a bias that is reversed relative to a forward bias, is applied to the electron emitting device, unnecessary electron emission can be suppressed in line-sequential driving of a plurality of the electron emitting devices of the present invention. Those electron emitting devices are arranged in a matrix, and connected to signal scanning wirings (63) to which scanning signals are applied, and signal wirings (62) which are perpendicular to the scanning lines (63) and to which modulation signals are applied in synchronism with the scanning signals, so that scanning signal pulses are sequentially applied to the scanning wirings (63). As a result, unnecessary light emission can be suppressed in a display, thereby achieving an excellent display contrast.

The width (the distance between the electrode 2 side edge (the side facing electrode 2) of the carbon film 4' connected to the electrode 3 and the end surface of the electrode 2 (or film 4' disposed thereon) exposed to the gap 5 is preferably 50 nm or less, more preferably 10 nm or less, and most preferably 5 nm or less, although other distances also may be employed. In this case, the electron emitting device of the present invention can be driven with several tens of volts.

As shown in FIG. 1B, in the electron emitting device of the present invention, space 6 is preferably present between the upper surface of the substrate 1 and the carbon film 4' connected to electrode 3, within the gap 5. Namely, the space 6 is preferably present between a lower surface portion of the carbon film 4' connected to electrode 3, adjacent to the electrode 2, and the upper surface of the substrate 1. Therefore, in the electron emitting device of the present invention, the width (the length extending as depicted in the cross section shown in the drawings) of the gap 5 at a distance separated from the upper surface of the substrate 1 is smaller than the width thereof at or adjacent to the upper surface of the substrate. The space 6 can separate the tunneling region from the upper surface of the substrate 1, possibly suppressing an adverse effect on the tunneling region in which ions or the like contained in the substrate 1 tunnel. Consequently, the space 6 possibly has the function to stabilize the electron emission properties, and to suppress a useless leakage current between the electrode 2 and the carbon film 4' connected to the electrode 3.

In the electron emitting device of the present invention, the Joule heat generated in the "voltage applying step" for forming the gap 5 can be controlled to transform the substrate 1 within the gap 5. As a result, as shown in FIGS. 4, 5, and 7B, a recess ("concave portion" or "depressed portion") 7 can be formed in the upper surface of the substrate 1 adjacent to the gap 5. When the recess 7 is formed, a portion of the gap 5 is formed by the recess 7 in addition to the above-described members.

The recess 7 can extend the effective distance along the upper surface of the substrate 1 between the facing members (the carbon film 4' connected to the electrode 3 and the electrode 2 or carbon film 4' connected to the electrode 2) with the gap 5 provided therebetween. As a result, within the gap 5 to which a high electric field is applied, an undesirable discharge through the surface of the substrate 1 can be possibly suppressed. Therefore, it is possible to obtain the electron emitting device exhibiting breakage durability even when a high voltage is abruptly applied to the electron emitting device.

Furthermore, in the electron emitting device of the present invention, in a plane (sectional view) (FIGS. 1B, 4, 5, 7B, 16B, 28B, etc.), which is substantially perpendicular to the surface of the upper substrate 1, and which passes through the electrodes 2 and 3, the height of the upper surface of the carbon film 4' connected to the electrode 2, relative to the upper surface of the substrate 1 is preferably set to be larger than the height of the upper surface of the other carbon film 4' (which is connected to the electrode 3) relative to the upper surface of the substrate 1, and defines a part of the gap 5, at least with respect to height or distance from the surface of the substrate 1. In this construction, when the electron emitting device is driven with the potential of the electrode 2 being set higher than that of the electrode 3, the electrode 2 serving as a gate electrode is positioned above (the anode side) the edge of the carbon film 4' connected to the electrode 3 serving as a cathode electrode. Consequently, it is possible to achieve the effect of improving the electron emission efficiency and the effect of converging an emitted electron beam.

Figure 6A:
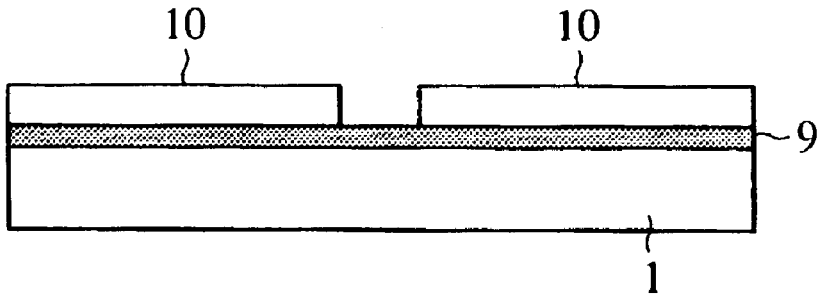
FIG. 6, consisting of FIGS. 6A to 6C, is a schematic drawing showing a method of manufacturing an electron emitting device according to another embodiment of the present invention.

Various methods can be used as the method of setting the height of the upper surface of the carbon film 4' connected to the electrode 2 relative to the upper surface of the substrate 1, to be larger than the height of the upper surface of the carbon film 4' connected to the electrode 3 relative to from the upper surface of the substrate 1. For example, a method may be employed in which an edge of the electrode 2 facing electrode 3, is tapered as shown in FIG. 6C, and then the "resistance decreasing step" and the "voltage applying step" are performed. This is due to the fact that the edge of the electrode 2 is thermally deformed and agglomerated in the formation of the gap 5 to produce a deformed portion (agglomerated portion) 8, as shown in FIG. 7B. As a result, the height of the carbon film 4' connected to electrode 2 relative to the upper surface of the substrate 1 can be increased.

The tapered edge of the electrode 2 results in control of the size of the space 6. The thinner the edge of the electrode 2 facing the electrode 3 before the "voltage applying step" is, the more easily the space 6 can be formed. On the other hand, a thick edge of the electrode 2 is advantageous to supply a current for forming the gap 5 and a current for emitting electrons, and for thermal durability. Therefore, as described above, when the edge of the electrode 2 facing the electrode 3 is tapered so that the thickness gradually decreases toward a tip thereof, the space 6 can be formed with good controllability, and the edge of electrode 2 after the "voltage applying step" can be thickened by agglomeration or deformation.

Figure 12:
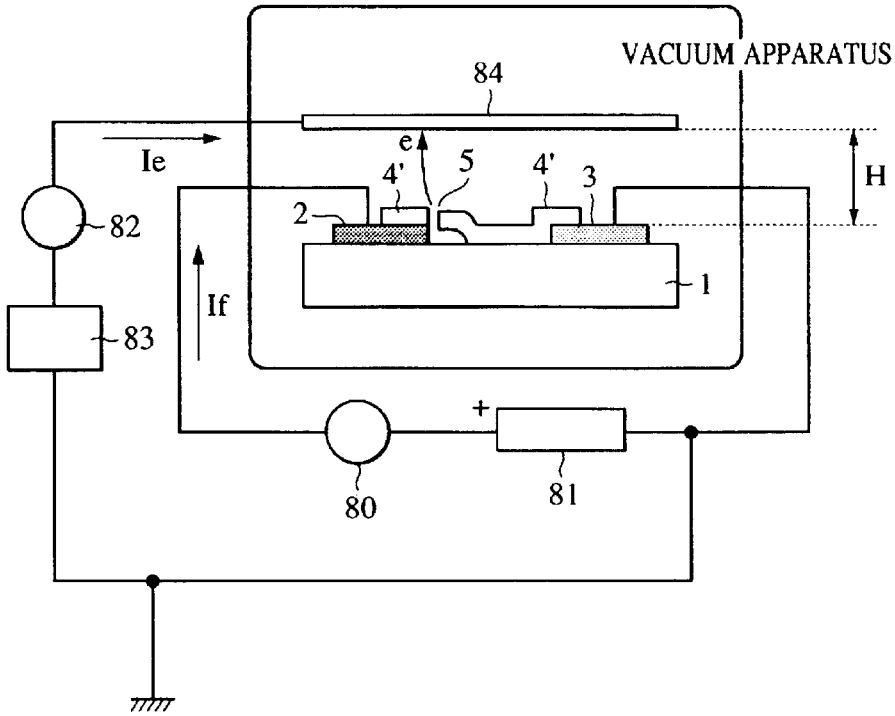
FIG. 12 is a schematic drawing showing an example of a vacuum apparatus having a measurement evaluation function.
Figure 13:
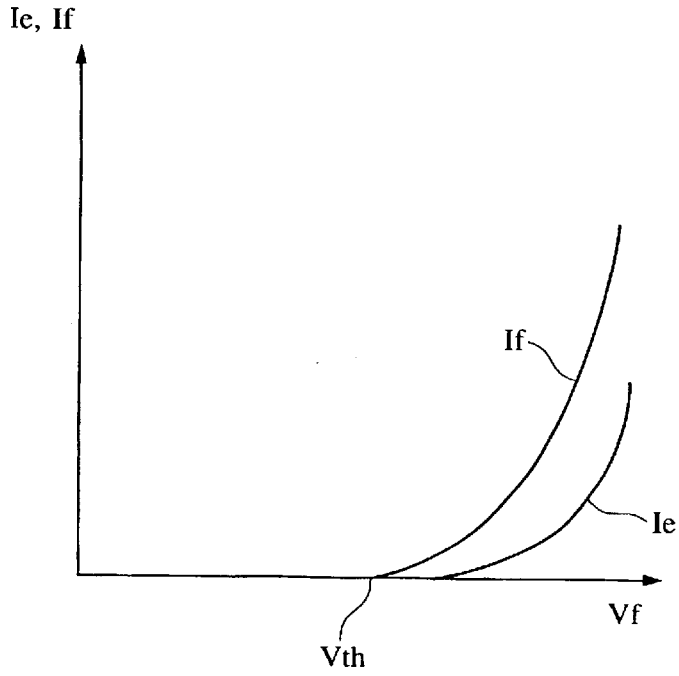
FIG. 13 is a schematic drawing showing the electron emission properties of an electron emitting device of the present invention.

As a result of measurement of the voltage-current characteristics of the electron emitting device obtained through the above steps by the measuring apparatus shown in FIG. 12, the characteristics schematically shown in FIG. 13 were obtained. Namely, the electron emitting device of the present invention has a threshold voltage Vth, and thus even when a voltage lower than the threshold voltage Vth is applied between the electrodes 2 and 3, substantially no electron is emitted. By applying a voltage higher than the threshold voltage Vth, the emission current (Ie) from the device and the device current (If) flowing between the electrodes start to increase.

This characteristic of the electron emitting device of the present invention enables selective driving of a desired device in a construction of an electron source comprising a plurality of the electron emitting devices arranged in a matrix on a same substrate.

In FIG. 12, the components denoted by the same reference numerals as in the other figures denote the same components as in those other digures. Reference numeral 84 denotes an anode, reference numeral 83 denotes a high-voltage power supply, reference numeral 82 denotes an ampere meter for measuring the emission current Ie emitted from the electron emitting device, reference numeral 81 denotes a power supply for applying a drive voltage Vf to the electron emitting device, and reference numeral 80 denotes an ampere meter for measuring the device current If flowing between the electrodes 2 and 3. In order to measure the device current If and the emission current Ie of the electron emitting device, the power supply 81 and the ampere meter 80 are connected to the electrodes 2 and 3, and the anode electrode 84 connected to the power supply 83 and the ampere meter 82 is disposed above the electron emitting device. Also, the electron emitting device and the anode electrode 84 are set in a vacuum apparatus which is provided with a device necessary for a vacuum apparatus, such as an exhaust pump, a vacuum gauge, etc. (not shown in the drawing) so that the device can be measured and evaluated in a desired vacuum. The distance H between the anode electrode 84 and the electron emitting device is 4 mm, and the pressure in the vacuum apparatus is $1\times10^{-6}$ Pa.

Figure 26:
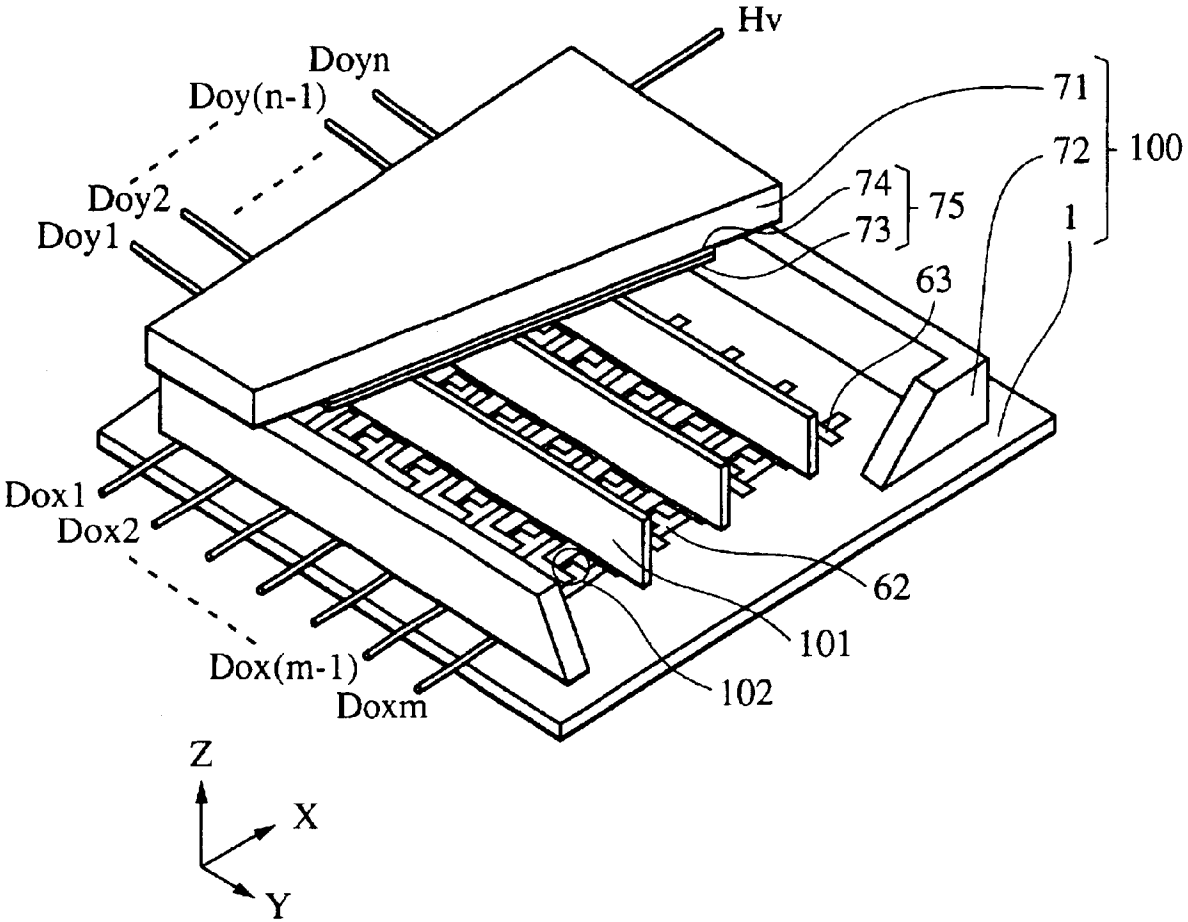
FIG. 26 is a perspective view schematically showing an example of an image forming apparatus manufactured in the present invention.

FIG. 26 is a schematic drawing showing an example of an image forming apparatus (image display apparatus) comprising the electron emitting device manufactured by the manufacturing method of the present invention. In FIG. 26, a support frame 72 and a face plate 71, which are described below, are partially removed for describing the inside of the image forming apparatus (airtight container 100).

In FIG. 26, reference numeral 1 denotes a rear plate (also referred to herein as a substrate) on which a plurality of electron emitting devices 102 of the present invention are arranged. Reference numeral 71 denotes the face plate on which an image forming member 75 is disposed. Reference numeral 72 denotes the support frame for holding the space between the face plate 71 and the rear plate 1 in a low-pressure state. Reference numeral 101 denotes a spacer disposed for holding the space between the face plate 71 and the rear plate 1.

When the image forming apparatus 100 is a flat panel display, the image forming member 75 comprises a fluorescent film 74 and a conductive film 73 such as a metal back. Reference numerals 62 and 63 each denote a wiring for applying a voltage to the electron emitting devices 102. Reference characters Doyl to Doyn, and Doxl to Doxm each denotes lead wirings for connecting driving circuits (not shown) disposed outside the image forming apparatus 100 to ends of wirings 62 and 63 led out of the vacuum space (the space surrounded by the face plate 71, the rear plate 1 and the support frame 72) of the image forming apparatus 100.

Next, an example of the method of manufacturing the image forming apparatus (image display apparatus) of the present invention shown in FIG. 26 by using the electron emitting device of the present invention is described below with reference to FIGS. 19 to 25.

(A) First, the rear plate 1 is prepared. For the rear plate 1, an insulating material, such as glass, is preferably used.

Figure 19:
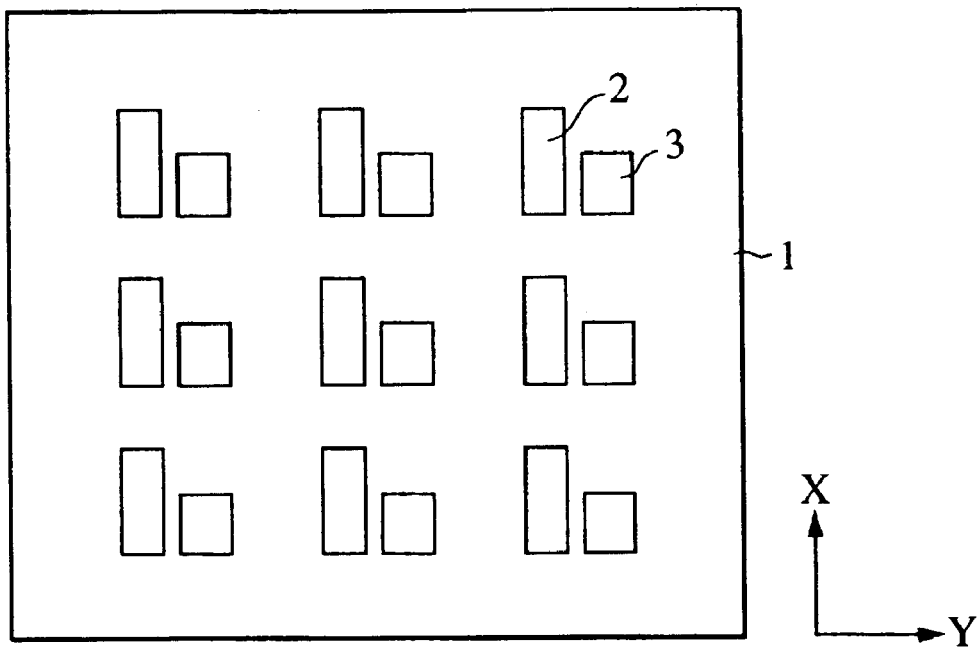
FIG. 19 is a schematic drawing showing a step for manufacturing a simple matrix arrangement electron source of the present invention.

(B) Next, plural pairs of the electrode 2 and 3 shown in FIG. 16 are formed on the rear plate 1 (FIG. 19).

As shown in FIG. 16B, the thickness of the electrode 3 is larger than the thickness of the electrode 2.

The electrodes 2 and 3 can be formed by any of various production methods such as a sputtering method, a CVD method, a printing method, etc. In order to simplify a description, FIG. 19 shows an example in which a total of 9 pairs of electrodes, including three pairs in the X direction and three pairs in the Y direction, are formed. However, the numbers of electrodes may be different than those, depending on the desired resolution of the image forming apparatus.

Figure 20:
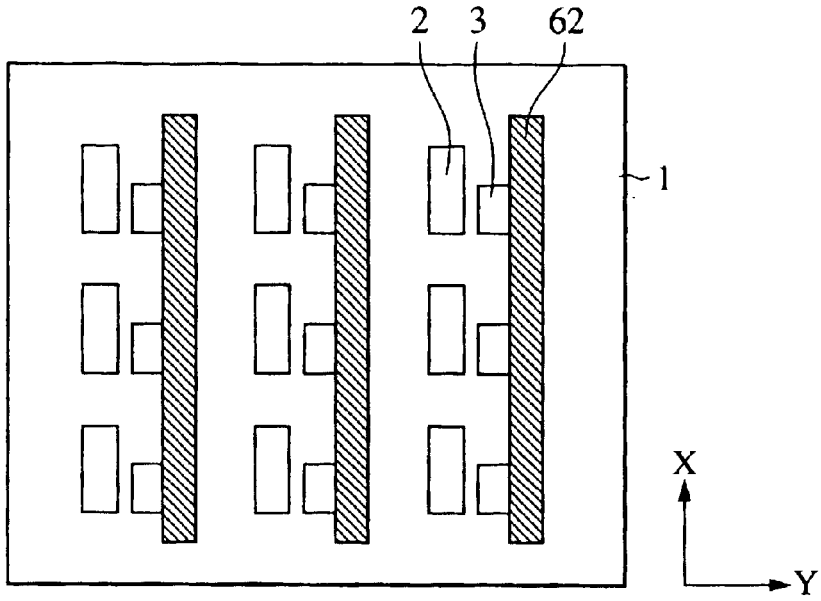
FIG. 20 is a schematic drawing showing a step performed after the step shown in FIG. 19.

(C) Next, lower wirings 62 are formed to partially cover the electrodes 3 (FIG. 20). Although the lower wirings 62 can be formed by any of various methods, the printing method is preferably used. Particularly, a screen printing method is preferred because the wirings 62 can be formed on a large substrate at a low cost.

Figure 21:
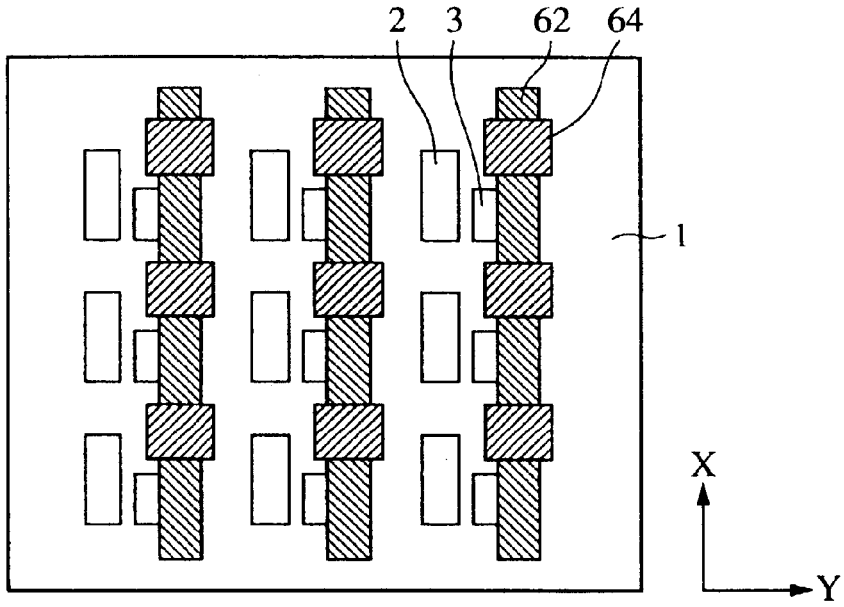
FIG. 21 is a schematic drawing showing a step performed after the step shown in FIG. 20.

(D) An insulating layer 64 is formed (FIG. 21). The insulating layer 64 is formed so as to be situated at each of the intersections between the lower wirings 62 and upper wirings 63 to be formed in a next step. Although the insulating film 64 can also be formed by any of various methods, the screen printing method is preferably used. Particularly, the screen printing method is preferred because the insulating film 64 can be formed on a large substrate at a low cost.

Figure 22:
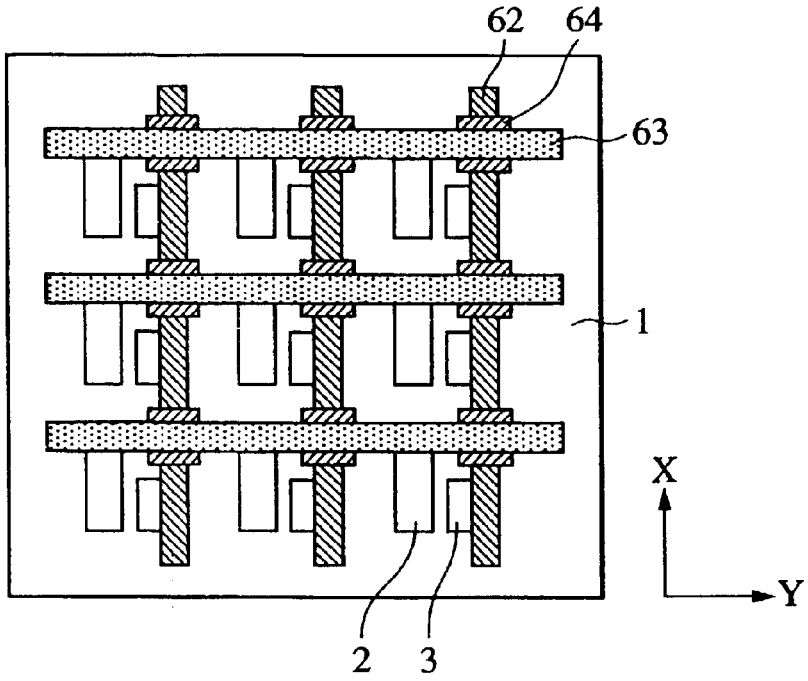
FIG. 22 is a schematic drawing showing a step performed after the step shown in FIG. 21.

(E) Next, the upper wirings 63 are formed to substantially cross the lower wirings 62 at a right angle (FIG. 22). Although the insulating film 64 can also be formed by any of various methods, the screen printing method is preferably used. Particularly, the screen printing method is preferred because the insulating film 64 can be formed on a large substrate at a low cost.

(F) Next, the polymer film 4 is formed for connecting each pair of the electrodes 2 and 3. As described above, the polymer film 4 can be formed by any one of various methods, but the ink jet printing method is preferably used for simply forming in a large area.

Figure 24:
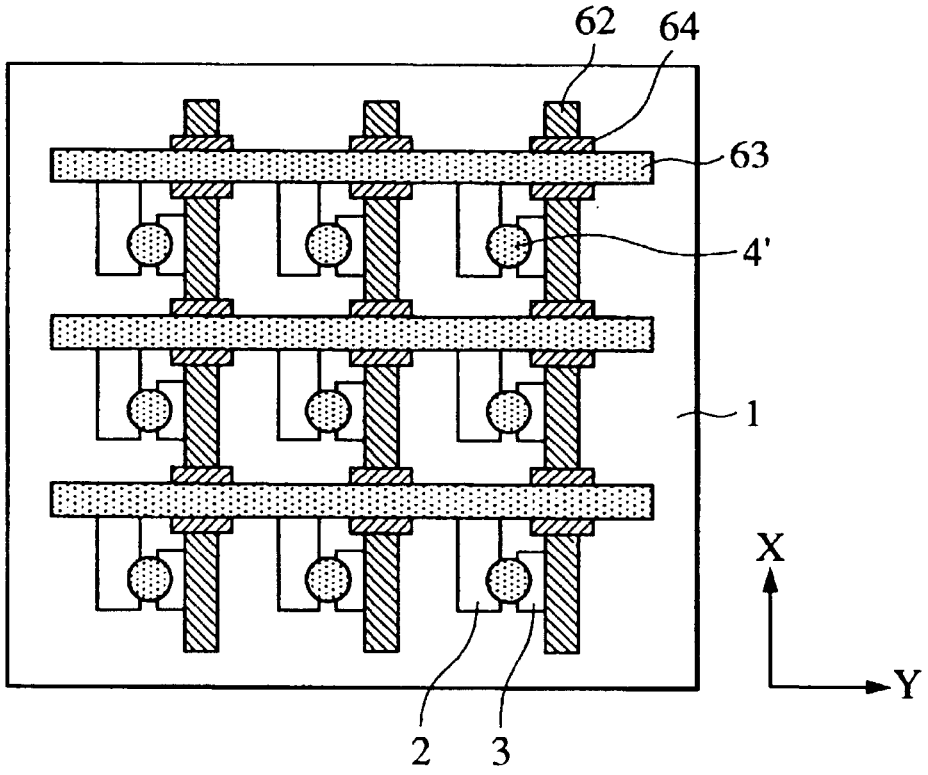
FIG. 24 is a schematic drawing showing a step performed after the step shown in FIG. 23.

(G) Then, as described above, the "resistance decreasing step" is performed for decreasing the resistance of each of the polymer films 4. In this step, the polymer films 4 are changed to the conductive films 4' (FIG. 24). Specifically, the resistivities of the conductive films 4' are in the range of $10^{-3}$ Ωcm to 10 Ωcm.

Figure 25:
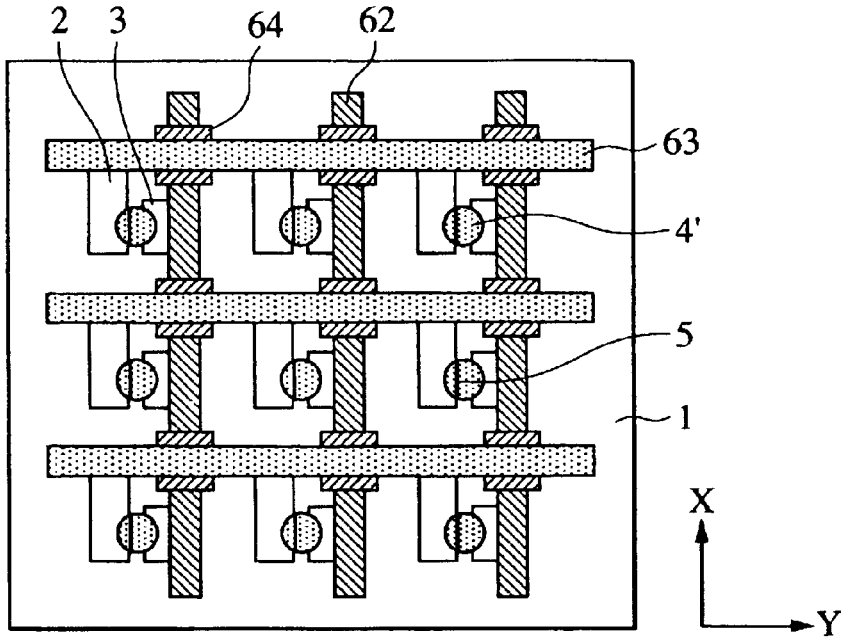
FIG. 25 is a schematic drawing showing a step performed after the step shown in FIG. 24.

(H) Next, the gap 5 is formed in each of the conductive films 4' (the films 4' obtained by decreasing the resistances of the polymer films 4) obtained in the step (G). The gaps 5 are formed by applying a voltage to each of the wirings 62 and 63. By applying the voltage to each of the wirings 62 and 63, the voltage is applied to each pair of electrodes 2 and 3. As the applied voltage, a pulse voltage is preferred. In the "voltage applying step", the gap 5 is formed in each of the conductive films 4' (FIG. 25). The gap 5 is disposed near a corresponding end of each of the electrodes 2. As each of the electron emitting devices, the device shown in any one of the drawings illustrating the present invention may be used. However, the device shown in FIG. 1 in which the carbon film is disposed on the electrode 2 is preferably used, the devices shown in FIGS. 4 and 5 in each of which the recess 7 is formed in the surface of the substrate 1 is more preferably used, and the device schematically shown in FIG. 5 is most preferably used.

The "voltage applying step" may be performed at the same time as the "resistance decreasing step". Namely, during irradiation with an electron beam or a laser beam, the voltage pulse may be continuously applied between the electrodes 2 and 3. In any event, the "voltage applying step" is preferably performed in a low-pressure atmosphere.

Figure 27A:
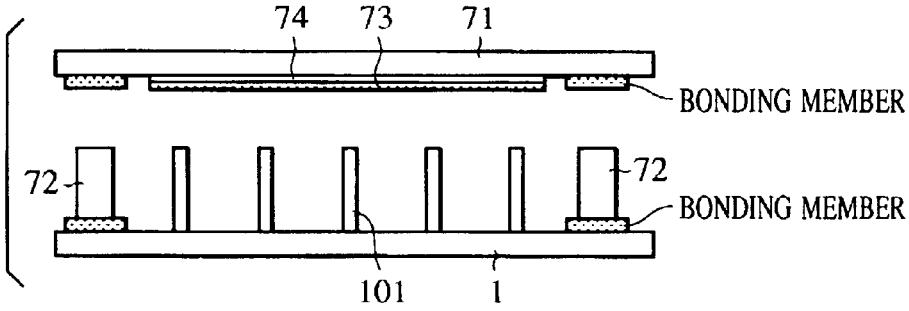
FIGS. 27A and 27B are schematic drawings respectively showing steps for manufacturing an image forming apparatus of the present invention.

(I) Next, the face plate 71 having the metal back 73 comprising an aluminum film and the fluorescent film 74 is aligned with the rear plate 1 previously passed through the steps (A) to (H) so that the metal back 73 faces the electron emitting device (FIG. 27A). Furthermore, a bonding member is disposed between the opposing surfaces ("opposing region") of the support frame 72 and the face plate 71. Similarly, a bonding member is also disposed between the opposing surfaces ("opposing region") of the rear plate 1 and the support frame 72. As the bonding member, a member having the function to maintain a vacuum and an adhesive function is preferably used. Specifically, frit glass, indium, or an indium alloy can be used.

Although FIG. 27 shows an example in which the support frame 72 is fixed (bonded), with the bonding member, to the rear plate 1 previously passed through the steps (A) to (H), the support frame 72 is not necessarily joined in the step (I). Similarly, FIG. 27 shows an example in which the spacer 101 is fixed to the rear plate 1, but the spacer 101 need not be fixed to the rear plate 1 in the step (I).

FIG. 27 shows an example in which for the sake of convenience, the rear plate 1 is positioned at a lower position, and the face plate 71 is disposed above the rear plate 1. However, in other embodiments, either of both plates may be disposed above the other.

Furthermore, FIG. 27 shows an example in which the support frame 72 and the spacer 101 are previously fixed (bonded) to the rear plate 1, but in other embodiments, they may be simply mounted on the rear plate 1 or the face plate 71 so that they are fixed (bonded) in a next, sealing step.

(J) Next, the sealing step is performed. At least the bonding member is heated while the face plate 71 and the rear plate 1, both of which are opposed to each other in the step (I), are pressed from opposite directions. In order to decrease thermal stress, the entire surfaces of the face plate 71 and the rear plate 1 are preferably heated.

In the present invention, the sealing step is preferably performed in a low-pressure (vacuum) atmosphere or a non-oxidizing atmosphere. Specifically, the pressure of the low-pressure (vacuum) atmosphere is preferably $10^{-5}$ Pa or less, and more preferably $10^{-6}$ Pa or less.

In the sealing step, the face plate 71 and rear plate 1 are joined together with airtight butting portions therebetween to obtain the airtight container (image forming apparatus) 100 shown in FIG. 26 in which a high vacuum is maintained.

Although, in this example, the sealing step is performed in a low-pressure (vacuum) atmosphere or a non-oxidizing atmosphere, in other embodiments, the sealing step may be performed in the air. In this case, an exhaust tube (not shown) is separately provided on the airtight container 100, for evacuating the space between the face plate 72 and rear plate 1 so that the airtight container 100 is evacuated to $10^{-5}$ Pa or less, and preferably $10^{-6}$ Pa or less, after the sealing step. Then, the exhaust tube is sealed to obtain the airtight container (image forming apparatus) 100 in which a high vacuum is maintained.

When the sealing step is performed in a vacuum, the step of depositing a getter material (not shown) on the metal back 73 (on the rear plate-side surface of the metal back 73) is preferably performed between the steps (I) and (J), in order to maintain the high vacuum in the image forming apparatus (airtight container) 100. In this case, as the getter material, an evaporation-type getter is preferably used for simplifying deposition. Therefore, barium is preferably deposited on the metal back 73 to form a getter film. Like the step (J), the step of depositing the getter is performed in a low-pressure (vacuum) atmosphere.

In the above-described example of the image forming apparatus, the spacer 101 is disposed between the face plate 71 and the rear plate 1. However, when the image forming apparatus is of a small size, the spacer 101 is not necessarily required. Also, if the gap between the rear plate 1 and the face plate 71 is about several hundreds $\mu$ms, the rear plate 1 and the face plate 71 can be directly bonded together with the bonding member, without using the support frame 72. In this case, the bonding member functions as a substitute member for the support member or frame 72.

In the present invention, the step (step (H)) of forming the gap 5 in the electron emitting device 102 is performed, and then the alignment step (step (I)) and the sealing step (step (J)) are performed. However, in other embodiments, the step (H) may be performed after the sealing step (step (J)). Although the electron emitting device and the manufacturing method have been described above with reference to FIG. 16, of course, the other above-described electron emitting devices and manufacturing methods of the invention may be used instead, or in addition thereto.

EMBODIMENTS

Further embodiments of the present invention will be described in detail below.

First Embodiment

In this embodiment, an electron emitting device of the present invention shown in FIG. 1 is manufactured.

A glass substrate is used as the substrate 1 so that a laser beam can be transmitted through the substrate 1. Therefore, both the front and back of the glass substrate 1 can be irradiated with a laser beam. As the material for the opposing electrodes 2 and 3, platinum having a high heat resistance to laser irradiation, and particularly a high thermal conductivity is used. Aromatic polyimide is used for the polymer film 4.

The method of manufacturing the electron emitting device of this embodiment is described with reference to FIGS. 1, 2 and 3.

(Step 1)

A quartz glass substrate used as the substrate 1 is sufficiently cleaned with a detergent, pure water and an organic solvent, and a device electrode material is deposited on the substrate 1 by a vacuum deposition or sputtering method. Then, the electrodes 2 and 3 are formed by, for example, a photolithography process (FIG. 1A). The width W of each electrode is 500 $\mu$m, and the thickness of each electrode is 100 nm.

(Step 2)

A solution of polyamic acid (produced by Hitachi Chemical Co., Ltd.: PIX-L110) which is an aromatic polyimide precursor, is diluted to a resin content of 3% with N-methylpyrrolidone/triethanolamine solvent, spin-coated, by a spin coater, on the substrate having the electrodes 2 and 3 formed thereon, and then baked at a temperature or 350° C. in a vacuum to form an polyimide film. The polyimide film formed in this step has a thickness of 30 nm. Then, the polyimide film is patterned to form the polymer film 4 having a desired shape and a width W' of 300 $\mu$m and extending across the electrodes 2 and 3 (FIG. 2B).

(Step 3)

Next, the resistance of the polymer film 4 is decreased. Specifically, the substrate 1 on which the electrodes 2 and 3 and the polymer film 4 comprising a polyimide film are formed, was set on a stage (in air), and the electrode 3 is irradiated with a second harmonic (SHG: wavelength 632 nm) of Q switch pulse Nd: YAG laser (pulse width 100 nm, repetition frequency 10 kHz, energy 0.5 mJ per pulse) (FIG. 3A).

In this step, the laser beam is moved on the stage to irradiate the electrode 3 in a direction (the width direction of the electrode, i.e., in a direction along the width of the electrode) parallel to the outer side edge of the electrode 3. Consequently, "transforming" uniformly proceeds in the width direction of the device electrode 3. FIG. 3B shows a locus of laser beam irradiation.

At the same time, a low voltage (DC 500 mV) for monitoring the resistance is applied between the electrodes 2 and 3, and laser irradiation is stopped when the resistance of the polymer film is decreased to about 500Ω.

In the electron emitting device, a resistance distribution of the deceased-resistance polymer film 4' was measured by scanning with a scanning atomic force microscope (AFM/STM) with a probe (not shown) having a metal coating for imparting conductivity, with a bias voltage applied between the electrode 3 of the device and the probe.

Figure 11A:
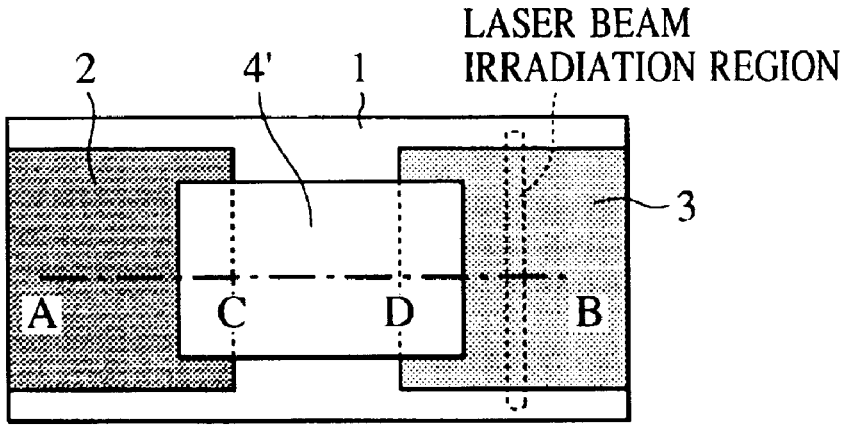
FIG. 11, consisting of FIGS. 11A and 11B, is a schematic drawing showing an example of an electrical conductivity distribution of an electron emitting device of the present invention.
Figure 11B:
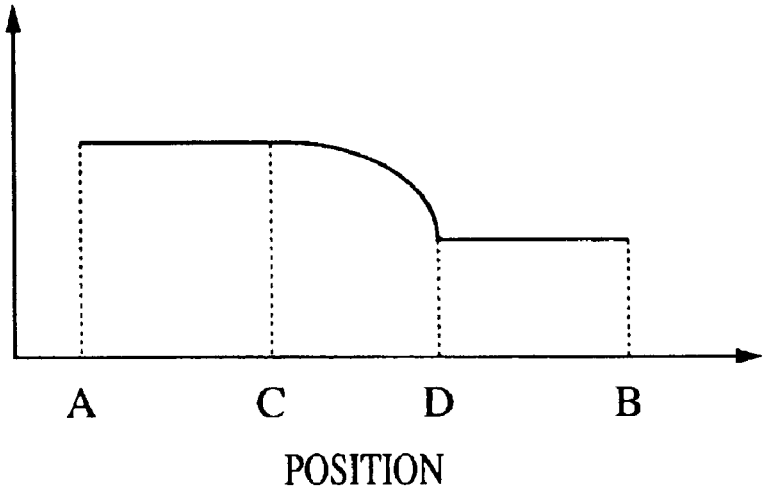

As a result, it was confirmed that a resistance distribution was formed, in which the resistance increased from the electrode 3 side irradiated with the laser beam toward the electrode 2 side. Namely, the relative resistance values on line A–B in FIG. 11A, which crosses the polymer film 4' obtained by decreasing the resistance, has a distribution in which the resistance value increases from area D toward area C between the electrodes, as shown in FIG. 11B.

As a result of Raman spectroscopic analysis of the film 4' obtained by decreasing the resistance, the polyimide film 4 was found to be transformed to the carbon film 4' containing a graphite component.

(Step 4)

Next, the substrate 1 on which the electrodes 2 and 3, and the polymer film (carbon film 4') obtained by decreasing the resistance are formed is transferred into the vacuum apparatus shown in FIG. 12, and the "voltage applying step" (the step of forming the gap 5) is performed. Specifically, a rectangular pulse of 20 V having a pulse width of 1 msec and a pulse interval of 10 msec is continuously applied between the electrodes 2 and 3 to form the gap 5 in the carbon film 4' (FIG. 3C).

Next, in the vacuum apparatus shown in FIG. 12, with a voltage of 1 kV applied to the anode electrode 84, a rectangular pulse of 19 V having a pulse width of 1 msec and a pulse interval of 10 msec is applied between the electrodes 2 and 3 of the electron emitting device manufactured in this embodiment under a condition in which the electrode 3 side irradiated with the laser beam has a negative polarity. As a result of measurement of the device current If and the emission current Ie, If=0.6 mA, and Ie=4.2 $\mu$A.

The electron emission properties of the electron emitting device manufactured in this embodiment are asymmetric with respect to the polarities of the applied voltage. When a voltage is applied with positive polarity on the electrode 3 side irradiated with the laser beam, the current flowing is only about 1/10 as large as that obtained with a reverse polarity.

As a result of detailed observation of the electron emitting device manufactured in this embodiment with an optical microscope (not shown), a scanning electron microscope (not shown) and a transmission electron microscope (not shown), the gap 5 was formed in the carbon film 4' near the electrode 2 not irradiated with the laser beam, and the space 6 was formed between the substrate 1 and the carbon film 4' within the gap 5. It was also confirmed that the electrode 2 was partially exposed to the gap 5.

Second Embodiment

Figure 8A:
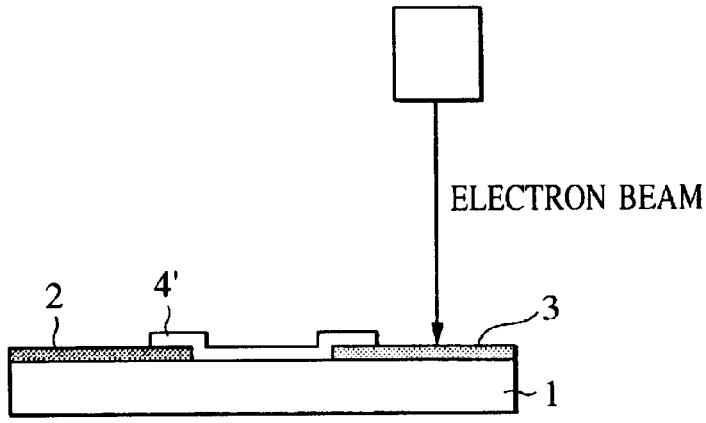
FIG. 8, consisting of FIGS. 8A to 8C, is a schematic drawing showing a method of manufacturing an electron emitting device according to a further embodiment of the present invention.
Figure 8B:
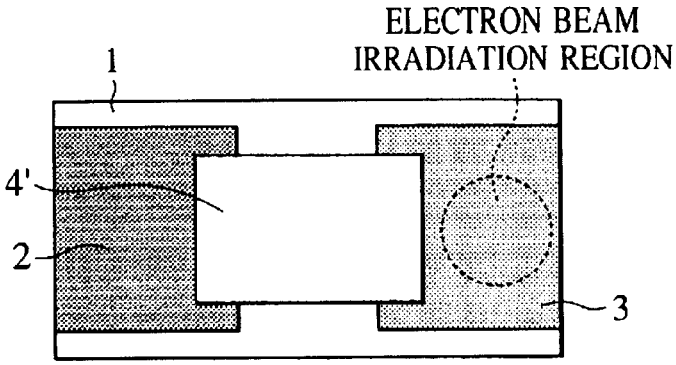
Figure 8C:
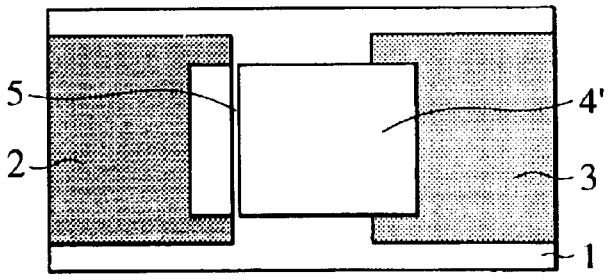

In this embodiment, an electron emitting device is manufactured by basically the same steps as the first embodiment except that in this embodiment, the "resistance decreasing step" is performed by electron beam irradiation. Therefore, steps after step 2 of the first embodiment are described with reference to FIG. 8.

(Step 3)

The substrate 1 on which the electrodes 2 and 3 and the polymer film 4 are formed is set in a vacuum container provided with an electron gun (not shown), and then the container is sufficiently evacuated. Then, the position of electron beam irradiation is set so that the center of the electron emitting device beam is applied to the electrode 3, and the electrode 3 is continuously irradiated with the electron beam (refer to FIGS. 8A and B). The conditions for electron beam irradiation include an acceleration voltage Vac of 10 kV. A spot diameter of the electron beam is set to 200 $\mu$m, and the center of the beam spot is set at a position 100 $\mu$m apart from the relevant edge of the electrode 3 so as to prevent the portion between the electrodes 2 and 3 from being directly irradiated with the electron beam. The electron emitting device beam irradiation is stopped when the resistance of the polymer film 4 is decreased to about 500Ω.

In the electron emitting device, a resistance distribution of the deceased-resistance polymer film 4' was measured by AFM/STM. As a result, it was confirmed that a resistance distribution was formed, in which the resistance increased from the electrode 3 side irradiated with the electron beam toward the electrode 2 side. Namely, the relative resistance values on line A–B in FIG. 11A, which cross the polymer film 4' obtained by decreasing the resistance, has a distribution in which the resistance value increases from area D toward area C between the electrodes 2 and 3, as shown in FIG. 11B.

As a result of Raman spectroscopic analysis of the film 4' obtained by decreasing the resistance using an electron beam, the original polyimide film 4 was found to be transformed to the carbon film 4' containing a graphite component.

(Step 4)

Next, the substrate 1 on which the polymer film (carbon film 4') transformed in the above-described step 3 is formed is set in the apparatus system shown in FIG. 12, and a rectangular pulse of 20 V having a pulse width of 1 msec and a pulse interval of 10 msec is continuously applied between the electrodes 2 and 3 to form the gap 5 in the carbon film 4'.

The electron emitting device of this embodiment is manufactured through the above steps. As a result of observation of the electron emitting device with an optical microscope (not shown) and a scanning electron microscope (not shown), it was confirmed that the gap 5 was formed in the carbon film 4' along the electrode 2 near the electrode 2 not irradiated with the electron beam.

Next, in the vacuum apparatus shown in FIG. 12, with a voltage of 1 kV applied to the anode electrode 84, a rectangular pulse of 19 V having a pulse width of 1 msec and a pulse interval of 10 msec is applied between the electrodes 2 and 3 of the electron emitting device manufactured in this embodiment under a condition in which the electrode 3 side irradiated with the electron beam has a negative polarity. As a result of measurement of the device current If and the emission current Ie, If=0.6 mA, and Ie=4.2 $\mu$A.

The electron emission properties of the electron emitting device manufactured in this embodiment are asymmetric with respect to the polarity of the applied voltage. When a voltage is applied with a positive polarity on the electrode 3 side irradiated with the laser beam, the current flowing is only about 1/10 as large as that obtained with a reverse polarity.

In the electron emitting device of this embodiment, driving is performed under a condition in which the potential of the electrode 2 is higher than the potential of the electrode 3, and stable electron emission properties can be maintained even in long-term driving.

Third Embodiment

An electron emitting device of this embodiment is basically the same as the above-described electron emitting devices except that the manufacturing method is partially different.

First, like in the steps 1 and 2 of the first embodiment, the electrodes 2 and 3, and the polymer film 4' comprising a polyimide film are formed on a substrate 1 comprising quartz glass. The electrode spacing L is 20 $\mu$m, and the width W and length of the electrodes are 500 $\mu$m and 100 nm, respectively (FIG. 1A).

With a large spacing between the electrodes, in some cases, electrical conductivity of the polymer film 4 cannot be sufficiently changed by decreasing the resistance of the polymer film 4 by heating and thermal conduction, which are performed in the first and second embodiments.

Therefore, the step of uniformly decreasing the resistance of the whole surface of the polymer film 4 is performed. Specifically, the portion of the polymer film 4 between the opposing electrodes 2 an 3 is irradiated with an electron beam to uniformly decrease the resistance of the polymer film 4 (FIG. 9A).

Figure 9B:
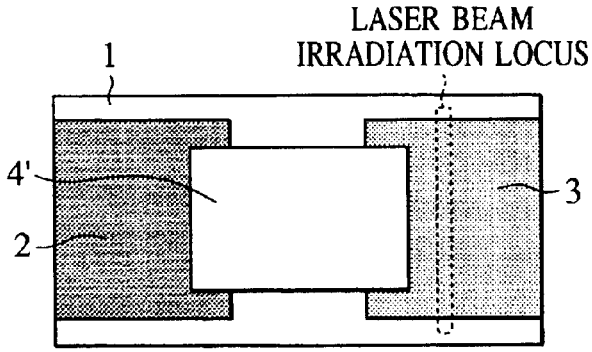

Then, at the same time as the step of electron beam irradiation, the electrode 3 was irradiated with a laser beam from an area underneath a lower surface of the substrate 1 (FIG. 9A). As the laser, a second harmonic (SHG: wavelength 632 nm) of Q switch pulse Nd: YAG laser (pulse width 100 nm, repetition frequency 10 kHz, beam diameter 10 $\mu$m) is used. In this step, the laser beam is moved relative to the polymer film 4 to irradiate the electrode 3 in a direction (the width direction of the electrode) parallel to the an outer side edge of the electrode 3. Consequently, "transforming" uniformly proceeds in the width direction of the device electrode 3. FIG. 9B shows a locus of laser beam irradiation. The laser beam irradiation is stopped when the resistance of the polymer film 4' is decreased to about 500Ω.

In the electron emitting device, a resistance distribution of the deceased-resistance polymer film 4' was measured by AFM/STM by the same method as the first embodiment. As a result, it was confirmed that a resistance distribution was formed, in which the resistance increased from the electrode 3 side irradiated with the laser beam toward the other electrode 2, as shown in FIG. 11.

As a result of Raman spectroscopic analysis of the film 4' obtained by decreasing the resistance, the polyimide film 4 was found to be transformed to the carbon film 4' containing a graphite component.

In this embodiment, electron beam irradiation is performed at the same time as laser beam irradiation of the electrode 3. However, when the electrode 3 is irradiated with a laser beam after the polymer film 4 is irradiated with an electron beam, the resistance can be decreased in the same manner as described above. In this case, the conditions of electron beam irradiation include an acceleration voltage Vac of 10 kV. The electron irradiation is stopped when the resistance value of the polymer film is decreased to about 2 kΩ. Then, the electrode 3 was irradiated with a second harmonic (SHG: wavelength 632 nm) of Q switch pulse Nd: YAG laser (pulse width 100 nm, repetition frequency 10 kHz, beam diameter 10 μm). The laser beam irradiation is stopped when the resistance of the polymer film is decreased to about 500Ω, thereby forming the carbon film 4' in the same manner as the above-described "resistance decreasing step".

Next, a bipolar rectangular pulse of 25 V having a pulse width 1 msec and a pulse interval of 10 msec is applied between the electrodes 2 and 3 by the same method as that used in the first embodiment using the apparatus system shown in FIG. 12, to form the gap 5 in the carbon film 4'. In this way, the electron emitting device of this embodiment is manufactured.

Figure 9C:
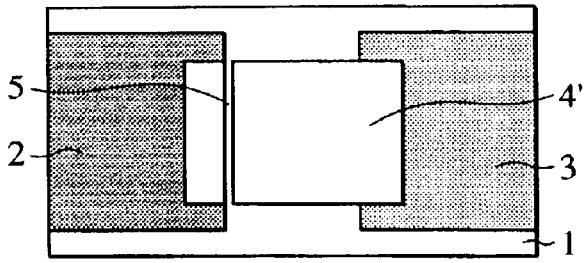

As a result of observation of the electron emitting device manufactured in this embodiment with an optical microscope (not shown) and a scanning electron microscope (not shown), it was confirmed that the gap 5 was formed in the carbon film 4' along the electrode 2 near the electrode 2 not irradiated with the laser beam (FIG. 9C). Also, it was confirmed that the electrode 2 was partially exposed to the gap 5.

Next, in the vacuum apparatus shown in FIG. 12, with a voltage of 1 kV applied to the anode electrode 84, a driving voltage of 22 V is applied between the electrodes 2 and 3 of the electron emitting device manufactured in this embodiment under a condition in which the potential of the electrode 2 is higher than that of the other electrode 3. As a result of measurement of the device current If and the emission current Ie, If=0.8 mA, and Ie=4.2 μA. Therefore, the electron emission properties were stably maintained in long-term driving.

Fourth Embodiment

In this embodiment, two electron emitting devices, which are the same as the above embodiment 1, are arranged in parallel to form an electron emitting device. This permits an emission of a large number of electrons, as compared with the case of a single electron emission section.

Figure 10A:
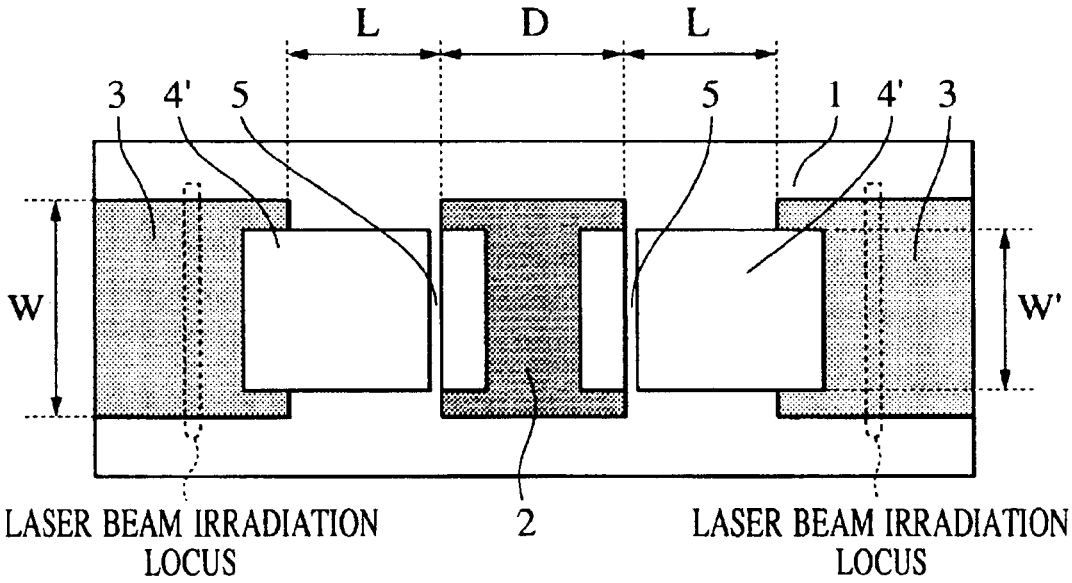
FIG. 10, consisting of FIGS. 10A and 10B, is a schematic drawing showing an electron emitting device according to a further embodiment of the present invention.
Figure 10B:
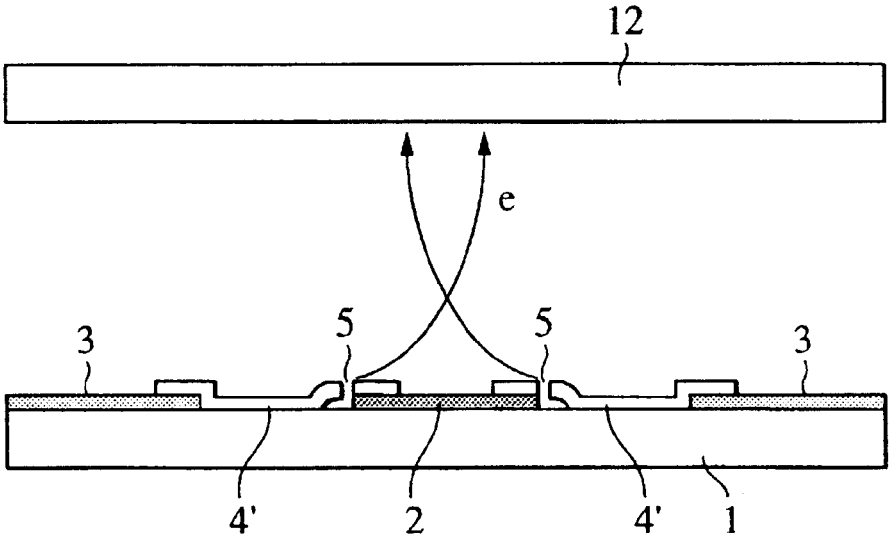

FIG. 10 schematically shows the electron emitting device of this embodiment. FIG. 10A is a plan view, and FIG. 10B is a sectional view. In these figures, the portions denoted by the same reference numerals as the above embodiment are denoted by the same reference numerals. FIG. 10B also shows an anode electrode 12.

In the electron emitting device of this embodiment, the electrodes 3 are arranged with a common electrode 2 provided therebetween, and a respective carbon film 4'is connected between one electrode 3 and electrode 2, and between the other electrode and the electrode.

First, the electrodes 2 and 3, and the polymer film 4 comprising a polyimide film are formed on the substrate 1 comprising quartz glass in the same manner as in the first embodiment. The spacing L between the electrodes 2 and 3 is 10 μm, the width W of each of the electrodes 2 and 3 is 300 μm, and the thickness of each of the electrodes 2 and 3 is 100 nm. The width W' of the polymer film 4 (and of the eventual carbon film 4') is 100 μm.

Next, the "resistance decreasing step" was performed as follows.

The substrate 1 on which the electrodes 2 and 3 and the polyimide film 4 are formed is set on a stage (in air), and the electrodes 3 are irradiated with a second harmonic (SHG: wavelength 632 nm) of Q switch pulse Nd: YAG laser (pulse width 100 nm, repetition frequency 10 kHz, beam diameter 10 μm).

In this step, the stage (not shown) is moved so that the electrodes 3 are irradiated in parallel with the outer side edges of the electrodes 3 (along the width direction). Consequently, transforming of the polyimide film 4 uniformly proceeds in the direction of the electrode width W. FIG. 10A shows a locus of laser irradiation. At the same time, a low-voltage (DC 500 mV) for monitoring the resistance is applied between each set of electrodes 2 and 3 so that laser beam irradiation is stopped when the resistance of the polyimide film 4 is decreased to about 500Ω, to stop the "resistance decreasing step".

The "resistance decreasing step" is performed for each of the two pairs of devices (polymer films).

As a result of Raman spectroscopic analysis of the film obtained by decreasing the resistance, the polyimide film 4 was found to be transformed to the carbon film 4' containing a graphite component.

In the electron emitting device, a resistance distribution of the deceased-resistance polymer film 4' was measured by AFM/STM. As a result, it was confirmed that a resistance distribution was formed, in which the resistance decreased from the common electrode 2 toward the electrodes 3 irradiated with the laser beam.

Then, the substrate 1 on which the carbon film 4' is formed in the above-described step is set in the apparatus system shown in FIG. 12, and a rectangular pulse of 20 V having a pulse width 1 msec and a pulse interval of 10 msec is continuously applied between the two pairs of the electrodes 2 and 3 by the same method as that used in the first embodiment.

As a result of observation of the electron emitting device manufactured in this embodiment with an optical microscope (not shown) and a scanning electron microscope (not shown), it was confirmed that a gap 5 was formed in each carbon film 4' adjacent an edge of the electrode 2 (i.e., a gap 5 appeared in the films 4', on both sides of the common electrode 2) (FIGS. 10A and 10B). Also, it was confirmed that the electrode 2 was partially exposed to the gap 5.

In the device manufactured in this embodiment, when a voltage is applied between the common electrode 2 with a positive polarity and the electrodes 3 with a negative polarity, electrons are emitted toward the common electrode 2, as schematically shown in FIG. 10B. In this case, when the anode electrode 12 is provided above the device, and a high voltage (several kV) is applied, electrons can be emitted from near the two gaps 5 and converged on the anode electrode 12, depending upon the anode voltage.

In the electron emitting device of this embodiment, the gaps 5 are formed near the common electrode 2, and thus two electron emission sections can be brought near to each other. Therefore, emission electrons can easily be converged on the anode electrode 12, as compared with a conventional surface conduction type of single electron emitting device in which an electron emission section is formed at a center between only two electrodes 2 and 3. Therefore, the electron emitting device of this embodiment is advantageous for higher definition of an image when used as an electron source of an image forming apparatus.

Fifth Embodiment

In this embodiment, an inner facing edge of each of opposing electrodes 2 and 3, connected to the polymer film 4, is tapered so that the thickness thereof gradually decreases toward a tip of the electrode 2 or 3 (the opposite electrode side).

The method of manufacturing the electron emitting device of this embodiment will be described below with reference to FIGS. 6 and 7.

A quartz glass substrate used as the substrate 1 is sufficiently cleaned with a detergent, pure water and an organic solvent, and an electrode material (Pt) 9 is deposited on the substrate 1 by a vacuum deposition or sputtering method. Then, a photoresist pattern 10 corresponding to the shape of the electrodes 2 and 3 is formed on the Pt thin film deposited on the substrate 1 by a conventional photolithography process (FIG. 6A).

Figure 6B:
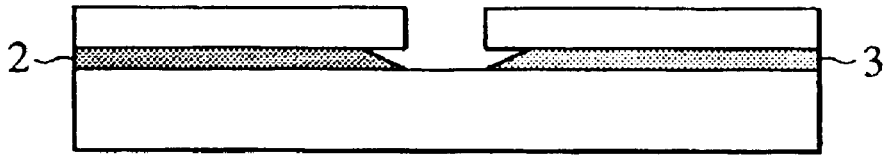
Figure 6C:
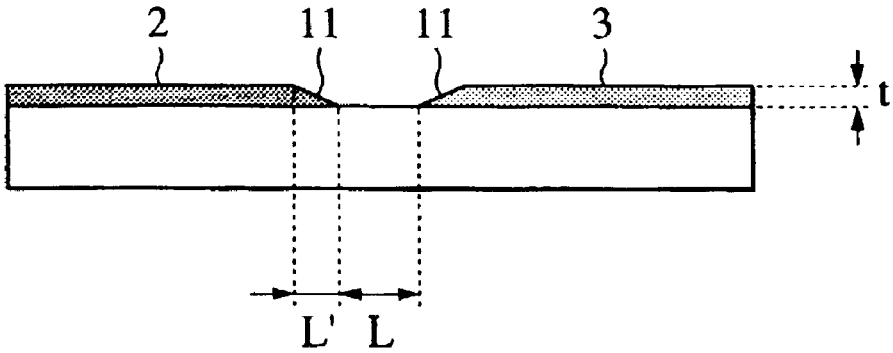

Next, the electrode material 9 is patterned by RIE (reactive ion etching) using $CF_4/O_2$ (FIG. 6B).

Next, the photoresist pattern 10 is removed with an organic solvent to form electrodes 2 and 3 (FIG. 6C). The spacing L between the electrodes is 10 νm, the width W of the electrodes is 500 νm, and the thickness t of the electrodes is 30 nm.

In the region in which the electrodes 2 and 3 oppose each other, an inner facing edge of each electrode 2 and 3 has a tapered structure 11 resulting from anisotropic etching. Namely, in the electrode forming method of this embodiment, the inner facing edge of each electrode is tapered, the taper length L' being 500 nm.

The polymer film 4 comprising a polyimide film is formed between the electrodes 2 and 3 formed as described above in the same manner as in the first embodiment. The thickness of the polymer film 4 is 30 nm. The polymer film. 4 is patterned by the photolithography process with a width W' of 300 $\mu$m, to form the polyimide film 4 having a desired shape (FIG. 7A).

Next, the "resistance decreasing step" is performed by electron beam irradiation in the same manner as in the second embodiment, to convert the polyimide film 4 to the carbon film 4'. In this step, the electrode 3 is irradiated with an electron beam so that the resistance of the carbon film 4' gradually increases from the electrode 3 towards the electrode 2.

Then, the "voltage applying step" is performed for the carbon film 4' formed as described above in the same manner as in the second embodiment to form the gap 5 near the inner facing edge of the electrode 2.

As a result of measurement of a structure near the gap 5 with a transmission electron microscope (not shown), it was confirmed that the inner facing edge of the electrode 2, which had the taper structure 11, was retracted due to agglomeration/deformation 8. Also, the substrate 1 is alternated to form a recess 7 along the gap 5, and a space 6 is also formed between the substrate 1 and the carbon film 4' along the gap 5. Furthermore, it was found that the electrode 2 is exposed to the gap 5 (FIG. 7B).

Although, in the first embodiment, the space 6 is partially formed at the inner facing edge of the electrode 2, while in the present embodiment, the space 6 is found to be formed over the entire gap 5. Namely, it is found that the space 6 can be effectively formed due to the presence of the taper structure 11.

In this embodiment, in the gap 5, a surface (the upper surface or tip) of the carbon film 4' on the electrode 2 is positioned above an adjacent, facing tip (edge) of the carbon film 4' connected to electrode 3. In this embodiment, the difference between the height of that surface of the carbon film 4' on the electrode 2 and the height of the adjacent, facing tip or edge of the carbon film 4' connected to electrode 3, is larger than the relative heights of the corresponding portions of the electrodes 2 and 3 in the first embodiment.

Sixth Embodiment

Like in the fifth embodiment, in the present embodiment, an electrode having a tapered edge is used. However, the method of forming a taper structure is different from that used in the fifth embodiment. In the present embodiment, the method of manufacturing the electron emitting device is described with reference to FIGS. 6 and 7.

In this embodiment, a photoresist pattern 10 corresponding to the shape of the electrodes 2 and 3 is formed on the Pt film 9 deposited on the substrate 1 by a conventional photolithography process, and then patterned by wet etching. In this step, an etchant, $HNO_3/7HCl/8H_2O$ is used. Next, the photoresist pattern 10 is removed with an organic solvent to form the electrodes 2 and 3 (refer to FIG. 6).

In the inner edge portions where the electrodes 2 and 3 oppose and face each other, each of the electrodes 2 and 3 formed as described above has a taper structure 11 due to anisotropic etching. The thickness of each of the electrodes is 100 nm, and the taper length L' is 1000 nm.

A polymer film 4 comprising a polyimide film is formed between the electrodes 2 and 3 formed as described above, in the same manner as the fifth embodiment (FIG. 7A).

Next, the "resistance decreasing step" is performed by electron beam irradiation to change the polyimide film to a carbon film 4' by the same method as that used in the second embodiment. In this step, the electrode 3 is irradiated with an electron beam so that the resistance of the carbon film 4' gradually increases in a direction from the electrode 3 towards the electrode 2.

Then, the "voltage applying step" is performed, in the same manner as in the second embodiment, for the carbon film 4' formed as described above to form a gap 5 near the inner facing edge of electrode 2.

As a result of measurement of a structure near the gap 5 with a transmission electron microscope (not shown), it was confirmed that the inner facing edge of the electrode 2, which had the taper structure 11, was retracted due to agglomeration/deformation 8. Also, the substrate is alternated to form a recess 7 along the gap 5, and a space 6 is also formed between the substrate 1 and the carbon film 4' along the gap 5. Furthermore, it is found that the electrode 2 is exposed to the gap 5 (FIG. 7B).

As a result of evaluation of the electron emitting device manufactured in this embodiment by the same method as that used in the fifth embodiment, a high efficiency electron emission could be stably maintained for a long period of time, as in the case of the electron emitting device of the fifth embodiment.

Seventh Embodiment

In this embodiment, an electron source comprising a plurality of electron emitting devices of the present invention are arranged in a matrix, and an image display device are manufactured.

Figure 14A:
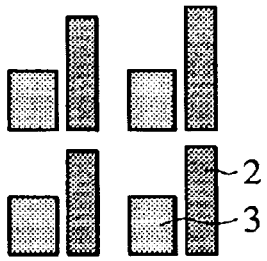
FIG. 14, consisting of FIGS. 14A to 14E, is a schematic drawing showing an example of a process for manufacturing a simple matrix arrangement electron source of the present invention.
Figure 14B:
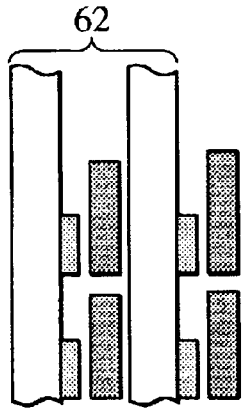
Figure 14C:
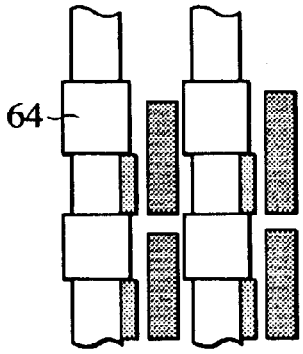
Figure 14D:
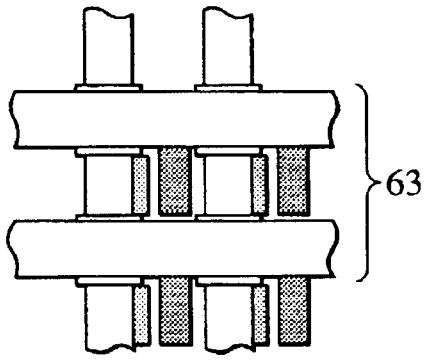
Figure 14E:
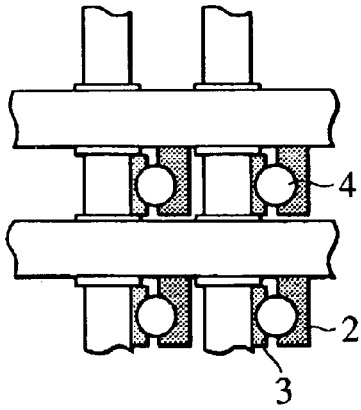
Figure 15:
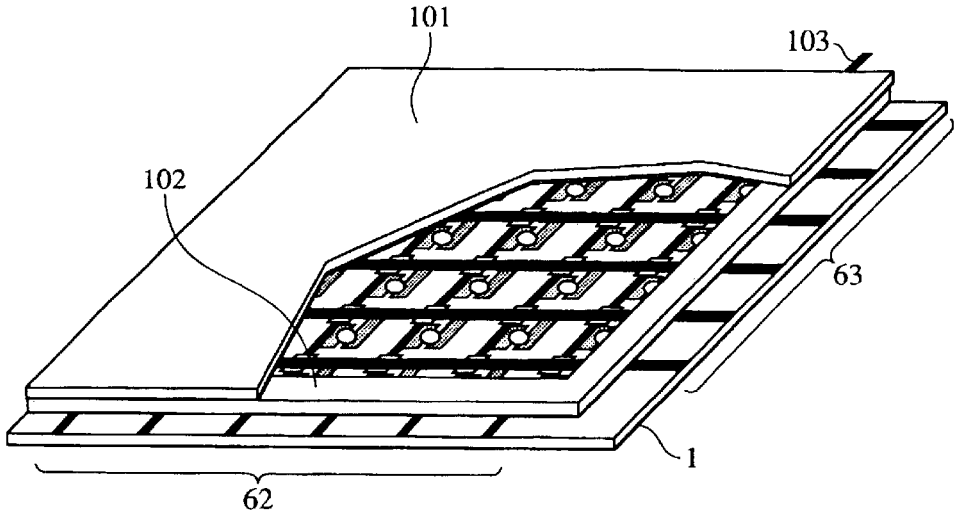
FIG. 15 is a schematic drawing showing an example of a display panel of a simple matrix arrangement image display apparatus of the present invention.

FIG. 14 is a schematic drawing illustrating the process for manufacturing an electron source of this embodiment, and FIG. 15 is a schematic drawing showing an image display device of this embodiment.

FIG. 14 is an enlarged view showing a portion of the electron source of this embodiment, in which the same reference numerals as shown in FIG. 1 denote the same members. In FIG. 14, reference numeral 62 denotes a Y-direction wiring, reference numeral 63 denotes an X-direction wiring, and reference numeral 64 denotes an interlayer insulating layer.

In FIG. 15, the same reference numerals as those in FIGS. 1 and 14 denote the same members. Reference numeral 101 denotes a face plate comprising a glass substrate on which a fluorescent film and an Al metal back are deposited, reference numeral 102 denotes a support frame for mounting a substrate 1 and the face plate 101 thereon, wherein the substrate 1, the face plate 101, and support frame 102 form a vacuum sealed container. Reference numeral 103 denotes a high-voltage terminal.

This embodiment will be described below with reference to FIGS. 14 and 15.

A Pt film is deposited to a thickness of 100 nm on a high-strain-point glass substrate (produced by Asahi Glass Co., Ltd., PD 200, softening point 830° C., annealing point 620° C., strain point 570° C.) by a sputtering method, and then patterned by a photolithography process to form a plurality of electrodes 2 and 3 each comprising the Pt film (FIG. 14A). The spacing between the electrodes 2 and 3 is 10 $\mu$m.

Next, Ag paste is printed by a screen printing method, and then baked to form the Y-direction wirings 62 connected to the plurality of the electrodes 3 (FIG. 14B).

Next, an insulating paste is printed at each of the intersections of the Y-direction wirings 62 and the X-direction wirings 63 by the screen printing method, and then baked to form insulating layers 64 (FIG. 14C).

Next, An Ag paste is printed by the screen printing method, and then baked to form the X-direction wirings 63 connected to the plurality of the electrodes 2 to form a matrix wiring on the substrate 1 (FIG. 14D).

A 3%-triethanolamine N-methylpyrrolidone solution of a polyamic acid, which is a polyimide precursor, is coated, by an ink jet printing method, across each pair of electrodes 2 and 3 on the substrate 1 having the matrix of wirings 62 and 63 formed thereon so that a coating center is positioned between each pair of electrodes 2 and 3. The coating is then baked at a temperature or 350° C. in a vacuum to form polymer films each comprising a circular polyimide film having a diameter of about 100 $\mu$m and a thickness of 300 nm (FIG. 14E).

Next, the substrate 1 on which the Pt electrodes 2 and 3, the matrix wirings 62 and 63, and the polymer films 4 (each comprising a polyimide film) are formed is set on a stage (not shown), and the "resistance decreasing step" is performed by irradiating each of the electrodes 3 of the electron emitting devices with a second harmonic (SHG) of Q switch pulse ND: YAG laser (repetition frequency 10 kHz, beam diameter 30 $\mu$m).

In this step, the stage (not shown) is moved so that each of the electrodes 3 is irradiated in a direction parallel to the outer, side (width) edge thereof. In the "resistance decreasing step", each of the polymer films 4 each comprising a polyimide film is transformed to a carbon film 4' containing a graphite component.

Then, the substrate 1 (electron source substrate) on which a plurality of devices are arranged in a matrix as described above and the face plate 101 are arranged opposite to each other with the support frame 102 provided therebetween and having a thickness of 2 mm, and then sealed with frit glass at 400° C. Also, a fluorescent film serving as a light emitting member and an Al metal film (metal back) corresponding to anode electrode are deposited on the surface of the face plate 101 which faces the electron source substrate 1. The fluorescent film comprises fluorescent materials, which respectively emit primary color lights of R (red), G (green) and B (blue), and which are arranged in stripes.

Then, the inside of the resulting sealed container 100 comprising the substrate 1, the face plate 101 and the support frame 102 is evacuated by a vacuum pump (not shown) through an exhaust tube (not shown), and a non-evaporation type getter (not shown) is heated (activation of getter) in the sealed container 100, in order to maintain a degree of vacuum. Then, the exhaust tube is welded by using a gas burner (not shown) to seal the container 100.

Finally, in the "voltage applying step", a bipolar rectangular pulse of 25 V with a pulse width 1 msec and a pulse interval of 10 msec is applied to each of the devices, i.e., between the electrodes 2 and 3, through the Y-direction wirings 62 and the X-direction wirings 63. In this step, a gap 5 is formed in each of the carbon films 4' near the electrodes 2, to manufacture the electron source and the image display device of this embodiment.

In the image display device completed as described above, the X-direction wirings 63 are used as scanning wirings to which scanning signals are applied, and the Y-direction wirings 62 are used as signal wirings to which modulation signals synchronous with the scanning signals are applied. In line-sequential driving by applying a voltage of 22 V to a desired electron emitting device, when a voltage 8 kV is applied to the metal back through the high-voltage terminal 103 (FIG. 15), a uniform good image can be displayed without variations in brightness over a long period of time.

Eighth Embodiment

In this embodiment, an electron emitting device schematically shown in FIG. 16 is manufactured. A method of manufacturing the electron emitting device is described with reference to FIGS. 16 and 17.

(Step 1)

Figure 17A:
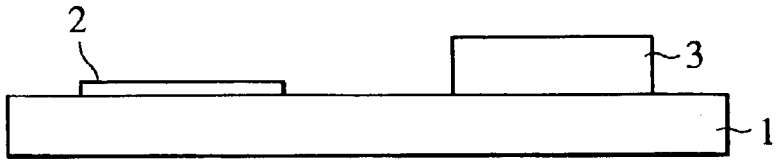
FIG. 17, consisting of FIGS. 17A to 17D, is a schematic sectional view showing an example of a method of manufacturing an electron emitting device of the present invention.

A quartz glass substrate is used as a substrate 1, and sufficiently cleaned with pure water and an organic solvent. Then, platinum is deposited to a thickness of 30 nm on the substrate 1 by a sputtering method, and platinum is further deposited to a thickness of 50 nm through a mask (not shown) having an opening in a region in which a device electrode 3 is to be formed. Next, a resist pattern corresponding to the shape of device electrodes 2 and 3 is formed, and then dry etching is performed to form the device electrodes 2 and 3. Consequently, the asymmetric device electrodes 2 and 3 including the device electrode 2 having a thickness of 30 nm and the device electrode 3 having a thickness of 8 nm are formed (FIG. 17A). The spacing of the electrodes 2 and 3 is 10 $\mu$m.

(Step 2)

A solution of polyamic acid (produced by Hitachi Chemical Co., Ltd.: PIX-L110) which is an aromatic polyimide precursor, is diluted with a N-methylpyrrolidone solvent containing 3% of triethanolamine, and spin-coated, by a spin coater, on the substrate 1 having the device electrodes 2 and 3 formed thereon as described above. Then, the coating is baked at a temperature or 350° C. in a vacuum to form a polyimide film. The polyimide film has a thickness of 30 nm.

Figure 17B:
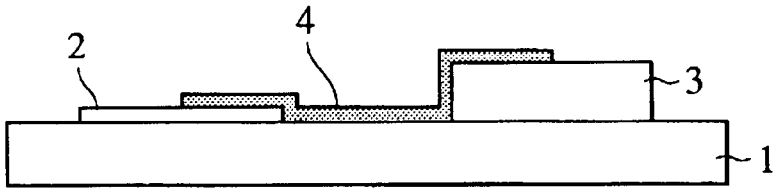

The polyimide film is patterned into a 300-$\mu$m square extending across the device electrodes 2 and 3 by the photolithography process to form a polymer film 4 having a desired shape (FIG. 17B).

(Step 3)

Figure 17C:
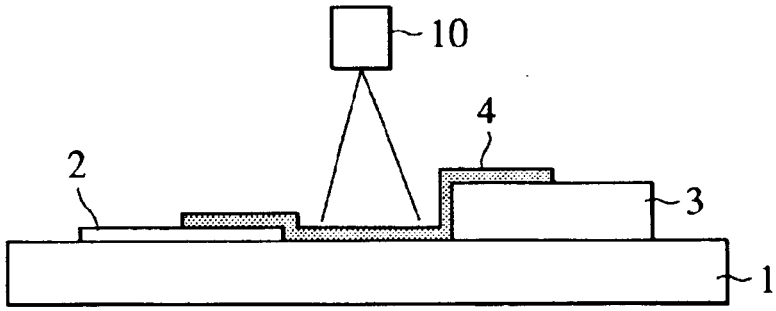

Next, the substrate 1 on which the device electrodes 2 and 3, and the polymer film 4 are formed is set on a vacuum container (not shown in FIGS. 16 and 17) provided with an electron gun (not shown), and the vacuum container is sufficiently evacuated. Then, the entire surface of the polymer film 4 is irradiated with an electron beam with an acceleration voltage Vac of 10 kV to decrease the film's resistance (FIG. 17C).

In this step, the resistance between the device electrodes 2 and 3 is monitored so that electron beam irradiation is stopped when the resistance is decreased to 1 kΩ. As a result of Raman spectroscopic analysis of the polyimide film obtained by decreasing the resistance, the polyimide film 4 was found to be transformed to a carbon film 4' containing a graphite component.

(Step 4)

Figure 17D:
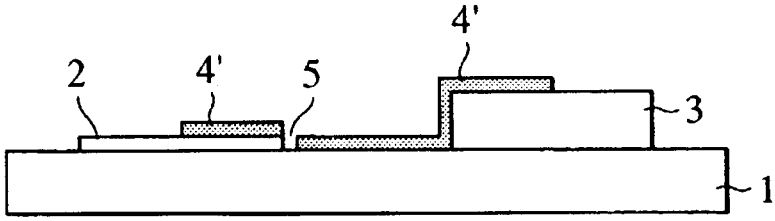

Next, the substrate 1 on which the device electrodes 2 and 3 and the carbon film 4', are formed is transferred into a vacuum apparatus shown in FIG. 12, and a rectangular pulse having a pulse height value of 8 V, a pulse width of 1 msec and a pulse interval of 10 msec is continuously applied between the device electrodes 2 and 3 to form the gap 5 in the carbon film 4' (FIG. 17D).

The electron emitting device of this embodiment is manufactured through the above steps.

A driving voltage of 20 V is applied between the device electrodes 2 and 3 of the electron emitting device of this embodiment with a voltage of 1 kV applied to an anode electrode 84 in the vacuum apparatus shown in FIG. 12, and the device current If and the emission current Ie were measured. As a result, If=0.6 mA, and Ie=4.0 μA, and the electron emission properties are asymmetric with respect to the polarities of the applied voltage. When a voltage was applied with a negative polarity on the device electrode 2 side, a flowing current was about 1/10 of the current obtained with reversed polarity voltage. In long-term driving with positive polarity on the electrode 2, the electron emitting device properties were stably maintained.

As a result of observation of a section of the electron emitting device of this embodiment with a transmission electron microscope (TEM), the gap 5 was formed near the device electrode 2.

Ninth Embodiment

In this embodiment, as shown in FIG. 18, an electron emitting device comprising an electrode 2 having a tapered edge is manufactured. The method of manufacturing the electron emitting device will be described below.

A quartz glass substrate is used as a substrate 1, and sufficiently cleaned with pure water and an organic solvent. Then, platinum is deposited to a thickness of 50 nm on the substrate 1 by a sputtering method, and a resist pattern is formed in a region in which a device electrode 2 is to be formed. Then, dry etching is performed to form the device electrode 2. Then, a resist pattern having an opening in a region in which a device electrode 3 is to be formed is formed, and then platinum is deposited to a thickness of 50 nm by the sputtering method, to form the device electrode 3 by lift off.

As a result of FE-SEM observation of a section of the substrate 1 on which the device electrodes 2 and 3 are formed by the above-described method, the angle θ1 formed by a side plane of the device electrode 2 and an upper surface of the substrate 1 was different from the angle θ2 formed by a side plane of the device electrode 3 and the upper surface of the substrate 1. In observation of a FE-SEM image, the angle θ1 formed by the side plane of the device electrode 2 and the substrate 1 was about 60°, and the angle θ2 formed by the side plane of the device electrode 3 and the substrate 1 was about 90°.

As described above, the device elements 2 and 3 having asymmetric shapes are formed. A spacing between the electrodes 2 and 3 is 10 μm.

Then, a polymer film 4 is formed, the resistance is decreased, and then a gap 5 is formed by the same steps as the above steps 2 to 4 in the eighth embodiment to manufacture the electron emitting device of this embodiment.

In this embodiment, when a potential applied to the device electrode 2 is set to be higher than the potential applied to the device electrode 3, good electron emission properties can be obtained.

As a result of observation of a section of the electron emitting device of this embodiment with a transmission electron microscope (TEM), the gap 5 was seen to be formed near a boundary between the device electrode 2 and the substrate 1.

Tenth Embodiment

In this embodiment, an image forming apparatus 100 schematically shown in FIG. 26 is formed. As an electron emitting device 102, the electron emitting device manufactured by the manufacturing method shown in FIGS. 16 and 17 is used. The method of manufacturing the image forming apparatus of this embodiment will be described below with reference to FIGS. 19 to 25, 26, and 27.

FIG. 25 is an enlarged partial view schematically showing an electron source comprising a rear plate, a plurality of electron emitting devices formed on the rear plate, and wirings for applying signals to the plurality of electron emitting devices. In FIG. 25, reference numeral 1 denotes the rear plate, reference numeral 5 denotes an electron emitting device, reference numerals 2 and 3 each denote an electrode, reference numeral 4' denotes a conductive film (carbon film) mainly composed of carbon, reference numeral 62 denotes an X-direction wiring, reference numeral 63 denotes a Y-direction wiring, and reference numeral 64 denotes an interlayer insulating layer.

In FIG. 26, the same reference numerals as FIG. 25 denote the same members. In FIG. 26, reference numeral 71 denotes a face plate comprising a fluorescent film 74 and an Al metal back 73, both of which are deposited on a glass substrate. Reference numeral 72 denotes a support frame, the rear plate 1, the face plate 71 and the support frame 72 constituting a vacuum sealed container.

This embodiment will be described below with reference to FIGS. 19 to 25, 26 and 16.

(Step 1)

First, platinum is deposited to a thickness of 30 nm on the glass substrate 1 by a sputtering method, and a resist pattern having an opening in a region in which the device electrode 3 is to be formed, is formed. Furthermore, platinum is deposited to a thickness of 100 nm. Then, a resist pattern corresponding to the shape of device electrodes 2 and 3 is formed, and then dry etching is performed to form the device electrodes 2 and 3. In this method, the asymmetric device electrodes 2 and 3 including the device electrode 2 having a thickness of 30 nm and the device electrode 3 having a thickness of 130 nm are formed (FIG. 19). The spacing of the electrodes 2 and 3 is 10 μm.

(Step 2)

Next, an Ag paste is printed by a screen printing method, and then baked to form the X-direction wirings 62 (FIG. 20).

(Step 3)

Then, an insulating paste is printed so as to be placed at each of intersections of the X-direction wirings 62 and Y-direction wirings 63 (that are to be disposed) by a screen printing method, and then baked to form the insulating layers 64 (FIG. 21).

(Step 4)

Furthermore, an Ag paste is printed by a screen printing method, and then baked to form the Y-direction wirings 63 (FIG. 22).

(Step 5)

Figure 23:
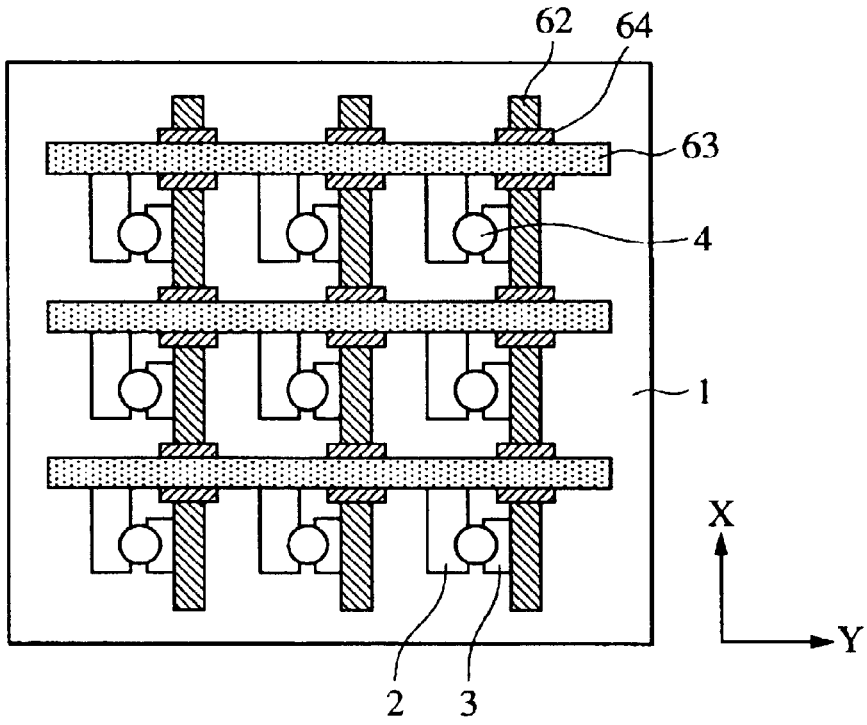
FIG. 23 is a schematic drawing showing a step performed after the step shown in FIG. 22.

A solution of 2% a polyamic acid, which is a polyimide precursor, and 3% triethanolamine in N-methylpyrrolidone is coated, by an ink jet printing method, across each pair of the device electrodes 2 and 3 on the substrate 1 having the matrix wirings 62 and 63 formed thereon so that the coating center is positioned between each pair of the electrodes 2 and 3. The coating is then baked at a temperature or 350° C. in a vacuum to form polymer films 4 each comprising a circular polyimide film having a diameter of about 100 μm and a thickness of 300 nm (FIG. 23).

(Step 6)

Next, the rear plate 1 on which the Pt electrodes 2 and 3, the matrix wirings 62 and 63, and the polymer films 4 each comprising a polyimide film are formed, is set on a stage (not shown), and the entire region of each of the polymer films 4 is irradiated with a second harmonic (SHG) of Q switch pulse ND: YAG laser (pulse width 100 nsec, repetition frequency 10 kHz, beam diameter 5 μm). In this step, the resistance of each of the polyimide films is decreased. As a result of Raman spectroscopic analysis of the decreased-resistance polyimide films, it was found that each of the polyimide films was transformed to a carbon films 4' containing a graphite component.

(Step 7)

Then, the support frame 72 and a spacer 101 are bonded, with frit glass, to the rear pate 1 formed as described above. Then, the rear plate 1, to which the spacer 101 and the support frame 72 are bonded, and the face plate 71 are arranged opposite to each other so that the surface on which the fluorescent film 74 and the metal back 73 are formed faces the surface on which the wirings 62 and 63 are formed (FIG. 27A). In this step, the frit glass is previously coated on the surface of the face plate 71, which opposes the support frame 72.

(Step 8)

Figure 27B:
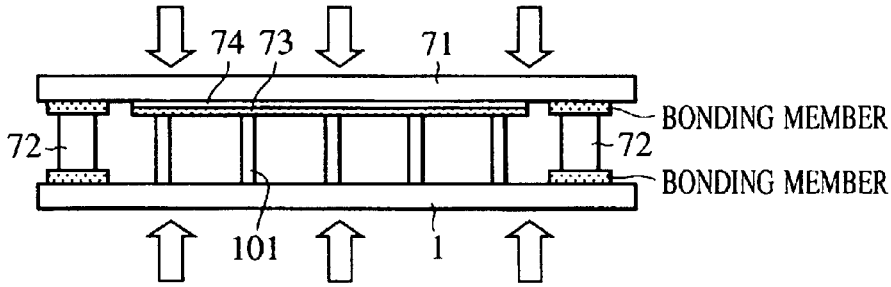

Then the opposing face plate 71 and rear plate are sealed by heating at 400° C. under pressure in a vacuum atmosphere of $10^{-6}$ Pa (FIG. 27B). In this step, an airtight container maintaining a high vacuum therein is obtained. The fluorescent film 74 comprises fluorescent materials, which respectively have the primary colors of R (red), G (green) and B (blue), and which are arranged in stripes.

Finally, a rectangular pulse with a pulse width of 1 msec and a pulse interval of 10 msec is applied to between the electrodes 2 and 3 of each of the devices through the X-direction wirings 62 and the Y-direction wirings 63. In this step, a gap 5 is formed in each of the carbon films 4' (refer to FIG. 25), to manufacture the image forming apparatus 100 of this embodiment.

In the image forming apparatus completed as described above, the X-direction wirings 62 are used as signal wirings to which modulation signals synchronous with scanning signals are applied, and the Y-direction wirings 63 are used as scanning wirings to which scanning signals are applied. In line-sequential driving by applying a voltage of 20 V to a desired electron emitting device, and a voltage 8 kV is applied to the metal back 73 through a high-voltage terminal Hv. As a result, a bright high quality image can be displayed with little variation over a long period of time.

Eleventh Embodiment

In this embodiment, the steps other than steps 1 and 5 are the same as in the tenth embodiment, and thus only steps 1 and 5 will be described. This embodiment is described with reference to FIG. 29. In FIG. 29, left column drawings are schematic sectional views respectively showing steps for forming an electron emitting device of this embodiment, and right column drawings are plan views respectively corresponding to the left drawings.

(Step 1)

A glass substrate 1 is sufficiently cleaned with a detergent, pure water and an organic solvent, and electrode material Pt is deposited on the glass substrate 1 by a sputtering method. Then, electrodes 2 and 3 are formed by a photolithography process (FIG. 29A).

(Step 5)

Figure 30:
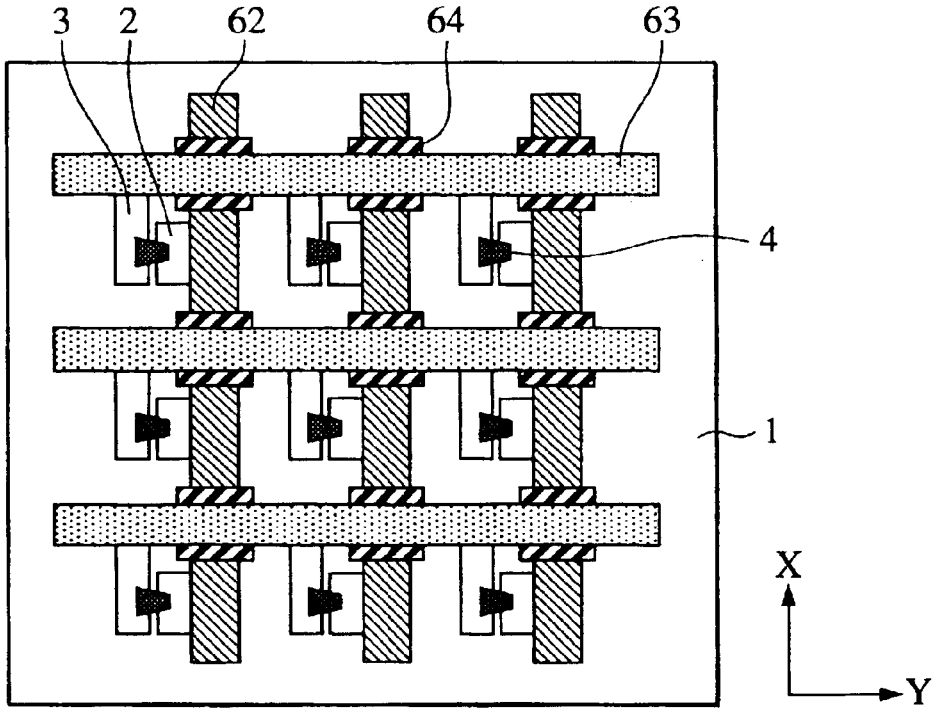
FIG. 30 is a schematic drawing showing a step for manufacturing a simple matrix arrangement electron source of the present invention.

A solution of polyamic acid (produced by Hitachi Chemical Co., Ltd.: PIX-L110) which is an aromatic polyimide precursor, is diluted with a N-methylpyrrolidone solvent containing 3% of triethanolamine, and spin-coated, by a spin coater, over the entire surface of the substrate 1 having matrix wirings formed thereon. Then, the coating is baked at a temperature or 350° C. in a vacuum to form a polyimide film 4" (FIG. 29B). Then, a photoresist 8 is coated (FIG. 29C), and then the polyimide film 4" is patterned by exposure (not shown), development (FIG. 29D), and etching (FIG. 29E) to form a trapezoidal polymer film 4 extending across the device electrodes 2 and 3 (FIGS. 29F and 30). In this step, the thickness of the polyimide film 4 is 30 nm, the connection length on the electrode 2 side is 50 μm, and the connection length on the electrode 3 side is 85 μm.

Figure 31:
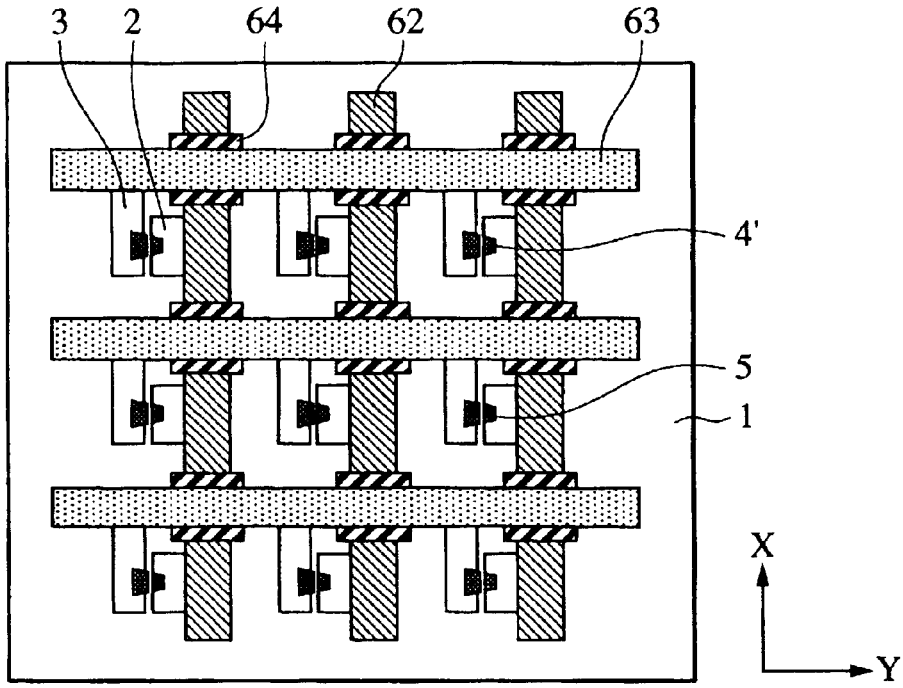
FIG. 31 is a schematic drawing showing a simple matrix arrangement electron source of the present invention.

In the image forming apparatus completed in this embodiment, the X-direction wirings 62 are used as signal wirings to which modulation signals synchronous with scanning signals are applied, and the Y-direction wirings 63 are used as scanning wirings to which scanning signals are applied. In line-sequential driving, a voltage of 20 V is applied to a desired electron emitting device, and a voltage of 8 kV is applied to the metal back 73 through a high-voltage terminal Hv. As a result, a bright high quality image can be displayed over a long period of time. As shown in FIG. 31, each of the gaps 5 is formed near the edge of the electrode 2.

Twelfth Embodiment

In this embodiment, the steps other than steps 1 and 5 are the same as those in the tenth embodiment, and thus only steps 1 and 5 will be described. The present embodiment is described with reference to FIG. 32.

(Step 1)

A Pt film is deposited to a thickness of 100 nm on a glass substrate 1 by a sputtering method, and then electrodes 2 and 3 each comprising the Pt film are formed by a photolithography process (FIG. 32A). The spacing between the electrodes is 10 μm.

(Step 5)

Figure 33:
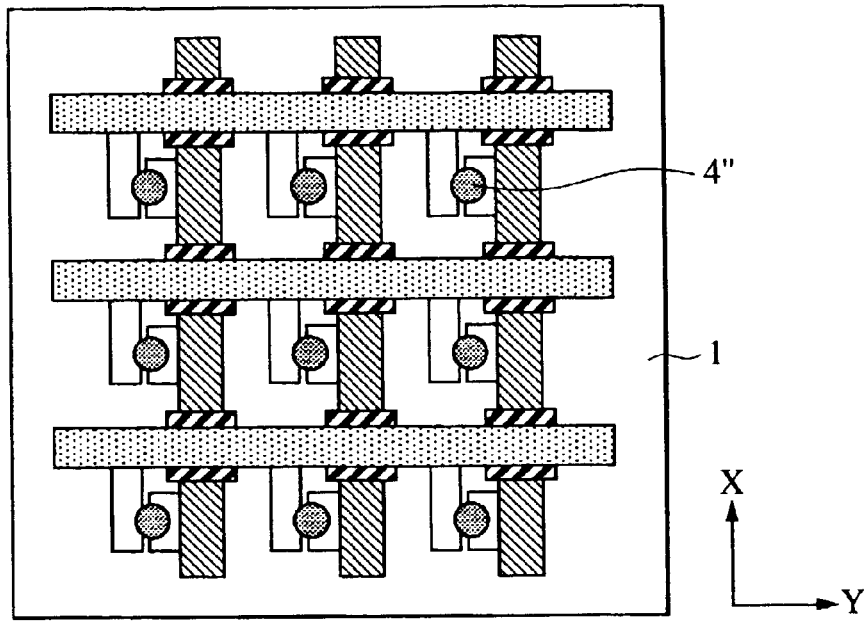
FIG. 33 is a schematic drawing showing a step for manufacturing a simple matrix arrangement electron source of the present invention.
Figure 34:
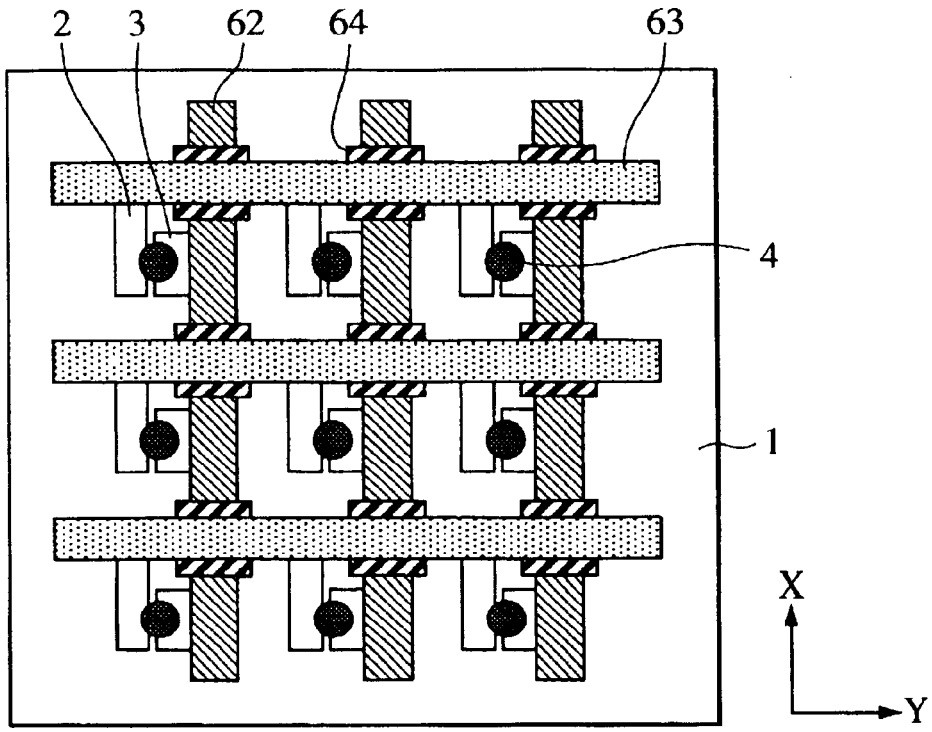
FIG. 34 is a schematic drawing showing a step for manufacturing a simple matrix arrangement electron source of the present invention.

Droplets 4" of a solution of 2% polyamic acid, which is a polyimide precursor, and 3% triethanolamine in a N-methylpyrrolidone solvent are coated, by an ink jet printing method, across the electrodes 2 and 3 on the substrate 1 having matrix wirings formed thereon so that the coating center is 40 μm deviated from a center line between the electrodes 2 and 3 toward the electrode 3 side (FIGS. 32B and 33). The coating is then baked at a temperature of 350° C. in a vacuum to form a polymer film 4 comprising a circular polyimide film having a diameter of about 100 μm and a thickness of 300 nm (FIGS. 32C and 34).

In this embodiment, in order that the connection length between the polymer film 4 and the electrode 2 is different from the connection length between the polymer film 4 and the electrode 3, the solution of a polymer or a polymer precursor is added dropwise to a position deviated from the center between the electrodes 2 and 3 by any desired length (FIG. 33B). The deviation is determined in consideration of the distance between the electrodes 2 and 3, the connection length between the polymer film 4 and each of the electrodes 2 and 3, the amount of the droplets applied, and the surface conditions of the substrate 1 and the electrodes 2 and 3.

Figure 35:
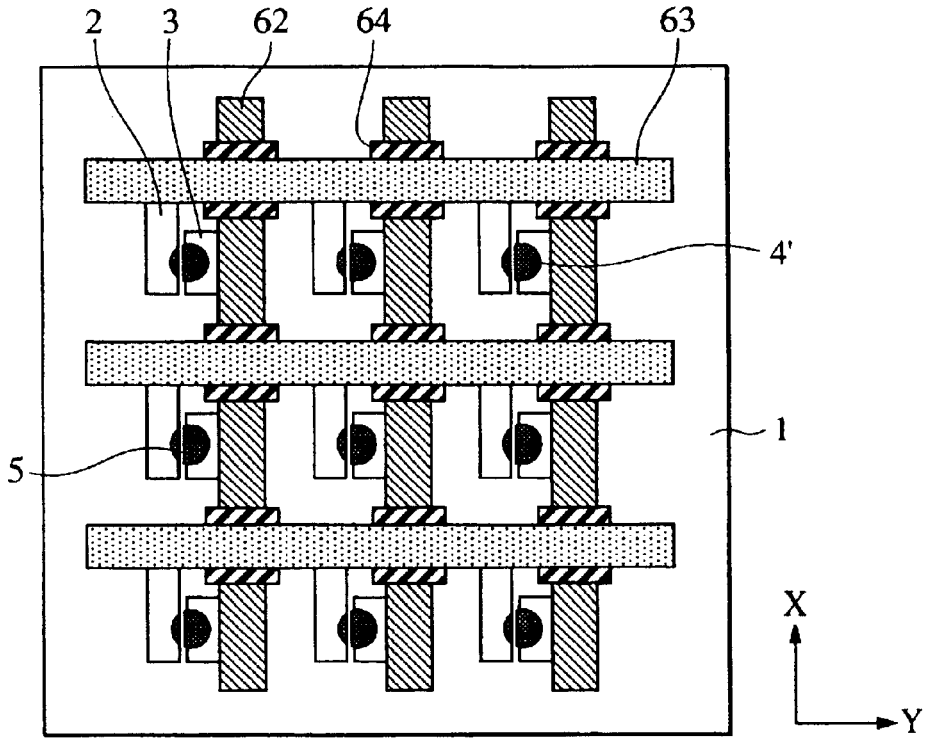
FIG. 35 is a schematic drawing showing a simple matrix arrangement electron source of the present invention.

In the image forming apparatus completed in this embodiment, the X-direction wirings 62 are used as signal wirings to which modulation signals synchronous with scanning signals are applied, and the Y-direction wirings 63 are used as scanning wirings to which scanning signals are applied. In line-sequential driving, a voltage of 20 V is applied to a desired electron emitting device, and a voltage of 8 kV is applied to the metal back 73 through a high-voltage terminal Hv. As a result, a bright high quality image can be displayed over a long period of time. As shown in FIG. 35, each of the gaps 5 is formed near an inner edge of the corresponding electrode 2.

Thirteenth Embodiment

In this embodiment, the steps other than steps 1 and 5 are the same as those in the tenth embodiment, and thus only steps 1 and 5 will be described. This embodiment is described with reference to FIG. 36. In FIG. 36, left column drawings are schematic sectional views respectively showing steps for forming an electron emitting device of this embodiment, and right column drawings are plan views respectively corresponding to the left drawings.

(Step 1)

Figure 36A:
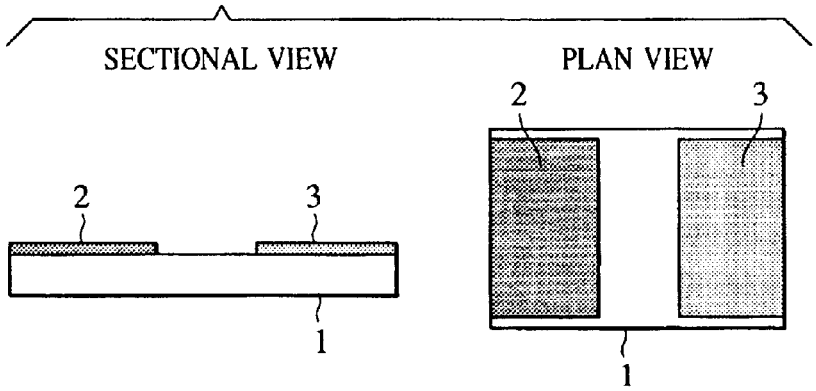
FIG. 36, consisting of FIGS. 36A to 36D, is a schematic drawing showing another step for manufacturing an electron emitting device of the present invention.

A Pt film is deposited to a thickness of 100 nm on a glass substrate 1 by a sputtering method, and then electrodes 2 and 3 each comprising the Pt film are formed by a photolithography process (FIG. 36A). The spacing between the electrodes is 10 μm.

(Step 5)

Figure 36B:
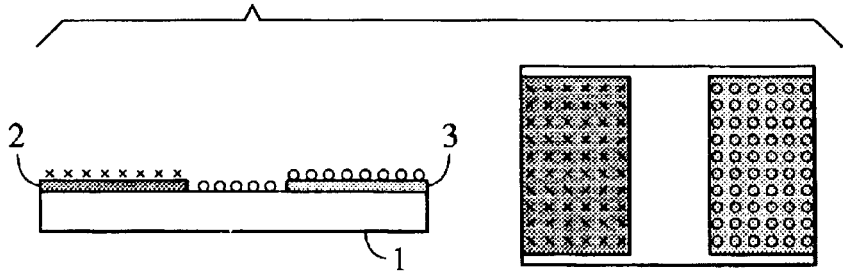
Figure 36C:
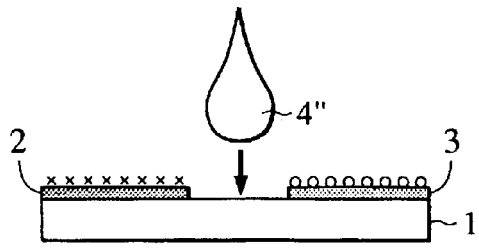
Figure 36D:
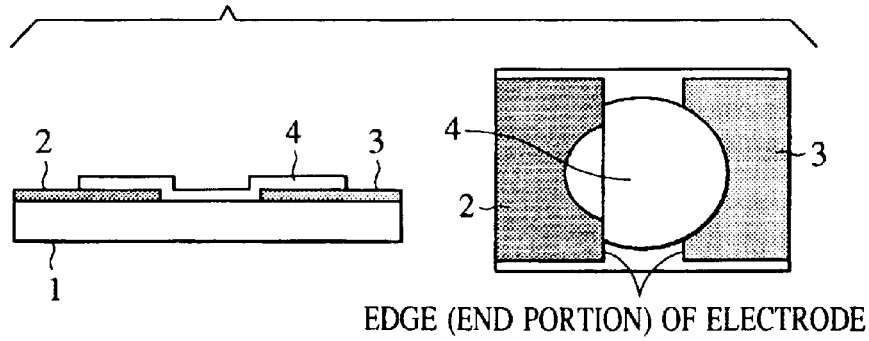
Figure 37:
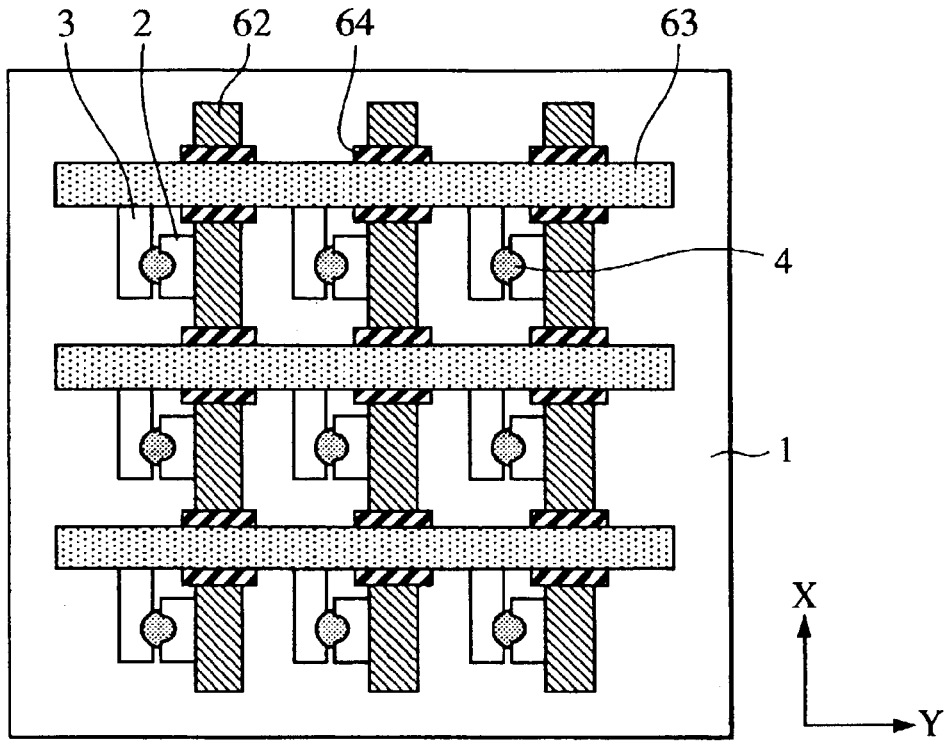
FIG. 37 is a schematic drawing showing a step for manufacturing a simple matrix arrangement electron source of the present invention.

A treatment is performed so that a surface energy of the electrode 2 is different from a surface energy of the electrode 3 (FIG. 36B). Droplets 4" of a solution of 2% polyamic acid and 3% triethanolamine in a N-methylpyrrolidone solvent are coated, by an ink jet printing method, across the electrodes 2 and 3 on the substrate 1 having matrix wirings formed thereon so that a coating center is positioned substantially at a center between the electrodes 2 and 3 (FIG. 36C). The coating is then baked at a temperature of 350° C. in a vacuum to form a polymer film 4 (FIGS. 36D and 37).

When the solution is applied across a pair of the electrodes 2 and 3 having different surface energies, a droplet less spreads to a lesser degree on the electrode which has a lower surface energy to cause a narrow adhesion area of the droplet, while a droplet easily spreads on the electrode having a higher surface energy to cause a wide adhesion area of the droplet. Therefore, the connection length between the polymer film 4 and one of the electrodes 2 and 3 can be differentiated from the connection length between the polymer film 4 and the other one of those electrodes 2 and 3. In this embodiment, the surface energy of the upper surface of the substrate between the electrodes 2 and 3 preferably coincides with the surface energy of the electrode which has the higher surface energy.

Which of the substrates 2 and 3 has a higher (lower) surface energy is appropriately determined according to the position of the gap 5 to be formed near one of the electrodes.

In this embodiment, the electrode 2 is washed with an alkali with the electrode 3 being masked to set the surface energy of the electrode 2 to be lower than the surface energy of the electrode 3. Besides the above method, various methods can be used as the method of differentiating the surface energy of the electrode 2 from the surface energy of the electrode 3. An example of such a method is a method of exposing one of the electrodes to an atmosphere containing an organic material.

Also, the surface energy of the electrode 2 can be differentiated from the surface energy of the electrode 3 by forming the electrodes 2 and 3 having different compositions. Specifically, a method of forming the electrodes 2 and 3 by using different materials, a method of forming the electrodes 2 and 3 by using materials having different compositions, etc. can be used.

Examples of the method of forming the electrodes 2 and 3 by using materials having different compositions include a method comprising forming the electrodes 2 and 3 by using materials having substantially the same composition, and then doping one of the electrodes with a predetermined material, a method comprising forming the electrodes 2 and 3 by using materials having substantially the same composition, and diffusing a material portion contained in a component connected to at least one of the electrodes to the electrode connected to the component.

Examples of a method for diffusing a material portion to one of the electrodes include (1) a method in which the component connected to one of the electrodes is heated, (2) a method in which two components are connected to both electrodes 2 and 3 so that the distance between one of the components and a center line between the electrodes 2 and 3 is different from the distance between the other component and the center line, and then heated, and (3) a method in which two components are connected to both electrodes 2 and 3 so that the connection area between the electrode 2 and the component is different from the connection area between the electrode 3 and the component, and the components are heated, and the like.

In the diffusion method, the standard single electrode potential (standard electrode potential) of a material desired to be diffused is set to be lower than that of the material of the electrode to which the material is desired to be diffused.

Figure 39:
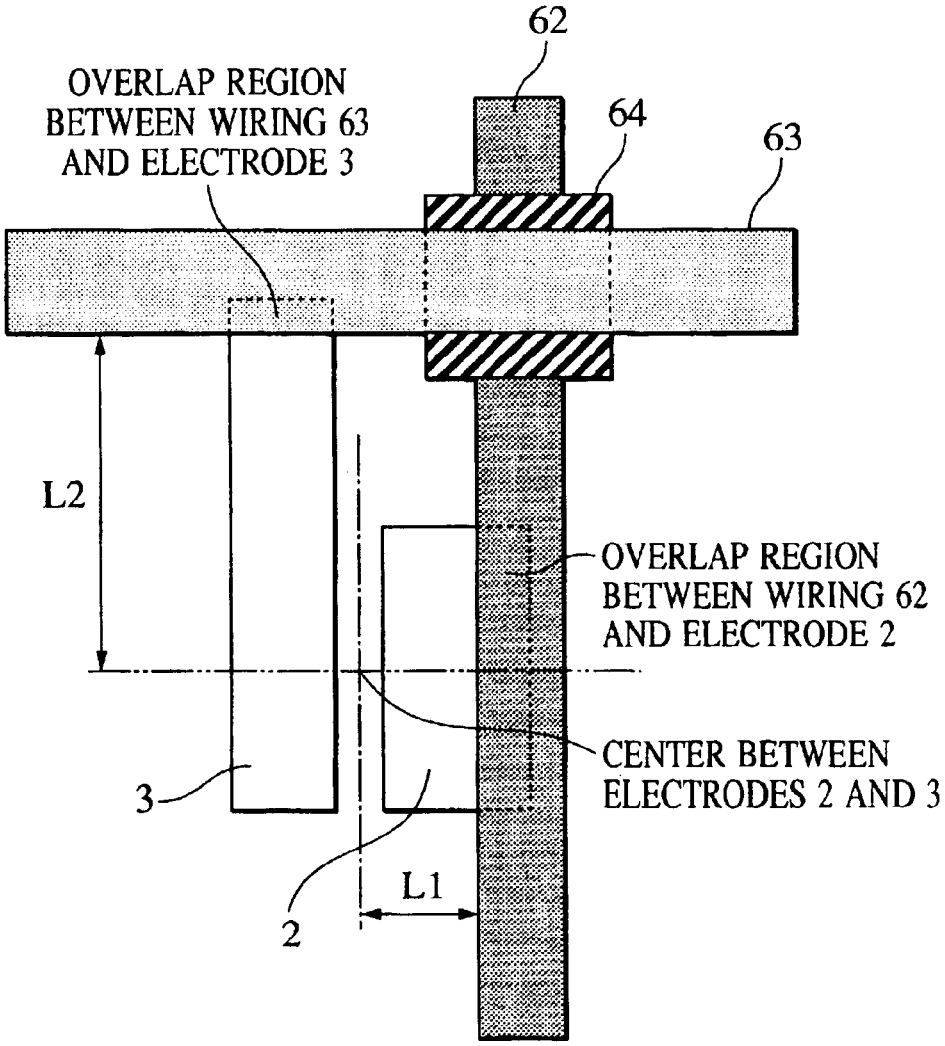
FIG. 39 is a schematic drawing showing the arrangement of device electrodes according to the present invention.
Figure 40A:
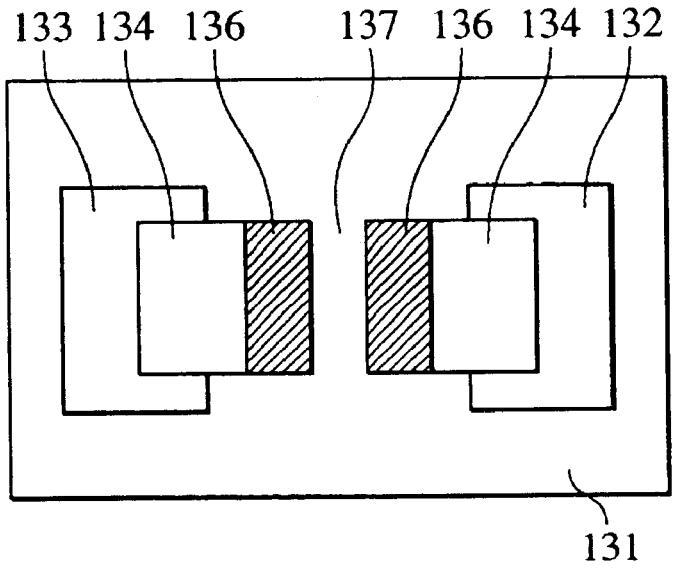
FIGS. 40A and 40B are a schematic plan view and a sectional view showing a conventional electron emitting device.
Figure 40B:
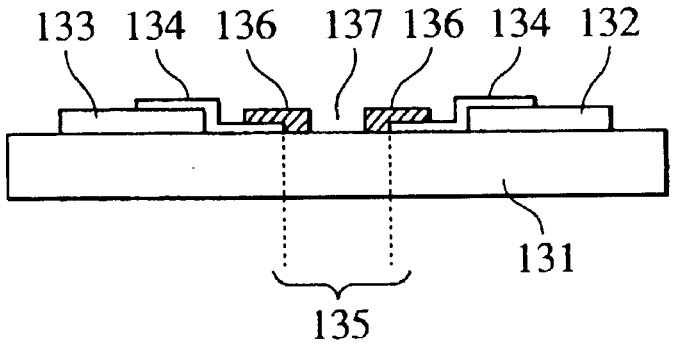
PRIOR ART FIG. 40B
Figure 41A:
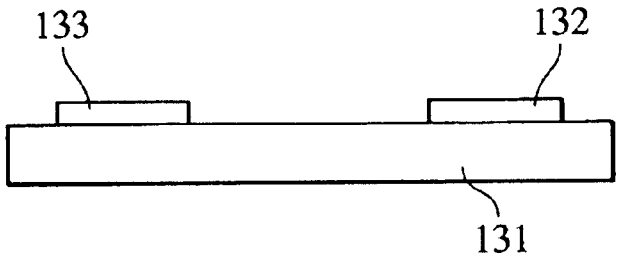
FIG. 41, consisting of FIGS. 41A to 41D, is a schematic drawing showing steps for manufacturing a conventional electron emitting device.
Figure 41B:
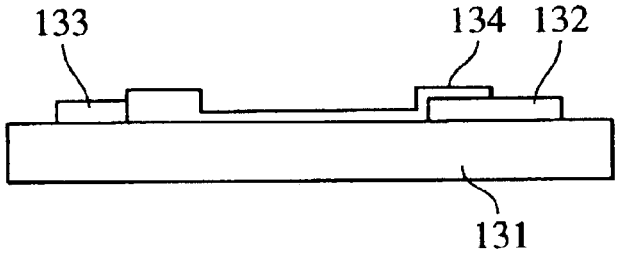
PRIOR ART FIG. 41B
Figure 41C:
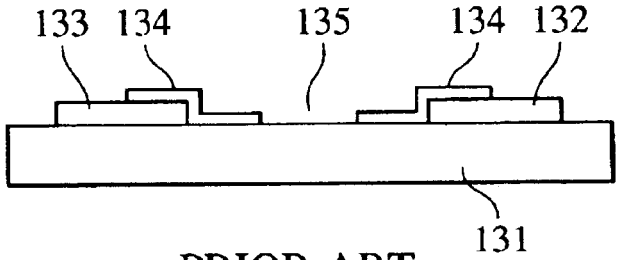
PRIOR ART FIG. 41C
Figure 41D:
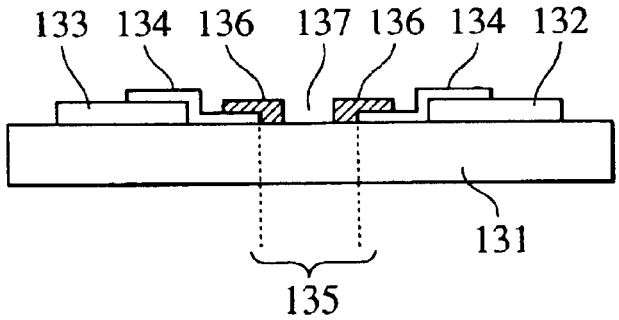
PRIOR ART FIG. 41D

For example, in the electron source of this embodiment, the wirings 62 and 63 are formed by using Ag as a main component, and Pt is selected as a material for the electrodes 2 and 3. Furthermore, in the above method (2), for example, as shown in FIG. 39, the distances (L1 and L2) from the center between the electrodes 2 and 3 to the wirings (62 and 63) respectively connected to the electrodes 2 and 3 and containing a material (Ag) desired to be diffused are differentiated. In this method, the diffusion length to the electrode 2 adjacent to the polymer film can be differentiated from the diffusion length to an edge of the electrode 3. As a result, by heating the wirings 62 and 63, Ag can be more diffused to the electrode 2 at a smaller distance from the wiring.

In the method (3), for example, as shown in FIG. 39, a contact area between the electrode 2 and the wiring 62 containing a material desired to be diffused is differentiated from a contact area between the electrode 3 and the wiring 63 containing the material desired to be diffused. Furthermore, as shown in FIG. 39, the methods (2) and (3) are simultaneously satisfied to obtain a further effect.

Although, in the above examples, both the wirings 62 and 63 are heated, diffusion can be performed by heating only the wirings connected to the electrode to which a material is desired to be diffused.

Figure 38:
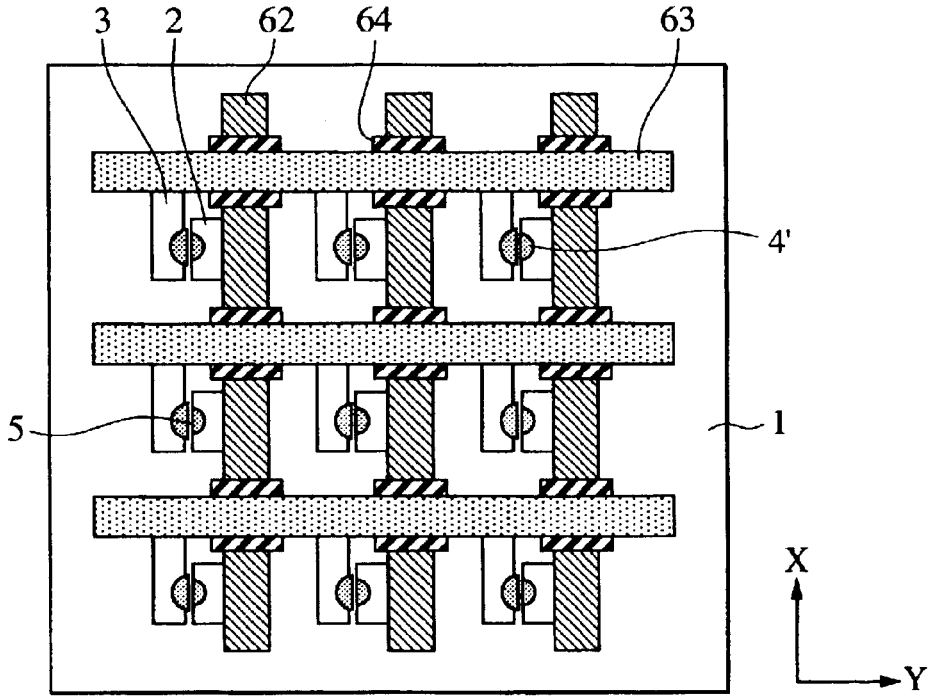
FIG. 38 is a schematic drawing showing a simple matrix arrangement electron source of the present invention.

In the image forming apparatus completed in this embodiment, the X-direction wirings 62 are used as signal wirings to which modulation signals synchronous with scanning signals are applied, and the Y-direction wirings 63 are used as scanning wirings to which scanning signals are applied. In line-sequential driving, a voltage of 20 V is applied to a desired electron emitting device, and a voltage of 8 kV is applied to the metal back 73 through a high-voltage terminal Hv. As a result, a bright high quality image can be displayed over a long period of time. As shown in FIG. 38, each of the gaps 5 is formed near an inner edge of the electrode 2.

The present invention permits the high-reproducibility manufacture of an electron emitting device comprising an electron emission section formed at a predetermined portion near an electrode, and exhibiting a high efficiency electron emission and uniform characteristics. Furthermore, an electron source comprising a plurality of electron emitting devices, or an image display device can be manufactured by using the electron emitting device and a manufacturing method therefor of the present invention. Also, an image display device capable of displaying a high-quality uniform image in a large area can be achieved. A method of manufacturing an image forming apparatus of the present invention can simplify the process for manufacturing an electron emitting device, and can manufacture, at a low cost, an image forming apparatus exhibiting excellent uniformity and display quality over a long period of time.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An electron-emitting device comprising:

(A) first and second electrodes separated by a space and disposed on a surface of a substrate;

(B) a carbon film disposed between the first and second electrodes on the surface of the substrate, and connected to the second electrode; and (C) a gap defined between the first electrode and the carbon film connected to the second electrode;

wherein within the gap, a space between a surface of the carbon film and a surface of the first electrode at an upper position apart from the surface of the substrate is smaller than that at the surface of the substrate, and the surface of the first electrode is partially exposed in the gap.

2. An electron-emitting device according to claim 1, further comprising another carbon film disposed on the first electrode.

3. An electron-emitting device according to claim 2, wherein an interface between the first electrode and the another carbon film is exposed in the gap.

4. An electron-emitting device according to claim 2, wherein in a plane, wherein a distance between an upper surface of the another carbon film and an upper surface of the substrate is greater than a distance between the upper surface of the substrate between the electrodes and an upper surface of the carbon film which is disposed between the electrodes.

5. An electron-emitting device comprising:

(A) first and second electrodes disposed on a surface of a substrate; and (B) a carbon film having a gap and disposed between the first and second electrodes on the surface of the substrate so that a first portion of the carbon film covers a portion of the first electrode, and a second portion of the carbon film covers a portion of the second electrode, wherein a part of a surface of the first electrode is exposed in the gap, and a width of the gap at an upper position apart from the surface of the substrate is smaller than that at the surface of the substrate.

6. An electron-emitting device according to claim 5, wherein an interface between the first electrode and the first portion of the carbon film disposed on the first electrode is exposed in the gap.

7. An electron-emitting device according comprising:

(A) first and second electrodes disposed with a space therebetween on a surface of a substrate; and (B) a carbon film disposed between the first and second electrodes on the surface of the substrate so that one end portion of the carbon film covers a portion of the second electrode, wherein a gap is at least partially defined by the other end portion of the carbon film and the first electrode.

8. An electron-emitting device according to claim 7, wherein a distance between the other end portion of the carbon film and the first electrode, at the surface of the substrate, is greater than that at an upper position away from the surface of the substrate.

9. An electron-emitting device according to claim 7, further comprising another carbon film disposed on the first electrode.

10. An electron-emitting device according to claim 9, wherein a distance between an upper surface of the another carbon film from an upper surface of the substrate is greater than a distance between the upper surface of the substrate between the electrodes and an upper surface of the carbon film which is disposed between the electrodes.

11. An electron-emitting device according to claim 9, wherein an interface between the first electrode and the another carbon film disposed on the first electrode is exposed in the gap.

12. An electron-emitting device comprising:

(A) first and second electrodes disposed on a surface of a substrate; and (B) a carbon film having a gap and disposed between the first and second electrodes on the surface of the substrate so that one end of the carbon film covers a portion of the first electrode, and the other end of the carbon film covers a portion of the second electrode, wherein at least part of a surface of the first electrode is exposed in the gap.

13. An electron-emitting device according to claim 12, wherein an interface between the first electrode and the end of the carbon film disposed on the first electrode is exposed in the gap.

14. An electron-emitting device comprising:

(A) first and second electrodes disposed on a surface of a substrate; and (B) a carbon film disposed between the first and second electrodes on the surface of the substrate so that one end portion of the carbon film covers a portion of the second electrode;

wherein another end portion of the carbon film faces the first electrode with a space interposed therebetween.

15. An electron-emitting device according to claim 14 wherein the another end portion of the carbon film is spaced apart from the surface of the substrate.

16. An electron-emitting device according to claim 14, further comprising another carbon film disposed on the first electrode.

17. An electron-emitting device according to claim 16, wherein a distance between an upper surface of the another carbon film from an upper surface of the substrate is greater than a distance between the upper surface of the substrate between the electrodes and an upper surface of the carbon film which is disposed between the electrodes.

18. An electron-emitting device according to claim 1, wherein at least a portion of the surface of the substrate exposed in the gap, is concave.

19. An electron-emitting device according to claim 1, wherein a plurality of electron emission sections are disposed in the gap.

20. An electron-emitting device according to claim 1, wherein when a voltage is applied across the first and second electrodes, an asymmetric electron emission property is exhibited according to a direction of an electric field applied between the first and second electrodes.

21. An electron-emitting device according to claim 1, wherein a width of the gap in a direction of which the first and second electrodes are facing is 50 nm or less.

22. An electron-emitting device according to claim 1, wherein a width of the gap in a direction of which the first and second electrodes are facing is 10 nm or less.

23. An electron-emitting device according to claim 1, wherein a width of the gap in a direction of which the first and second electrodes are facing is 5 nm or less.

24. An electron source comprising a plurality of electron emitting devices, each being an electron-emitting device according to claim 1.

25. An image display device comprising an electron source according to claim 24, and a light emitting member.

26. A method of manufacturing an electron-emitting device, comprising the steps of:

(A) forming a pair of electrodes and a polymer film for connecting the electrodes on a substrate;

(B) decreasing a resistance of the polymer film; and (C) forming a gap in a film obtained by decreasing the resistance of the polymer film;

wherein step (C) comprises supplying a current, through the pair of electrodes, to the film obtained by decreasing the resistance of the polymer film so that the Joule heat generated near an end of one of the electrodes is higher than Joule heat generated near an end of another one of the electrodes.

27. A method of manufacturing an electron-emitting device, comprising the steps of:

(A) forming a pair of electrodes and a polymer film for connecting the electrodes on a substrate so that a contact resistance between one of the electrodes and the polymer film is different from the contact resistance between another one of the electrodes and the polymer film;

(B) decreasing a resistance of the polymer film; and (C) forming a gap in a film obtained by decreasing the resistance of the polymer film;

wherein the gap is formed by supplying a current, through the pair of electrodes, to the film obtained by decreasing the resistance of the polymer film.

28. A method of manufacturing an electron-emitting device, comprising the steps of:

(A) forming, on a substrate, a pair of electrodes and a polymer film for connecting the electrodes by covering a portion of each of the electrodes;

(B) decreasing a resistance of the polymer film; and (C) forming a gap in a film obtained by decreasing the resistance of the polymer film;

wherein the polymer film is formed so that a step coverage of a portion which partially covers one of the electrodes is different from a step coverage of a portion which partially covers another one of the electrodes; and the gap is formed by supplying, through the pair of electrodes, a current to the film obtained by decreasing the resistance of the polymer film.

29. A method of manufacturing an electron-emitting device, comprising the steps of:

(A) forming a pair of electrodes and a polymer film for connecting the electrodes, on a substrate, so that a configuration of one of the electrodes and the polymer film is different from a configuration of another one of the electrodes and the polymer film;

(B) decreasing a resistance of the polymer film; and (C) forming a gap in a film obtained by decreasing the resistance of the polymer film;

wherein the gap is formed by supplying, through the pair of electrodes, a current to the film obtained by decreasing the resistance of the polymer film.

30. A method of manufacturing an electron-emitting device, comprising the steps of:

(A) forming a pair of electrodes having different shapes, and a polymer film for connecting the electrodes on a substrate;

(B) decreasing a resistance of the polymer film; and (C) forming a gap in a film obtained by decreasing the resistance of the polymer film;

wherein the gap is formed by supplying, through the pair of electrodes, a current to the film obtained by decreasing the resistance of the polymer film.

31. A method of manufacturing an electron-emitting device according to claim 26, wherein the pair of electrodes are formed in different sizes.

32. A method of manufacturing an electron-emitting device according to claim 26, wherein the pair of electrodes are formed with different thicknesses.

33. A method of manufacturing an electron-emitting device according to claim 26, wherein the pair of electrodes are formed so that an angle formed by a side surface of one of the electrodes and a surface of the substrate is different from an angle formed by a side surface of another one of the electrodes and the surface of the substrate.

34. A method of manufacturing an electron-emitting device, comprising the steps of:

(A) forming a pair of electrodes comprising different materials, and a polymer film for connecting the electrodes on a substrate;

(B) decreasing a resistance of the polymer film; and (C) forming a gap in a film obtained by decreasing the resistance of the polymer film;

wherein the gap is formed by supplying, through the pair of electrodes, a current to the film obtained by decreasing the resistance of the polymer film.

35. A method of manufacturing an electron-emitting device, comprising the steps of:

(A) forming a pair of electrodes having different surface energies on a substrate;

(B) forming a polymer film for connecting the electrodes disposed on the substrate;

(C) decreasing a resistance of the polymer film; and (D) forming a gap in a film obtained by decreasing the resistance of the polymer film;

wherein the polymer film for connecting the electrodes is formed by coating the substrate with a solution of a polymer constituting the polymer film or a solution of a precursor of the polymer, and then heating the substrate with the solution coated thereon, and wherein the gap is formed by supplying, through the pair of electrodes, a current to the film obtained by decreasing the resistance of the polymer film.

36. A method of manufacturing an electron-emitting device, comprising the steps of:

(A) forming a pair of electrodes having different compositions on a substrate;

(B) forming a polymer film for connecting the electrodes disposed on the substrate;

(C) decreasing a resistance of the polymer film; and (D) forming a gap in a film obtained by decreasing the resistance of the polymer film;

wherein the polymer film for connecting the electrodes is formed by coating the substrate with a solution of a polymer constituting the polymer film or a solution of a precursor of the polymer, and then heating the substrate with the solution coated thereon, and wherein the gap is formed by supplying, through the pair of electrodes, a current to the film obtained by decreasing the resistance of the polymer film.

37. A method of manufacturing an electron-emitting device according to claim 34, wherein the pair of electrodes is formed with a pair of conductive members comprising substantially a same material, and by adding a different material to at least one of the pair of conductive members.

38. A method of manufacturing an electron-emitting device according to claim 34, wherein the pair of electrodes is formed by connecting at leas one of a pair of conductive members comprising substantially a same material to a member comprising a material having a lower standard electrode potential than that of the material of the conductive members, and heating at least the member comprising the material having a lower standard electrode potential than that of the material of the conductive members.

39. A method of manufacturing an electron-emitting device, comprising the steps of:

(A) forming a pair of electrodes and a polymer film for connecting the electrodes on a substrate so that a connection length between one of the electrodes and the polymer film is different in length from a connection length between the other electrode and the polymer film;

(B) decreasing a resistance of the polymer film; and (C) forming a gap in a film obtained by decreasing the resistance of the polymer film;

wherein the gap is formed by supplying, through the pair of electrodes, a current to the film obtained by decreasing the resistance of the polymer film.

40. A method of manufacturing an electron-emitting device according to claim 39, wherein each connection length is between the polymer film and an end of a corresponding one of the electrodes.

41. A method of manufacturing an electron-emitting device according to claim 39, wherein each connection length is a portion of contact between the polymer film and at least one of the substrate and a corresponding one of the electrodes.

42. A method of manufacturing an electron-emitting device, comprising the steps of:

(A) forming a pair of electrodes and a polymer film for connecting the electrodes on a substrate;

(B) decreasing a resistance of the polymer film so that the resistance of a portion of the polymer film near one of the electrodes is lower than the resistance of another portion of the polymer film near another one of the electrodes; and (C) forming a gap in a film obtained by decreasing the resistance of the polymer film by supplying, through the pair of electrodes, a current to the film obtained by decreasing the resistance of the polymer film.

43. A method of manufacturing an electron-emitting device according to claim 26, wherein the polymer film is formed by applying, by an ink jet method, a solution of a polymer constituting the polymer film or a solution of a precursor of the polymer, to at least the substrate.

44. A method of manufacturing an electron-emitting device according to claim 26, wherein the step of decreasing the resistance of the polymer film comprises irradiating the polymer film with a particle beam or light.

45. A method of manufacturing an electron-emitting device according to claim 44, wherein the particle beam is an electron beam.

46. A method of manufacturing an electron-emitting device according to claim 44, wherein the particle beam is an ion beam.

47. A method of manufacturing an electron-emitting device according to claim 44, wherein the light is a laser beam.

48. A method of manufacturing an electron source comprising a plurality of electron-emitting devices arranged on a substrate, the method comprising manufacturing each of the electron emitting devices by a method according to claim 26.

49. A method of manufacturing an image forming apparatus comprising an electron source comprising a plurality of electron-emitting devices, and an image forming member for forming an image by irradiation with electrons emitted from the electron source, the method comprising manufacturing the electron source by a method according to claim 48.

* * * * *

UNITED STATES PATENT AND TRADEMARK OFFICE

CERTIFICATE OF CORRECTION

PATENT NO. : 6,992,428 B2
APPLICATION NO. : 10/321605
DATED : January 31, 2006
INVENTOR(S) : Masafumi Kyogaku et al.

It is certified that error appears in the above-identified patent and that said Letters Patent is hereby corrected as shown below:

ON THE TITLE PAGE [56] REFERENCES CITED:

Other Publications:

After "M. Bischoff et al.; "On", "Emissio" should read --Emission--;
"R. Mull r" should read "R. Muller" and "Water-Influ nced" should read --"Water-Influenced--;
After "H. Pagnia; "Prospects", "Switch s"" should read --Switches"--;
"M.L. Elinson" should read --M.I. Elinson--;
"G. Dittmer: "El ctrical" should read --G. Dittmer; "Electrical--; and
After "A. Baba, et al.,", "form" should read --from--.

COLUMN 1:

Line 16, "Example" should read --Examples--; and
Line 22, "Advance" should read --Advances--.

COLUMN 2:

Line 52, "films" should read --film's--.

COLUMN 5:

Line 59, "hither" should read --higher--.

COLUMN 8:

Line 21, "the film" should read --of the film--; and
Line 56, "leas" should read --least--.

COLUMN 12:

Line 52, "s a" should read --as a--.

COLUMN 18:

Line 7, "deceasing" should read --decreasing--; and
Line 11, "deceasing" should read --decreasing--.

UNITED STATES PATENT AND TRADEMARK OFFICE

CERTIFICATE OF CORRECTION

PATENT NO. : 6,992,428 B2
APPLICATION NO. : 10/321605
DATED : January 31, 2006
INVENTOR(S) : Masafumi Kyogaku et al.

It is certified that error appears in the above-identified patent and that said Letters Patent is hereby corrected as shown below:

COLUMN 25:

Line 7, “like” should read --like are--; and
Line 57, “from” should be deleted.

COLUMN 30:

Line 39, “deceased-resistance” should read --decreased-resistance--.

COLUMN 31:

Line 49, “deceased-resistance” should read --decreased-resistance--.

COLUMN 32:

Line 51, “2 an” should read --2 and--; and
Line 62, “to the” should read --to--.

COLUMN 33:

Line 2, “deceased-resistance” should read --decreased-resistance--.

COLUMN 34:

Line 1, “4’is” should read --4′ is--; and
Line 37, “deceased-resistance” should read --decreased-resistance--.

COLUMN 41:

Line 12, “2% a” should read --2%--;
Line 33, “films” should read --film--; and
Line 67, “and” should be deleted.

COLUMN 45:

Line 62, “wherein” (second occurrence) should be deleted.

COLUMN 46:

Line 19, “according” should be deleted.

UNITED STATES PATENT AND TRADEMARK OFFICE

CERTIFICATE OF CORRECTION

PATENT NO. : 6,992,428 B2
APPLICATION NO. : 10/321605
DATED : January 31, 2006
INVENTOR(S) : Masafumi Kyogaku et al.

It is certified that error appears in the above-identified patent and that said Letters Patent is hereby corrected as shown below:

COLUMN 49:

Line 44, "leas" should read --least--.

Signed and Sealed this

Seventeenth Day of October, 2006

JON W. DUDAS
*Director of the United States Patent and Trademark Office*